US009459015B2

(12) United States Patent
Karamanos et al.

(10) Patent No.: US 9,459,015 B2
(45) Date of Patent: Oct. 4, 2016

(54) HVAC SYSTEM AND ZONE CONTROL UNIT

(75) Inventors: John Chris Karamanos, San Jose, CA (US); Douglas Edward Stuck, San Jose, CA (US)

(73) Assignee: John Chris Karamanos, San Jose, CA (US)

( * ) Notice: Subject to any disclaimer, the term of this patent is extended or adjusted under 35 U.S.C. 154(b) by 1351 days.

(21) Appl. No.: 12/956,668

(22) Filed: Nov. 30, 2010

(65) Prior Publication Data

US 2011/0155354 A1 Jun. 30, 2011
US 2016/0153671 A9 Jun. 2, 2016

Related U.S. Application Data

(63) Continuation-in-part of application No. 12/792,674, filed on Jun. 2, 2010, and a continuation-in-part of application No. 12/573,737, filed on Oct. 5, 2009, now Pat. No. 8,146,377, which is a continuation of (Continued)

(51) Int. Cl.
*F24F 3/00* (2006.01)
*F24F 3/052* (2006.01)

(Continued)

(52) U.S. Cl.
CPC ..... *F24F 3/052* (2013.01); *F24F 13/0245* (2013.01); *F28D 1/05383* (2013.01); *F28F 1/126* (2013.01); *F28F 2260/02* (2013.01); *Y10T 29/49826* (2015.01)

(58) Field of Classification Search
CPC ..... F28D 1/024; F28D 21/0012; F28D 21/0008; F24F 1/0007; F24F 11/0012; F24F 3/044; F28F 9/002; F28F 27/00
USPC ..... 165/121, 47, 300, 67; 29/428, 890.03, 29/726
See application file for complete search history.

(56) References Cited

U.S. PATENT DOCUMENTS 1,429,776 A 9/1922 Robinson
1,793,059 A 2/1931 Chambers (Continued)

FOREIGN PATENT DOCUMENTS

JP 62-008033 1/1987
JP 02-035326 2/1990

(Continued)

OTHER PUBLICATIONS

Author Unknown, Ashrae Fundamentals Handbook, 1997, p. 37.6, 1 page.

(Continued)

*Primary Examiner* — Travis Ruby
(74) *Attorney, Agent, or Firm* — Amin, Turocy & Watson, LLP

(57) ABSTRACT

Methods for installing one or more heating, ventilation, and air conditioning (HVAC) units in an HVAC system include the steps of securing inlet and outlet piping assemblies of the HVAC unit to a bracket, coupling a thermal transfer mechanism of the HVAC unit with the inlet piping assembly and the outlet piping assembly, fluidly coupling a water pump with the thermal transfer mechanism, the inlet piping assembly, or the outlet piping assembly, mounting the HVAC unit by mounting the bracket to the HVAC system, and maintaining alignment of the HVAC unit thermal transfer mechanism, the HVAC unit inlet piping assembly, and the HVAC unit outlet piping assembly while mounting the HVAC unit in the HVAC system. An HVAC unit can include a thermal transfer mechanism, inlet and outlet piping assemblies, a water pump, and a bracket.

29 Claims, 30 Drawing Sheets

Related U.S. Application Data application No. 11/429,418, filed on May 5, 2006, now Pat. No. 7,596,962.

(60) Provisional application No. 61/321,260, filed on Apr. 6, 2010, provisional application No. 61/317,929, filed on Mar. 25, 2010, provisional application No. 61/183,458, filed on Jun. 2, 2009, provisional application No. 60/755,976, filed on Jan. 3, 2006, provisional application No. 60/678,695, filed on May 6, 2005.

(51) Int. Cl.

| | |
|---|---|
| *F24F 13/02* | (2006.01) |
| *F28D 1/053* | (2006.01) |
| *F28F 1/12* | (2006.01) |

(56) References Cited

U.S. PATENT DOCUMENTS

| | | | |
|---|---|---|---|
| 2,233,273 | A | 2/1941 | Di Vincenzo |
| 2,268,360 | A | 12/1941 | Walker |
| 2,534,690 | A | 12/1950 | Young, Jr. et al. |
| 2,999,605 | A | 9/1961 | De Jarnett |
| 3,182,717 | A | 5/1965 | Pierce |
| 3,216,025 | A | 11/1965 | Roll |
| 3,463,223 | A | 8/1969 | Marino |
| 3,706,125 | A | 12/1972 | Hopkins |
| 3,734,171 | A | 5/1973 | Ares et al. |
| 3,778,537 | A | 12/1973 | Miller |
| 3,822,903 | A | 7/1974 | McNeely et al. |
| 3,968,833 | A | 7/1976 | Strindehag et al. |
| 4,099,630 | A | 7/1978 | Beck |
| 4,123,012 | A | 10/1978 | Hough |
| 4,140,227 | A | 2/1979 | Beck |
| 4,163,372 | A | 8/1979 | Frye et al. |
| 4,172,496 | A | 10/1979 | Melnyk |
| 4,182,370 | A | 1/1980 | Karcher |
| 4,184,661 | A | 1/1980 | Kushner et al. |
| 4,193,563 | A | 3/1980 | Vitale |
| 4,232,845 | A | 11/1980 | Turner |
| 4,244,542 | A | 1/1981 | Matthews |
| 4,261,529 | A | 4/1981 | Sandberg et al. |
| D263,624 | S | 3/1982 | Stenzler et al. |
| 4,328,926 | A | 5/1982 | Hall, Jr. |
| 4,343,349 | A | 8/1982 | Busch, Jr. |
| 4,473,107 | A | 9/1984 | Fairbrother et al. |
| 4,479,668 | A | 10/1984 | Jacquet |
| 4,541,602 | A | 9/1985 | Potzas |
| 4,550,891 | A | 11/1985 | Schaty |
| 4,601,447 | A | 7/1986 | McFarland |
| 4,682,647 | A | 7/1987 | Sleep |
| 4,736,480 | A | 4/1988 | Bohl et al. |
| 4,779,815 | A | 10/1988 | Moore et al. |
| 4,842,227 | A | 6/1989 | Harrington et al. |
| 4,901,957 | A | 2/1990 | Daigle et al. |
| 4,928,856 | A | 5/1990 | White |
| 4,971,139 | A | 11/1990 | Khattar |
| 5,005,636 | A | 4/1991 | Haessig |
| 5,016,843 | A | 5/1991 | Ward |
| 5,050,824 | A | 9/1991 | Hubbard |
| 5,278,740 | A | 1/1994 | Agnelli |
| 5,417,243 | A | 5/1995 | Ragona |
| 5,429,330 | A | 7/1995 | Bond et al. |
| 5,446,677 | A | 8/1995 | Jensen et al. |
| 5,458,241 | A | 10/1995 | Brown |
| 5,526,931 | A | 6/1996 | White |
| 5,551,630 | A | 9/1996 | Enoki et al. |
| 5,597,354 | A | 1/1997 | Janu et al. |
| 5,689,880 | A | 11/1997 | Petty |
| 5,771,954 | A | 6/1998 | Benner et al. |
| 5,850,037 | A | 12/1998 | Mullins |
| 5,860,627 | A | 1/1999 | Edwards |
| 5,868,361 | A | 2/1999 | Rinderer |
| 5,986,562 | A | 11/1999 | Nikolich |
| 6,079,626 | A | 6/2000 | Hartman |
| 6,135,381 | A | 10/2000 | Teson |
| 6,142,405 | A | 11/2000 | Black |
| 6,170,784 | B1 | 1/2001 | MacDonald et al. |
| 6,198,047 | B1 | 3/2001 | Barr |
| 6,199,396 | B1 | 3/2001 | Aizawa |
| 6,252,171 | B1 | 6/2001 | Barr |
| 6,280,320 | B1 | 8/2001 | Paschke et al. |
| 6,363,736 | B1 | 4/2002 | Kunkel et al. |
| 6,375,017 | B1 | 4/2002 | Schattner et al. |
| 6,385,510 | B1 | 5/2002 | Hoog et al. |
| 6,409,223 | B1 | 6/2002 | Bartholoma |
| 6,536,516 | B2 | 3/2003 | Davies et al. |
| 6,557,574 | B2 | 5/2003 | Federspiel |
| 6,564,819 | B2 | 5/2003 | Zelczer |
| 6,578,319 | B1 | 6/2003 | Cole et al. |
| 6,702,237 | B2 | 3/2004 | Rubenstein et al. |
| D490,690 | S | 6/2004 | Brass et al. |
| 6,834,714 | B2 * | 12/2004 | Walsh ..... 165/220 |
| 6,868,293 | B1 | 3/2005 | Schurr et al. |
| 6,951,324 | B2 | 10/2005 | Karamanos |
| 6,996,943 | B2 | 2/2006 | Denier et al. |
| 7,092,794 | B1 | 8/2006 | Hill et al. |
| 7,140,236 | B2 | 11/2006 | Karamanos |
| 7,165,797 | B2 | 1/2007 | Karamanos |
| 7,233,125 | B2 * | 6/2007 | Ramamoorthy et al. ..... 318/801 |
| 7,243,004 | B2 | 7/2007 | Shah et al. |
| 7,274,973 | B2 | 9/2007 | Nichols et al. |
| 7,343,226 | B2 | 3/2008 | Ehlers et al. |
| 7,387,013 | B2 | 6/2008 | Karamanos |
| 7,444,731 | B2 | 11/2008 | Karamanos |
| 7,478,761 | B2 | 1/2009 | Karamanos et al. |
| 7,537,183 | B2 | 5/2009 | Karamanos |
| 7,540,455 | B2 | 6/2009 | Wunderlich et al. |
| 7,596,962 | B2 | 10/2009 | Karamanos |
| 7,806,629 | B2 | 10/2010 | McCoy |
| 7,856,865 | B2 | 12/2010 | Karamanos |
| 7,937,820 | B2 | 5/2011 | Karamanos |
| 7,942,371 | B1 | 5/2011 | McCoy |
| 8,235,331 | B2 | 8/2012 | McIntosh |
| 8,469,782 | B1 | 6/2013 | Roy |
| 8,523,643 | B1 | 9/2013 | Roy |
| 2002/0080032 | A1 | 6/2002 | Smith et al. |
| 2002/0088273 | A1 | 7/2002 | Harness et al. |
| 2003/0050871 | A1 | 3/2003 | Broughton |
| 2003/0080259 | A1 | 5/2003 | Robicheau et al. |
| 2003/0085022 | A1 | 5/2003 | Viso |
| 2003/0085023 | A1 | 5/2003 | Viso |
| 2003/0171092 | A1 | 9/2003 | Karamanos |
| 2003/0178535 | A1 | 9/2003 | Jette |
| 2003/0222185 | A1 | 12/2003 | Rubenstein et al. |
| 2004/0104322 | A1 | 6/2004 | Hennequin |
| 2004/0108105 | A1 | 6/2004 | Dwyer |
| 2004/0159110 | A1 | 8/2004 | Janssen |
| 2004/0253918 | A1 | 12/2004 | Ezell et al. |
| 2005/0039470 | A1 | 2/2005 | Laing et al. |
| 2005/0056752 | A1 | 3/2005 | Karamanos |
| 2005/0056753 | A1 | 3/2005 | Karamanos |
| 2005/0284988 | A1 | 12/2005 | Lawver |
| 2006/0130561 | A1 | 6/2006 | Karamanos |
| 2006/0231689 | A1 | 10/2006 | Caminita |
| 2006/0249589 | A1 | 11/2006 | Karamanos |
| 2006/0287774 | A1 | 12/2006 | Yoon et al. |
| 2007/0262162 | A1 | 11/2007 | Karamanos |
| 2008/0135648 | A1 | 6/2008 | Smiltneek et al. |
| 2008/0164006 | A1 | 7/2008 | Karamanos |
| 2008/0195254 | A1 | 8/2008 | Jung et al. |
| 2009/0012650 | A1 | 1/2009 | Wang et al. |
| 2009/0057499 | A1 | 3/2009 | Karamanos |
| 2009/0062964 | A1 | 3/2009 | Sullivan et al. |
| 2009/0090549 | A1 | 4/2009 | Betz |
| 2010/0252641 | A1 | 10/2010 | Karamanos |
| 2010/0307733 | A1 | 12/2010 | Karamanos et al. |
| 2012/0168113 | A1 | 7/2012 | Karamanos |
| 2012/0186289 | A1 | 7/2012 | Karamanos |

FOREIGN PATENT DOCUMENTS

| | | | |
|---|---|---|---|
| JP | 3221773 | A | 9/1991 |
| JP | 5042818 | A | 2/1993 |

(56) References Cited

FOREIGN PATENT DOCUMENTS

| | | | |
|---|---|---|---|
| JP | 7055195 | A | 3/1995 |
| JP | 8005092 | | 1/1996 |
| JP | 8189717 | A | 7/1996 |
| JP | 2000046375 | A | 2/2000 |
| JP | 20011004199 | A | 1/2001 |
| WO | 2005119196 | | 12/2005 |

OTHER PUBLICATIONS

Model SDR Catalog, "Standard Construction Features", Environmental Technologies, Inc., Oct. 2001, pp. 6-9 and 12-13.
Office Action dated Mar. 28, 2016 for U.S. Appl. No. 13/073,809, 14 pages.
Office Action dated Oct. 25, 2013 for U.S. Appl. No. 12/792,674, 20 pages.
Office Action dated Jun. 2, 2014 for U.S. Appl. No. 12/792,674, 12 pages.
Office Action dated Jan. 31, 2014 for U.S. Appl. No. 13/073,809, 29 pages.
Office Action dated Jul. 7, 2014 for U.S. Appl. No. 13/073,809, 18 pages.
Office Action dated Apr. 24, 2015 for U.S. Appl. No. 13/073,809, 16 pages.
PCT International Search Report mailed Aug. 13, 2008, International Application No. PCT/US06/17797, 13 pages.
Office Action dated Dec. 3, 2008 for U.S. Appl. No. 11/429,418, 22 pages.
Office Action dated Oct. 27, 2011 for U.S. Appl. No. 12/573,737, 48 pages.
Office Action dated Jan. 14, 2013 for U.S. Appl. No. 13/416,046, 27 pages.
Office Action dated May 29, 2013 for U.S. Appl. No. 13/416,046, 14 pages.
Office Action dated Jun. 1, 2016 for U.S. Appl. No. 12/792,674, 22 pages.
Office Action dated Jul. 14, 2016 for U.S. Appl. No. 13/073,809, 16 pages.

* cited by examiner

Boolean Logic Table for Change-Over Determination

| | | | | | | | | |
|---|---|---|---|---|---|---|---|---|
| Z1 | Cool | C | C | C | H | H | H | H |
| Z2 | Hot | C | C | H | H | H | C | C |
| Z3 | Cool | C | H | H | H | C | C | H |
| Chg-Over | Yes | No | Y | Y | N | Y | Y | Y |

HVAC SYSTEM AND ZONE CONTROL UNIT

CROSS-REFERENCES TO RELATED APPLICATIONS

This application is a continuation-in-part of U.S. patent application Ser. No. 12/792,674 filed Jun. 2, 2010, and is a continuation-in-part of U.S. patent application Ser. No. 12/573,737 filed Oct. 5, 2009, now U.S. Pat. No. 8,146,377, which is a continuation of U.S. patent application Ser. No. 11/429,418 filed May 5, 2006, now U.S. Pat. No. 7,596,962 which claims the benefit of priority to provisional patent application No. 60/678,695 filed May 6, 2005 and provisional patent application No. 60/755,976 filed Jan. 3, 2006. U.S. patent application Ser. No. 12/792,674 filed Jun. 2, 2010 also claims benefit of priority to provisional patent application No. 61/321,260 filed Apr. 6, 2010, provisional patent application No. 61/317,929 filed Mar. 26, 2010, and provisional patent application No. 61/317,929 filed Mar. 26, 2010.

BACKGROUND

Various embodiments described herein relate generally to the field of heating, ventilation, and air conditioning (HVAC), and more particularly to HVAC systems having distributed zone control units that locally re-circulate air within zones serviced by the zone control units. Such an HVAC system may be particularly effective for use in office building, hospitals, hotels, schools, apartments, research labs, multi-family residences, and single-family residences.

A range of approaches are used in existing HVAC systems. Existing HVAC systems include, for example, conventional forced air variable volume systems and systems employing chilled beams.

Conventional Forced Air Variable Air Volume Systems

A conventional forced air variable air volume (VAV) system distributes air and water to terminal units installed in habitable spaces throughout a building. The air and water are cooled or heated in central equipment rooms. The air supplied is called primary or ventilation air. The water supplied is called primary or secondary water. Steam may also be used. Some terminal units employ a separate electric heating coil in lieu of a hot water coil. The primary air is first tempered through a large air handling unit and then distributed to the rest of the building through conventional air duct work. The large air handling unit may consist of a supply fan, return fan, exhaust fan, cooling coil, heating coil, filters, condensate drain pans, outside air dampers, return dampers, exhaust dampers, sensors, controls, etc. Once the primary air leaves the air handling unit the primary air is distributed through out the building through air duct work and then to in-room terminal units such as air distribution units and terminal units. A single in-room terminal unit usually conditions a single space, but some (e.g., a large fan-coil unit) may serve several spaces. Air distribution units and terminal units are typically used primarily in perimeter spaces of buildings with high sensible loads and where close control of humidity is not desired; they are also sometimes used in interior zones. Conventional forced air variable air volume systems work well in office buildings, hospitals, hotels, schools, apartments, and research labs. In most climates, these VAV systems are typically installed to condition perimeter building spaces and are designed to provide all desired space heating and cooling, outside air ventilation, and simultaneous heating and cooling in different parts of the building during intermediate seasons.

A conventional forced air variable air volume system has several disadvantages. For example, because large volumes of air circulated around a building, fan energy consumption and temperature losses may be significant. To minimize energy consumption, the large air handling unit may recycle the circulated air and only add a small portion of fresh air. Such recycling, however, may result in air borne contaminants and bacteria being spread throughout the building resulting in "sick building syndrome." Other disadvantages may include draughts, lack of individual control, increased building height required to accommodate ducting, and noise associated with air velocity. Additionally, for many buildings, the use of in-room terminal units may be limited to perimeter spaces, with separate systems required for other areas. More controls may be needed as compared to other systems. In many systems, the primary air is supplied at a constant rate with no provision for shut off, which may be a disadvantage as tenants may prefer to shut off their heating or air conditioning or management may desire to do so to reduce energy consumption. In many systems, low primary chilled water temperature and or deep chilled water coils are required to control space humidity accurately, which may result in more energy consumption from a chiller, cooling tower, and/or pumps. A conventional forced air variable air volume system may not be appropriate for spaces with large exhaust requirements such as labs unless supplementary ventilation is provided. In many systems, low primary air temperatures require heavily insulated ducts. In many systems, the energy consumption is high because of the power needed to deliver primary air against the pressure drop of the terminal units. The initial cost for a VAV system may be high. In many systems, the primary air is cooled, distributed, and may be subsequently re-heated after delivery to a local zone, thus wasting energy. In many systems, individual room control is expensive as an individual terminal unit or fan coil unit is required for each zone, which may be costly to install and maintain, including for ancillary components such as controls. Moving large flow rates of air thru duct work is inefficient and wastes energy. Mold and biocides may form in the duct work and then be blown into the ambient/occupied space.

Chilled-Beam Systems

A chilled beam uses water, not air, to remove heat from a room. Chilled beams are a relatively recent innovation. Chilled beams work by pumping chilled water through radiator like elements mounted on the ceiling. As with typical air ventilation systems, chilled beams typically use water heated or cooled by a separate system outside of the space. The building's occupants and equipment (e.g., computers) heat the air, which rises and is cooled by the chilled beam creating convection currents. Radiant cooling of interior elements and exposed slab soffit enhances this convective flow. Room occupants are also cooled (or warmed) by radiant heat transfer to or from the chilled beam.

Chilled beams, however, have some disadvantages. For example, they are relatively expensive due to the use of copper coils. A chilled beam is not easy to relocate, which may require major renovation for some office space reconfigurations. They can also be expensive to install for a variety of reasons, for example, their weight may be an issue with regard to seismic codes; they may take several tradesmen to install; they may require increased piping, valves, and controls compared to other systems; and three to four chilled beams may be required for every VAV air distribution unit or fan coil unit. Air still needs to be tempered to prevent condensation from forming on the chilled beam. They may be unable to provide the indoor comfort required in large spaces. They are exposed directly to the ambient space, which may result in condensate forming on the chilled beam and dripping on to products and equipment below. Substantially unrestricted airflow to the beam is typically required. A chilled beam requires more ceiling area than diffusers of a conventional system, thus leaving less room for sprinklers and lights. This can impact the aesthetics of the interior spaces and require a higher level of coordination for other systems such as lighting, ceiling grid, and fire protection. Mechanical contractors may not be familiar with chilled beams and may charge more. Re-circulated air passing through the chilled beam is not filtered as it would be in a VAV system. A chilled beam may not be suitable for use in an area with a high latent load. Areas such as conference rooms, meeting rooms, class rooms, restaurants, or theaters with dense population may be difficult to condition with chilled beams. Portions of a building that are open to the outside air typically cannot be conditioned with chilled beams. Noise may be an issue with chilled beams due to the use of pressure nozzles, which are factory set for a certain performance, derivation from which causes noise thereby limiting the options of the building occupants. The building should have a very tight construction for humid climates. Naturally ventilated buildings may need to include a sensor to measure dew point in the space and/or window position switches that automatically raise the cooling water temperature or shut down flows to the chilled beam when high dew points are reached. Chilled beams may need to be vacuumed every year. More control valves, strainers, etc. may be desired. Typical room design temperature for chilled beams is 75 to 78 degrees F., which may be too high for healthcare and pharmaceutical applications. A chilled beam typically does not provide a radial-symmetric airflow pattern like most hospital/lab air diffusers; instead, they drive the air laterally across the top of the room, which can disrupt hood airflow patterns.

In light of the above, it would be desirable to have improved HVAC systems and components with increased advantages and/or decreased disadvantages compared to existing HVAC systems and components. In particular, improved HVAC systems and components having reduced installed cost, improved controllability, decreased energy usage, increased recyclability, increased quality, increased maintainability, decreased maintenance costs, and decreased sound would be beneficial.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present disclosure generally provides heating, ventilation, and air conditioning (HVAC) systems, components, and control systems. In many embodiments, an HVAC system includes distributed zone control units that locally re-circulate air to zones serviced by each respective zone control unit. A zone control unit can condition the re-circulated air by adding heat, removing heat, and/or filtering. A supply airflow (e.g., a flow of outside air) can be mixed in with return airflows extracted from the serviced zones, the resulting mixed airflow conditioned prior to discharge to the serviced zones. Automated control dampers and a variable speed fan(s) can be used to control flow rates of the mixed air discharged to each serviced zone, control the flow rates of the return airflows extracted from the serviced zones, and to control the flow rate of the supply airflow mixed in with the return airflows. In many embodiments, the supply airflows are provided to the distributed zone control units by a central supply airflow source, which can intake outside air and condition the outside air prior to discharging the conditioned outside air for distribution to the distributed zone control units. In many embodiments, an HVAC system includes an exhaust air system that extracts air from one or more HVAC zones and discharges the extracted air as exhaust air. In many embodiments, an HVAC system includes a heat recovery wheel for exchanging heat and moisture between the incoming outside intake air and the outgoing exhaust air. In many embodiments, an HVAC system includes one or more filters and/or a humidity adjustment device for conditioning the supply airflow prior to distribution to the distributed HVAC zone control units. In many embodiments, an HVAC zone control unit and/or the central supply airflow source incorporates one or more heat exchangers with micro-channel coils. In many embodiments, the distributed HVAC zone control units include control electronics having an Internet protocol address and can include a resident processor and memory providing local control functionality.

The disclosed HVAC systems, zone control units, and control systems provide a number of advantages. These advantages may include reduced installed system cost; improved air quality; increased Leadership in Energy and Environmental Design (LEED) points; improved quality; reduced maintenance costs; improved maintainability; reduced sound; reduced energy usage; improved control system; improved building flexibility; superior Indoor Air Quality (IAQ); exceeding American Society of Heating, Refrigerating and Air-Conditioning Engineers (ASHRAE) standards; flexible application in a variety of different types of buildings/applications; and/or reduced manufacturing costs and installed cost.

Thus, in a first aspect, a method for providing heating, ventilation, and air conditioning (HVAC) to zones of a building is provided. The method includes providing a flow of supply air from outside the zones. First and second flows of return air are extracted from a first subset of the zones and a second subset of the zones, respectively. The first and second return airflows are mixed with first and second portions of the supply airflow to form first and second mixed airflows, respectively. Heat is added to and/or removed from at least one of the first return airflow, the first supply airflow, or the first mixed airflow. Heat is added to and/or removed from at least one of the second return airflow, the second supply airflow, or the second mixed airflow. The first mixed airflow is distributed to the first subset of zones. And the second mixed airflow is distributed to the second subset of zones.

The heat can be added or removed using heat exchanging coils. Each of the first and second mixed airflows can be routed through a respective heat exchanging coil. Heat can be added to a mixed airflow by routing water having a temperature higher that a temperature of the mixed airflow within the respective heat exchanging coil. Each of the respective heat exchanging coils can include a heating coil and a cooling coil. Water having a temperature higher than the temperature of the respective mixed airflow can be routed within the respective heating coil to add heat to the respective mixed airflow. And water having a temperature lower than the temperature of the respective mixed airflow can be routed within the respective cooling coil to remove heat from the respective mixed airflow. A variable rate pump can be used to control a flow rate of water routed through the respective heat exchanging coil. A variable speed fan can be used to draw the respective mixed airflow through the respective heat exchanging coil so as to control a flow rate of the respective mixed airflow.

The first subset of zones can include a plurality of zones. One or more automated controllable dampers can be used to control a flow rate of return air originating from one or more zones of the first subset of zones. And one or more automated controllable dampers can be used to control a flow rate of the first mixed airflow distributed to one or more zones of the first subset of zones.

In another aspect, a heating, ventilation, and air conditioning (HVAC) zone control unit (ZCU) configured to provide HVAC to a building in conjunction with at least one additional of such a zone control unit is provided. In a building having zones that include a first and second subset of zones, the ZCU provides HVAC to the first subset of the zones, and the at least one additional ZCU provides HVAC to the second subset of the zones. The ZCU includes a housing configured to mount to the building local to the first subset of zones. A return air plenum is disposed within the housing. A first return air inlet is configured to input a first return airflow originating from at least one of the first subset of zones into the return air plenum. A supply air inlet is configured to receive a supply airflow into the plenum from a supply air duct transporting the supply airflow from outside the zones of the building. The supply airflow and the return airflow combine to form a mixed airflow. At least one heat exchanging coil is disposed within the housing. A discharge air plenum is disposed within the housing. A fan motivates the mixed airflow to pass through the heat exchanging coil and discharges into the discharge air plenum. A first discharge outlet is configured to discharge air from the discharge air plenum for distribution to at least one zone of the first subset of zones. The ZCU can include one or more return airflow inlets and/or one or more discharge outlets.

The ZCU can include one or more automated controllable dampers. For example, an automated controllable damper can be used to control a flow rate of the first return airflow input through the first return air inlet. And an automated controllable damper can be used to control a flow rate of the second return airflow input through the second return air inlet. An automated controllable damper can be used to control a flow rate of the supply airflow input through the supply air inlet. And one or more automated controllable dampers can be used to control the rate at which the mixed airflow is discharged to one or more zones serviced by the ZCU.

The ZCU can also employ an open air plenum design. In an open air plenum design, return air inlets draw return airflows directly from the air surrounding the ZCU so that no return airflow ducts are required. Instead, zone installed vents and natural passageways in building's ceiling can be used to provide a pathway by which the return airflows are routed from the serviced building zones back to the ZCU.

The at least one heat exchanging coil can include a heating coil and a cooling coil. A first variable rate pump can be used to route water having a temperature higher than the mixed airflow through the heating coil at a controlled rate. And a second variable rate pump can be used to route water having a temperature lower than the mixed airflow through the cooling coil at a controlled rate.

The ZCU can include handle brackets, which include handle features that provide for convenient handling/transport of the ZCU. The handle brackets can include support provisions for ZCU system components (e.g., heating coil piping, cooling coil piping, controllable valves, variable rate pumps, etc.).

The ZCU can be sealed and pressurized for testing and/or shipping. For example, the ZCU can be sealed, pressurized, and then shipped to the job site in the pressurized state. The pressure level can be monitored to detect any leaks, or to verify the absence of leaks as evidenced by a lack of drop in the pressure level over a suitable time period. Exemplary brackets and related methods that can be employed are disclosed in U.S. Pat. Nos. 6,951,324, 7,140,236, 7,165,797, 7,387,013, 7,444,731, 7,478,761, 7,537,183, and 7,596,962; and United States Patent Publication No. U.S. 2007/0108352 A1; the full disclosures of which are hereby incorporated herein by reference.

The ZCU can include a local control unit to control the ZCU. The local control unit has its own Internet Protocol (IP) address and be connectable to the Internet via a communication link. The communication link can include, for example, a hard-wired communication link and/or a wireless communication link. The local control unit can be configured to control lighting in the first subset of zones.

A sensor(s) can be coupled with the local control unit to measure a compound concentration level. The local control unit can use the measured concentration level to control a flow rate of the supply airflow input into the ZCU to control a resulting concentration level of the measured compound. The sensor(s) can include at least one of a carbon-dioxide ($CO_2$) sensor or a total organic volatile (TOV) sensor. The local control unit can transmit the measured compound concentration level to an external device.

Lighting for serviced building zones can also be controlled via the ZCU local control unit. For example, lights (e.g., light emitting diode (LED) lights) can be located on air diffusers and controlled by the ZCU local control unit (e.g., as a master/slave control combination). Lighting and sensors can be co-located. For example, a sensor pack and a LED light(s) can be co-located on a return air grill. Additional zone lights (e.g., LED lights) can be employed via master slave combination off of the ZCU local control unit.

In another aspect, an HVAC system for providing HVAC to zones of a building is provided. The system includes first and second HVAC ZCUs, such as the above-described ZCU. The system further includes a supply airflow duct transporting a flow of supply air. A first portion of the supply airflow is provided to the first ZCU and a second portion of the supply air is provided to the second ZCU. The system further includes an air-handling unit that intakes the supply airflow from external to the zones of the building and discharges the supply airflow into the supply airflow duct.

The HVAC system can include at least one supply line providing a heat transfer fluid to the at least one heat exchanging coil and at least one return line for returning the heat transfer fluid discharged from the at least one heat exchanging coil.

In another aspect, a prefabricated assembly is provided that is configured for use in an HVAC system providing HVAC to zones of a building. The HVAC system has a plurality of distributed ZCUs, with each of the ZCUs providing HVAC to a respective subset of the zones. The prefabricated has a length and includes a length of duct having first and second ends. The duct is configured to transport a flow of supply air from the first end to the second end. The duct is adaptable to include a discharge port to discharge a portion of the supply airflow to one of the distributed ZCUs. Brackets that include mounting features are coupled with the duct along the length of the duct. A supply line and a return line are supported by at least one of the mounting features. The supply line and the return line are provided to supply and return water from a heat exchanging coil of one or more of the distributed ZCUs. The prefabricated assembly is configured so that corresponding components of a plurality of the prefabricated assemblies can be coupled to provide for the transport of the flow of supply air along a combined length of the coupled assemblies and for the transport of the supply and return water along the combined length. The prefabricated assembly includes mounting surfaces to mount the assembly to the building.

The prefabricated assembly can include additional features. For example, the prefabricated assembly can be configured so that at least one electrical conduit can be supported by at least one of the mounting features. The prefabricated assembly can include at least one cable tray supported by at least one of the mounting features. The prefabricated assembly can include at least one wireless transmitter or a wireless repeater coupled with at least one of the brackets. The prefabricated assembly can include control wires connectable to the distributed ZCUs to transmit at least one of control signals or data at least to or from the distributed ZCUs.

In another aspect, a method for providing HVAC to first and second zones of a building is provided. The method includes providing first and second flows of supply air from outside the zones via an air duct. A first flow of return air is extracted from a first zone and a second flow of return air is extracted from a second zone. The first flow of return air is mixed with the first flow of supply air in a first zone control unit so as to form a first mixed flow. The second flow of return air is mixed with the second flow of supply air in a second zone control unit so as to form a second mixed flow. Heated water is directed to the first and second zone control units from a hot water source. Cooled water is directed to the first and second zone control units from a cold water source. In response to a low temperature in the first zone, heat transfer within the first zone control unit from the heated water to the first mixed airflow is increased. In response to a high temperature in the first zone, heat transfer within the first zone control unit from the cooled water to the first mixed airflow is increased. In response to a low temperature in the second zone, heat transfer within the second zone control unit from the heated water to the second mixed airflow is increased. In response to a high temperature in the second zone, heat transfer within the second zone control unit from the cooled water to the first mixed airflow is increased. The first mixed airflow is distributed to the first zone. And the second mixed airflow is distributed to the second zone.

Heat transfer can be increased within the zone control units using several approaches. For example, heat transfer can be increased by varying the return airflows by altering a fan speed within each zone control unit. And/or heat transfer can be increased by varying flow of the heated water or the cooled water within each zone control unit.

Humidity control can be employed. For example, a mixed airflow can be dehumidified in a zone control unit by cooling the mixed airflow to full saturation to form condensate (which is removed, for example, via a sump pump a condensate return line). The dehumidified mixed airflow can then be reheated (e.g., via a heater coil).

Common zone control units can be employed. For example, the first zone control unit can be interchangeable with the second zone control unit, even if the first zone has significantly different heating and cooling load characteristics than the second zone.

The method can include installing the HVAC system in the building using pre-assembled assemblies. For example, the HVAC system can be installed in the building by coupling the first zone control unit to the duct, the hot water source, and the cold water source using a first assembly and coupling the second zone control unit to the duct, the hot water source, and the cold water source using a second assembly. Each of the first and second assemblies includes a supply air duct, a hot water line, and a cold water line supported by a bracket.

In another aspect, a set of prefabricated assemblies are provided that are configured for use in an HVAC system providing HVAC to zones of a building. The HVAC system has a plurality of zone control units (ZCUs), each of the ZCUs locally providing HVAC to a respective subset of the zones. Each of the prefabricated assemblies has a length and includes a length of duct having first and second ends. The duct is configured to transport a flow of supply air from the first end to the second end. The duct is adaptable to include a discharge port to discharge a portion of the supply air to an associated one of the distributed ZCUs. Brackets are coupled with the length of the duct. The brackets include mounting features. The set of prefabricated assemblies includes a supply line to supply water to and a return line to return water from a heat exchanging coil of one or more of the distributed ZCUs. The supply and return lines are supported by at least one of the mounting features. Corresponding components of a plurality of the prefabricated assemblies can be coupled to provide for the transport of the flow of supply air along a combined length of the coupled assemblies and for the transport of the supply and return water along the combined length. The prefabricated assemblies include mounting surfaces to mount the assemblies to the building.

Embodiments of the present invention encompass methods of installing a heating, ventilation, and air conditioning (HVAC) unit in an HVAC system. Exemplary methods may include steps such as securing an inlet piping assembly of the HVAC unit to a bracket, securing an outlet piping assembly of the HVAC unit to the bracket, coupling a thermal transfer mechanism of the HVAC unit with the inlet piping assembly and the outlet piping assembly, fluidly coupling a water pump with at least one of the thermal transfer mechanism, the inlet piping assembly and the outlet piping assembly, placing at least a portion of the thermal transfer mechanism along an air flow path within a casing of the HVAC unit such that at least a portion of the inlet piping assembly and at least a portion of the outlet piping assembly are disposed exterior to the casing, positioning a fan along the airflow path within the casing, mounting the HVAC unit by mounting the bracket to the HVAC system, and maintaining alignment of the HVAC unit thermal transfer mechanism, the HVAC unit inlet piping assembly, and the HVAC unit outlet piping assembly while mounting the HVAC unit in the HVAC system. In some cases, the water pump includes a variable rate water pump. In some cases, the water pump includes a variable rate water pump having an electronically commutated motor. In some cases, the water pump includes a variable rate water pump operable between about 0 and about 15 gallons per minute. Optionally, the water pump can be controlled by pulse width modulation. Relatedly, the water pump can be controlled by a signal of between about 0 volts and about 10 volts. In some instances, the fan includes a variable rate fan. In some instances, the fan includes a variable rate fan having an electronically commutated motor.

In some aspects, embodiments of the present invention encompass methods of preparing a heating, ventilation, and air conditioning (HVAC) unit for delivery to a construction site for installation in an HVAC system. Exemplary methods may include steps such as coupling a thermal transfer mechanism with an inlet piping assembly and an outlet piping assembly, where the inlet piping assembly is configured to supply fluid to the thermal transfer mechanism and the outlet piping assembly is configured to receive fluid from the thermal transfer mechanism. Method steps may also include fluidly coupling a water pump with at least one of the thermal transfer mechanism, the inlet piping assembly, and the outlet piping assembly, placing at least a portion of the thermal transfer mechanism along an air flow path within a casing, such that at least a portion of the inlet piping assembly and at least a portion of the outlet piping assembly are disposed exterior to the casing, positioning a fan along the airflow path within the casing, and coupling a bracket with the casing, the inlet piping assembly, and the outlet piping assembly, so as to maintain the casing, the inlet piping assembly, and the outlet piping assembly in positional relationship. In some cases, the water pump includes a variable rate water pump. In some cases, the water pump includes a variable rate water pump having an electronically commutated motor. In some cases, the water pump includes a variable rate water pump operable between about 0 and about 15 gallons per minute. Optionally, the water pump can be controlled by pulse width modulation. In some instances, the water pump can be controlled by a signal of between about 0 volts and about 10 volts. In some embodiments, the fan may include a variable rate fan. In some cases, the fan may include a variable rate fan having an electronically commutated motor.

In yet another aspect, embodiments of the present invention include a heating, ventilation, and air conditioning (HVAC) unit for transporting fluid in an (HVAC) system. Exemplary HVAC units may include a thermal transfer mechanism, an inlet piping assembly coupled with the thermal transfer mechanism for supplying fluid to the thermal transfer mechanism, an outlet piping assembly coupled with the thermal transfer mechanism for receiving fluid from the thermal transfer mechanism, and a water pump in fluid communication with at least one of the thermal transfer mechanism, the inlet piping assembly, and the outlet piping assembly. HVAC units may also include a bracket that maintains the thermal transfer mechanism, the inlet piping assembly, and the outlet piping assembly in positional relationship, a casing defining an airflow path, and a fan disposed along the airflow path within the casing. In some cases, at least a portion of the thermal transfer mechanism can be disposed along the air flow path within the casing, at least a portion of the inlet piping assembly and at least a portion of the outlet piping assembly can be disposed exterior to the casing, and at least a portion of the bracket can be disposed exterior to the casing. In some instances, the water pump includes a variable rate water pump having an electronically commutated motor. In some instances, the water pump includes a variable rate water pump operable between about 0 and about 15 gallons per minute. Optionally, the fan may includes a variable rate fan having an electronically commutated motor.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. The present invention can, however, be practiced without the specific details. Furthermore, well-known features may be omitted or simplified in order not to obscure the embodiment being described.

HVAC System Configuration

Figure 1:
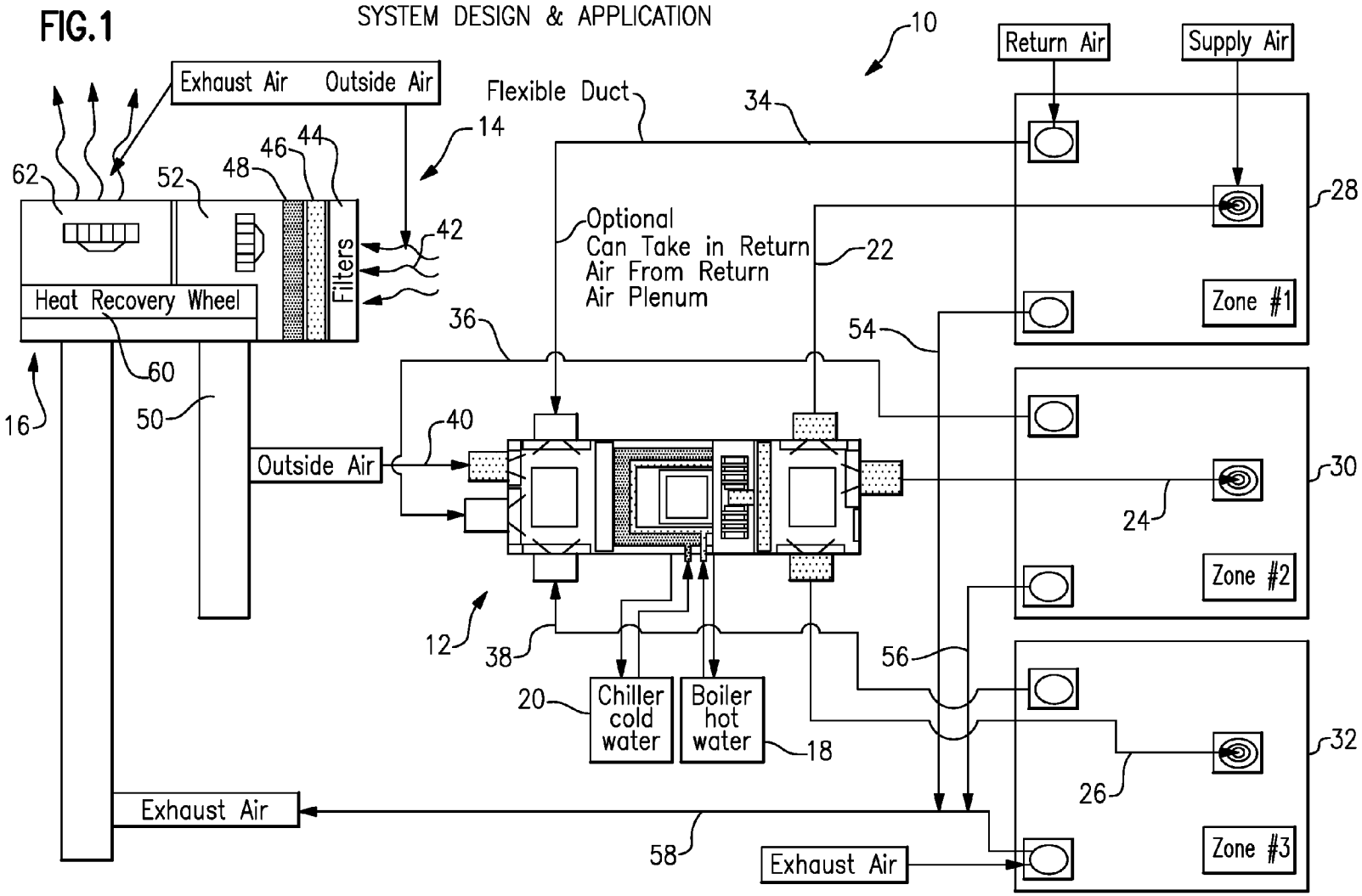
FIG. 1 diagrammatically illustrates an HVAC system having distributed zone control units that provide localized air recirculation, in accordance with many embodiments.

Referring now to the drawings, in which like reference numerals represent like parts throughout the several views, FIG. 1 diagrammatically illustrates an HVAC system 10 that includes a zone control unit 12, a supply air system 14, an exhaust air system 16, a boiler 18, and a chiller 20. While the illustrated HVAC system 10 includes one zone control unit 12 servicing three HVAC zones 28, 30, 32, additional zone control units can be used, and each zone control unit can serve one or more HVAC zones. Likewise, one or more supply air systems, exhaust air systems, boilers, and/or chillers can be used in any particular HVAC system.

The zone control unit 12 discharges mixed airflows 22, 24, 26 to building zones 28, 30, 32, respectively. The zone control unit 12 extracts return airflows 34, 36, 38 from building zones 28, 30, 32, respectively. A supply airflow 40 (e.g., an outside airflow) can be combined with the recirculation airflows 34, 36, 38 within the zone control unit in a controlled manner via automated dampers to form a mixed airflow. Heat can be added or extracted from the mixed airflow via one or more coils located within the zone control unit prior to discharging the mixed airflow for delivery to the building zones 28, 30, 32. For example, the mixed airflow can be drawn through a heating coil and a cooling coil located within the zone control unit. The boiler 18 can be used to add heat to a flow of water that is circulated through the heating coil. The chiller 20 can be used to extract heat from a flow of water that is circulated through the cooling coil. Other suitable approaches can also be used to add heat to or extract heat from the mixed airflow, for example, a heat pump system can be used to add or extract heat via a heat exchanger located within the zone control unit. A number of HVAC zone control unit configurations, in accordance with many embodiments, will be discussed in more detail below.

The supply air system 14 can be used to distribute intake outside air to provide the supply airflow 40 to each of the distributed zone control units in an HVAC system. The supply air system 14 intakes outside air 42, filter the outside air 42 via filters 44, add heat to the outside air via a heater coil 46, and/or remove heat from the outside air via an air conditioning coil 48. Other approaches can also be used to add heat to or extract heat from the air inducted by the supply air system 14, for example, a heat pump system can be used to add or extract heat via a heat exchanger located within the supply air system. The supply air system 14 includes a fan section 52, which can employ a variable speed motor, for example, an electronically commutated motor (ECM), for controlling the amount of outside air inducted by the supply air system 14 in response to system demands. The supply air system 14 is coupled with a duct system 50 to deliver the supply airflow 40 to the zone control unit 12, as well as to any additional zone control unit employed by the HVAC system 10.

The exhaust air system 16 can be used to extract exhaust airflows 54, 56, 58 from building zones 28, 30, 32, respectively. The exhaust air system 16 and the supply air system 14 can be coupled via a heat recovery wheel 60 to exchange heat and moisture between the outside air inducted by the supply air system 14 and the combined exhaust airflows discharged by the exhaust air system 16. The exhaust air system 16 includes a fan section 62, which can employ a variable speed motor, for example, an electronically commutated motor (ECM), for controlling the amount of exhaust air discharged by the exhaust air system 16 in response to system demands.

HVAC System Distribution Assemblies

In the above-described HVAC system 10, a supply airflow 40 is delivered to the zone control unit 12 and heated and cooled water are circulated to the zone control unit 12. In many embodiments, an integrated distribution system is used to deliver the supply airflow and circulate heated and cooled water to each of the distributed zone control units employed within a building HVAC system. Such an integrated distribution system can employ a number of joined distribution assemblies that each includes a supply air duct to distribute supply air to the zone control units, and supply and return water pipes to circulate the heated and cooled water to the zone control units.

Figure 2:
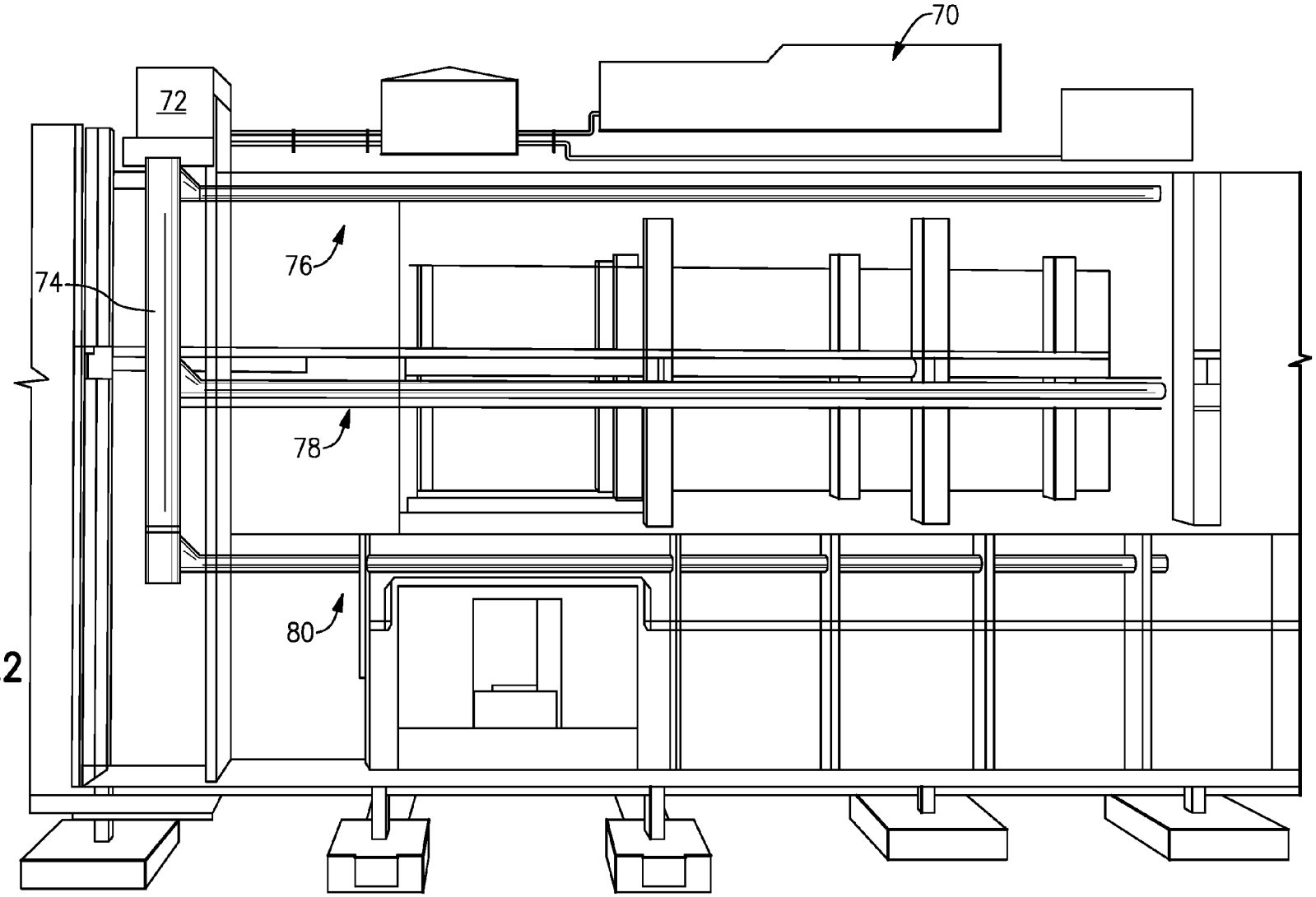
FIG. 2 is a perspective view illustrating installed distribution assemblies for an HVAC system having distributed zone control units, in accordance with many embodiments.
Figure 3:
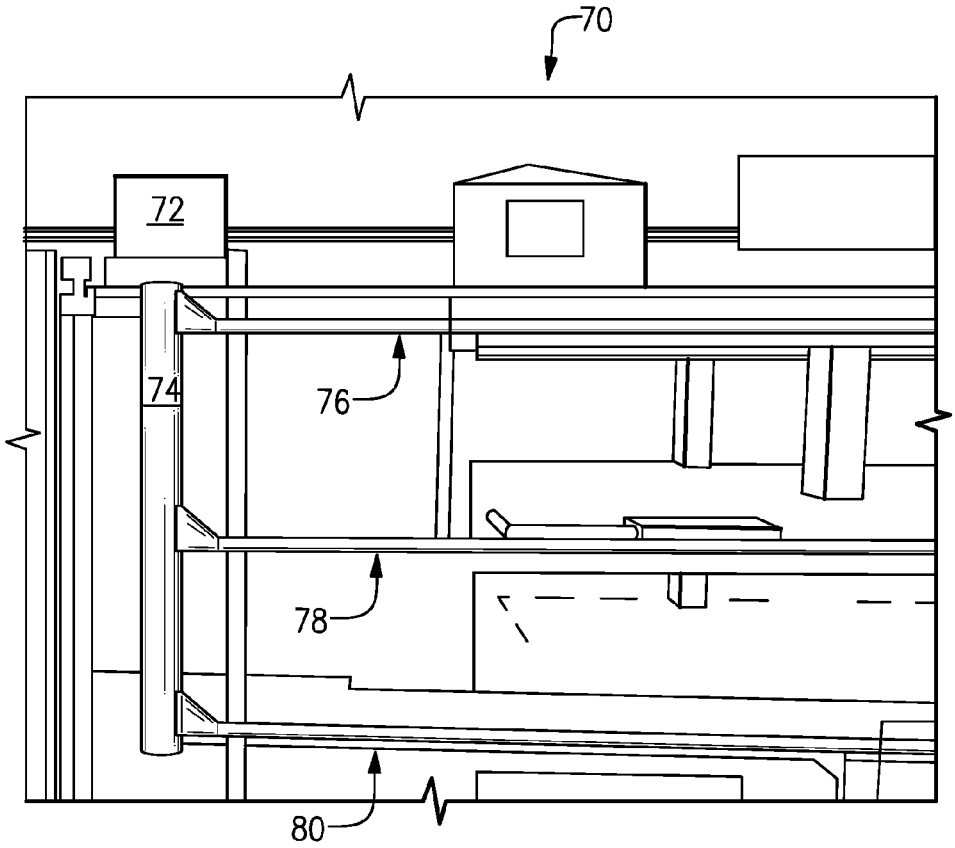
FIG. 3 is a perspective view illustrating the installed distribution assemblies of the HVAC system of FIG. 2 from a closer view point.

For example, FIG. 2 illustrates an installed distribution system 70 of an HVAC system having distributed zone control units, in accordance with many embodiments. The distribution system 70 includes a roof-mounted air handler 72 that discharges a supply airflow (e.g., outside air) into a vertically-oriented distribution assembly 74. The vertically-oriented distribution assembly 74 in turn distributes the supply airflow to horizontally-oriented distribution assemblies 76, 78, 80, which in turn distribute the supply airflow to zone control units distributed along the horizontally-oriented distribution assemblies 76, 78, 80. FIG. 3 illustrates the installed distribution system of FIG. 2 from a closer view point.

Figure 4:
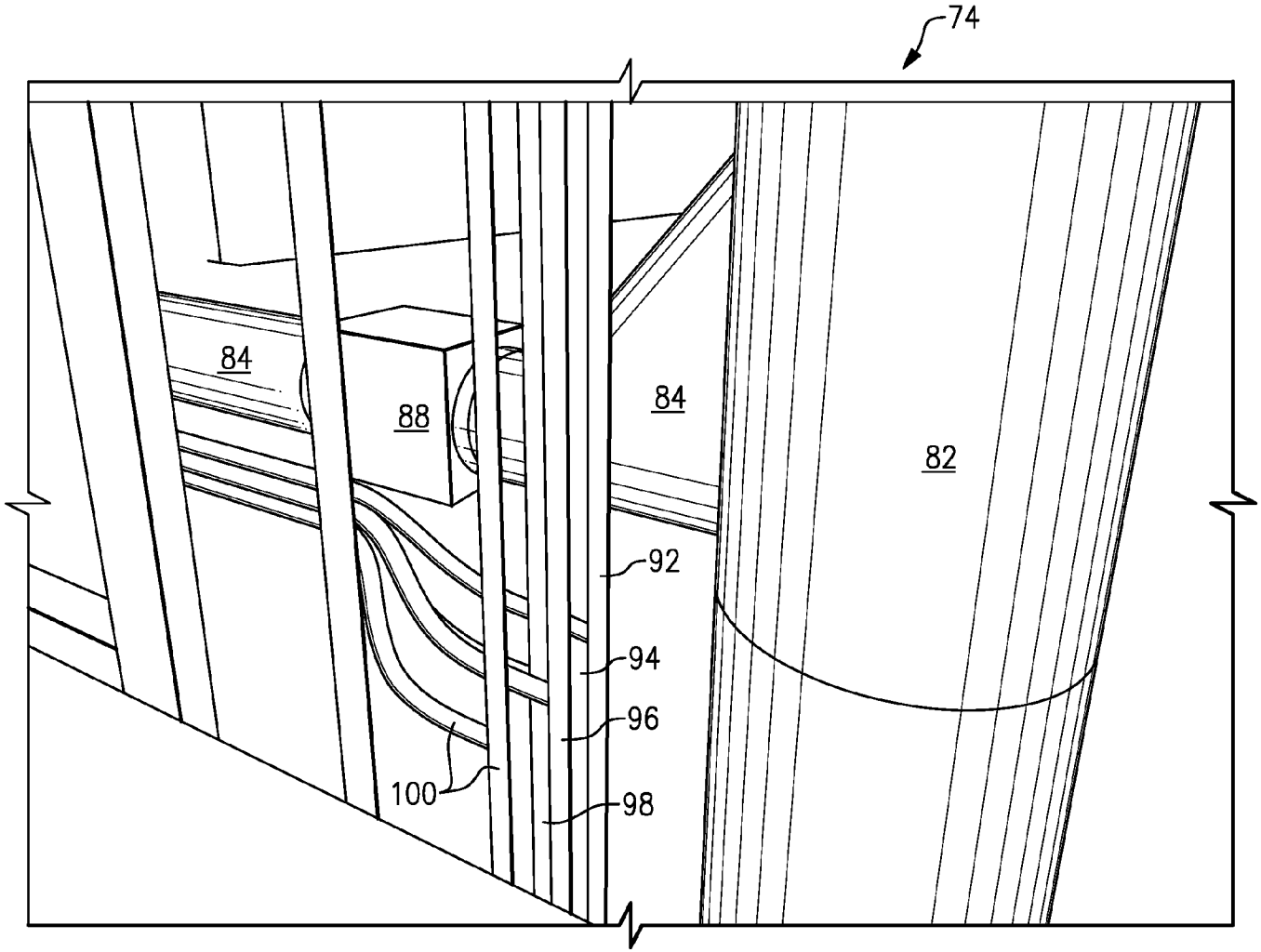
FIG. 4 is a perspective view illustrating a junction between a vertically-oriented distribution assembly and a horizontally-oriented distribution assembly of the HVAC system of FIG. 2.

FIG. 4 illustrates a junction between the vertically-oriented distribution assembly 74 and one of the horizontally-oriented distribution assemblies 76, 78, 80. The vertically-oriented distribution assembly 74 includes a trunk supply air duct 82 that can be suitably sized to transport the supply air distributed to the downstream zone control units. Likewise, the horizontally-oriented distribution assembly 76, 78, 80 includes a supply air duct 84 that can be suitably sized to transport the portion of the supply air distributed to respective downstream zone control units. Because the disclosed HVAC systems employ distributed zone control units that locally re-circulate air to respective zones, the required minimum size of the supply air ducts is significantly smaller than duct sizes required by conventional forced air HVAC systems, which do not employ local re-circulation of air. As a result, the sizes of the supply air ducts employed in the disclosed HVAC systems can be selected to reduce the number of different duct sizes employed without substantial detriment due to the significantly reduced minimum size of the ducts. For example, the vertically-oriented distribution assembly 74 illustrated employs a supply air duct 82 having a single constant cross-section, and each of the horizontally-oriented distribution assemblies 76, 78, 80 employ a supply air duct 84 having a common, albeit smaller, cross-section. At the junction, a transition duct 86 and a duct coupling section 88 are used to couple the supply airflow ducts of the vertically and horizontally-oriented distribution assemblies together.

The distribution assemblies includes four water supply and return lines 92, 94, 96, 98 used to circulate heated and cooled water to and from the distributed zone control units, and further includes a condensate return line 100 used to remove condensate water from the zone control units. At the junction, the supply and return lines of the horizontally-oriented distribution assembly are coupled into the corresponding lines of the vertically oriented distribution assembly.

Figure 5:
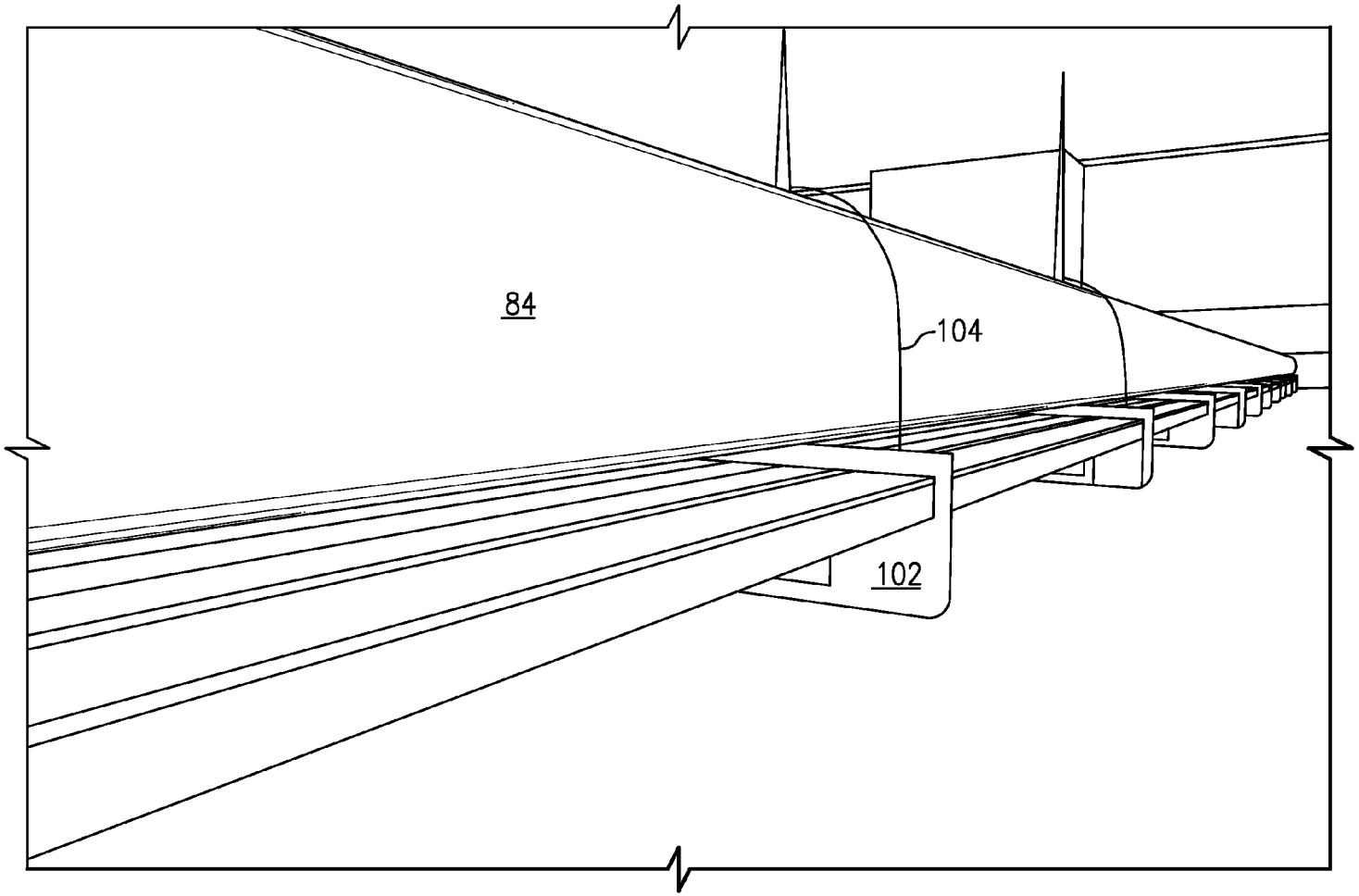
FIG. 5 is a perspective view illustrating a horizontally-oriented distribution assembly of the HVAC system of FIG. 2.

FIG. 5 illustrates one of the horizontally-oriented distribution assemblies 76, 78, 80 as installed. The horizontally-oriented distribution assembly includes a plurality of brackets 102 distributed along the length of the distribution assembly. Each of the brackets 102 is hung from via a hanger 104 and is disposed under and supports the supply air duct 84. Each of the brackets 102 includes mounting features used to support the four water supply and return lines and the condensate return line. The brackets 102 also include mounting features used to, for example, support additional components such as electrical conduits and cable trays used to route power and/or control cables to systems distributed in the building (e.g., to the zone control units, to lighting, telephone, computers, outlets, wireless repeaters, wireless transmitters, fire suppression sprinklers, smoke detectors, and the like). The brackets 102 can also be used to support sensors and/or electronic devices. For example, wireless repeaters and/or wireless transmitters can be distributed throughout the building via attachment to selected brackets 102 so as to provide wireless internet connectivity in the building.

Figure 6:
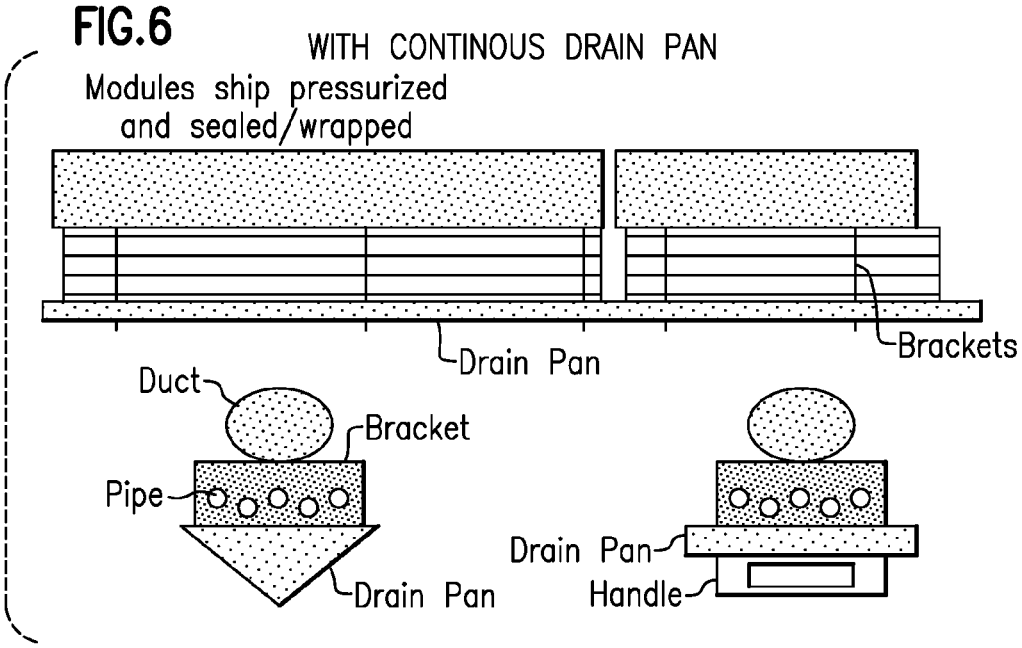
FIG. 6 illustrates details of prefabricated distribution assemblies used in an HVAC system having distributed zone control units, in accordance with many embodiments.
Figure 7:
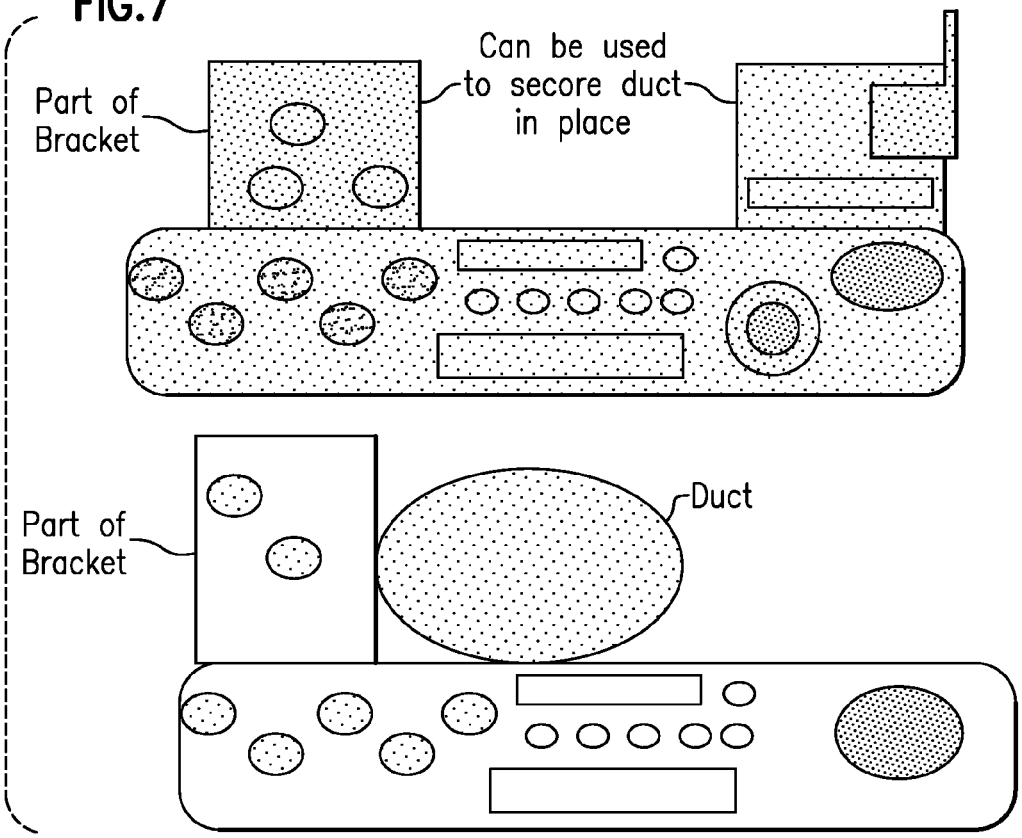
FIG. 7 illustrates details of brackets used in a prefabricated distribution assembly of an HVAC system having distributed zone control units, in accordance with many embodiments.

The distribution assemblies 74, 76, 78, 80 can be prefabricated prior to installation in a building. In many embodiments, the distribution assemblies 74, 76, 78, 80 include prefabricated subassemblies that are assembled on site prior to installation. For example, each of the horizontally-oriented distribution assemblies 76, 78, 80 can be fabricated from a number of prefabricated modules that are separately transported to a building site, mounted to the building (e.g., by lifting the prefabricated modules up to be hung via the above-described hangers from the ceiling of the building), and then joined to the adjacent prefabricated modules into a combined assembly. Alternatively, the prefabricated modules can be joined into a combined assembly before being lifted and hung from the ceiling (e.g., while disposed on the floor). FIG. 6 and FIG. 7 illustrate details of such prefabricated distribution assemblies that can be used in an HVAC system having distributed zone control units, in accordance with many embodiments. Additional details of such prefabricated distribution assemblies are disclosed in U.S. Provisional Patent Application No. 61/317,929, entitled "Modular Building Utilities Superhighway Systems and Methods," filed on Mar. 26, 2010; and U.S. Provisional Patent Application No. 61/321,260, entitled "Modular Building Utilities Superhighway Systems and Methods," filed on Apr. 6, 2010; the entire disclosures of which are incorporated by reference above.

HVAC Zone Control Unit Installation

Figure 8:
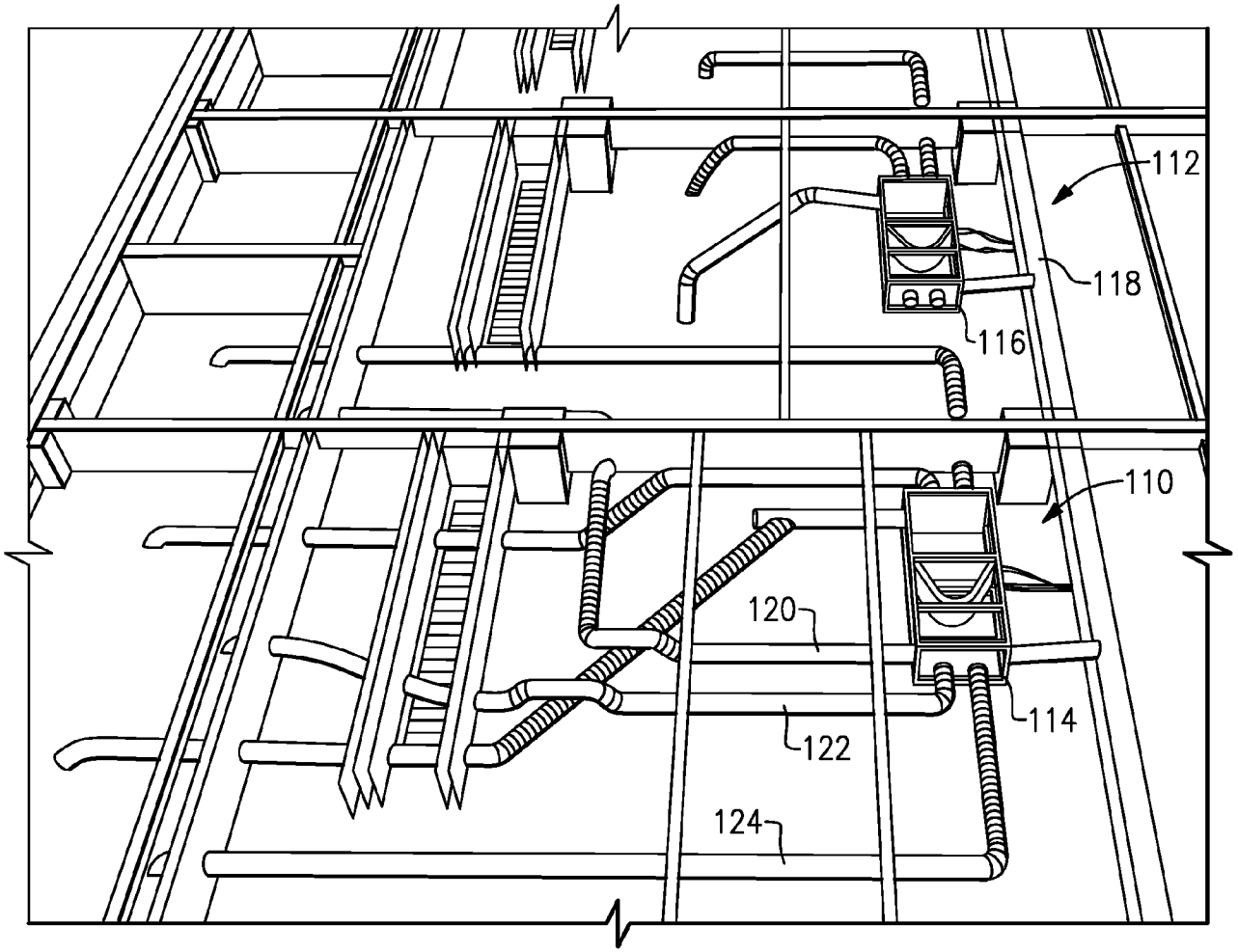
FIG. 8 is a perspective view illustrating the installation of two zone control units of an HVAC system having distributed zone control units, in accordance with many embodiments.

FIG. 8 illustrates two example installations 110, 112 of zone control units 114, 116, respectively, in accordance with many embodiments. In the example installations 110, 112, the zone control units 114, 116 are mounted adjacent to a horizontally-oriented distribution assembly 118 so as to provide for convenient coupling between the distribution assembly 118 and the zone control units 114, 116 with respect to provisions for the supply airflow, the circulation of heated and cooled water to and from the zone control units, and the removal of condensate from the zone control units. In the first example installation 110, return air ducts 120, 122, 124 are used to transport return airflow extracted from building zones serviced by the first zone control unit 114 to return air inlets of the first zone control unit 114. In the second example installation 112, no return air ducts are employed so that the return air inlets of the second zone control unit 116 intake return airflows directly from adjacent to the second zone control unit 116. The second example installation 112 can be used, for example, when a suitable route exists for return airflows to travel between the building zones serviced by a zone control unit and the zone control unit. For example, vents can be installed in the ceiling panels of the serviced building zones to allow for return airflows to exit the serviced zones into the ceiling cavity in which the zone control unit is located.

Figure 9:
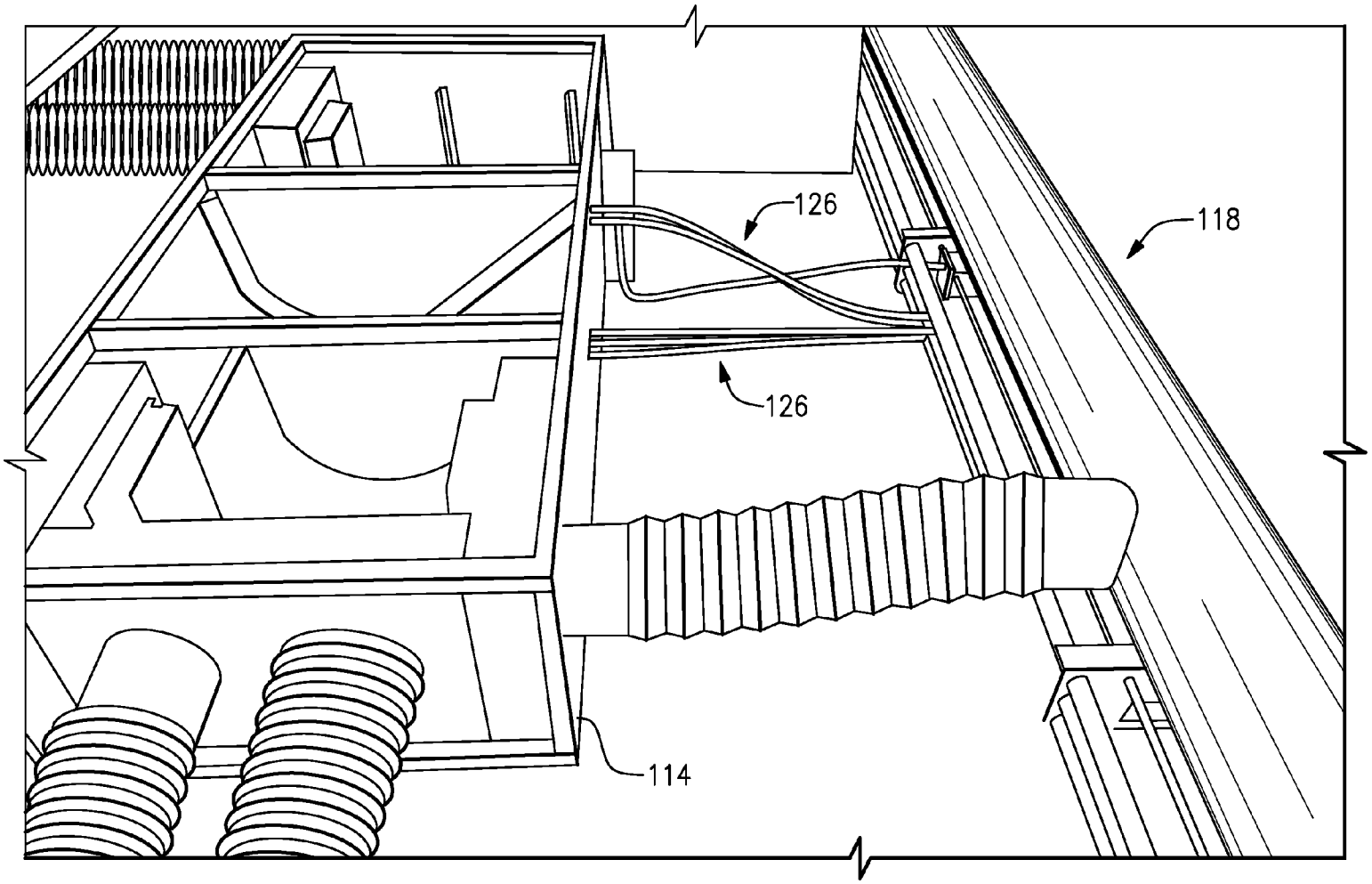
FIG. 9 is a perspective view illustrating supply and return lines used to couple a zone control unit with a distribution assembly of an HVAC system having distributed zone control units, in accordance with many embodiments.
Figure 10:
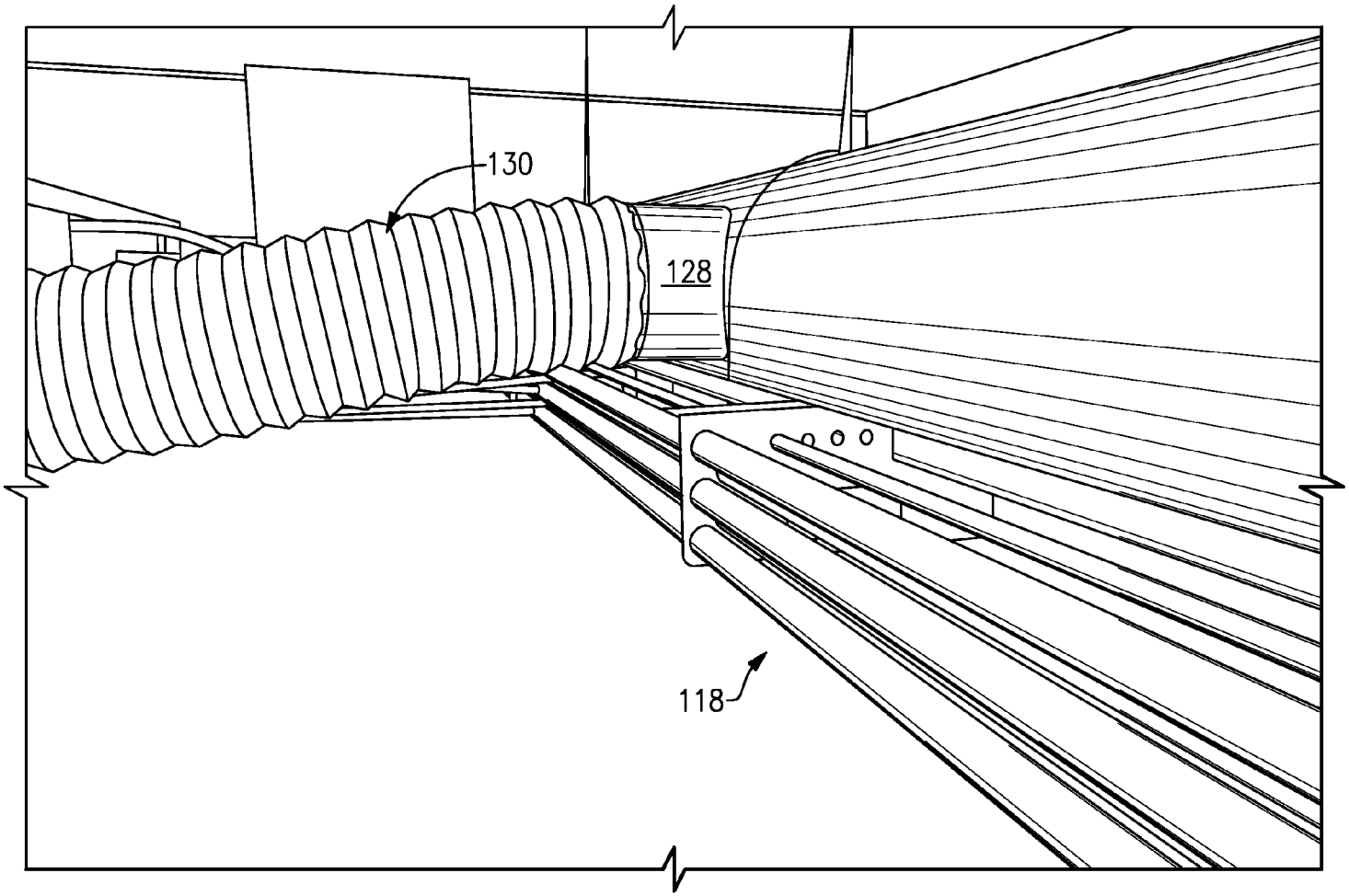
FIG. 10 is a perspective view illustrating details of a distribution assembly of an HVAC system having distributed zone control units and a supply air duct port and associated supply air duct used to transfer a flow of supply air from the distribution assembly to a zone control unit, in accordance with many embodiments.

FIG. 9 illustrates the coupling of the zone control unit 114 to the horizontally-oriented distribution assembly 118. Coupling water lines 126 are used to couple the heat exchanging coils of the zone control unit 114 with the supply and return water lines of the distribution assembly 118 and to couple the condensate return line of the distribution assembly 118 with a sump discharge line of the zone control unit 114. FIG. 10 illustrates details a supply airflow duct port 128 of the distribution assembly 118 and an associated supply airflow duct 130 used to transfer a flow of supply air from the distribution assembly 118 to the zone control unit 114.

In many embodiments, the distribution system illustrated in FIG. 1 through FIG. 10 is pre-engineered and prefabricated accordingly so that required on-site fabrication is reduced or eliminated. For example, a method of manufacturing and installing the distribution assemblies 74, 76, 78, 80 can proceed as follows:

1. Perform thermal load calculations for the building.
2. Prepare a design drawing(s) showing where the zone control units, air duct, electrical, piping etc. is going to be installed.
3. Fabricate air duct in sections such as 10, 20, 30, 40, etc. foot sections and label based on the design drawing(s).
4. Cut in openings/duct connections for the duct to attach to adjacent duct and to the zone control units.
5. Insulate the air duct.
6. Attach the brackets and fastening system to the air duct.
7. Pre-fabricate water pipe and insert through the bracket mounting features (e.g., staggered holes/grommets).
8. Couple features to the pipes used to couple the zone control units with the pipes and used to couple adjacent prefabricated distribution assembly modules (e.g., valve bodies, pressure gauges and stainless steel hose kits).
9. Seal the pipe ends and hoses, and pressurize to a suitable testing pressure (e.g., 100 psig).
10. Insulate the pipe and all other components requiring insulation.
11. Same procedure for fire sprinklers, process pipe, dx etc. . . .
12. Leave for a suitable time frame (e.g., overnight, other specified time period) to make sure there are no leaks by making sure the pressure is the same as the day before or time frame before.
13. Install the electrical conduit and cable trays (or this can be done in the field after the brackets have been hung).
14. Wrap the entire module in a large plastic bag and seal off both ends.
15. Tag the modules as per the details on the design drawing(s).
16. Cut small slits in the plastic bag over the handles of the brackets so only the handles are exposed.
17. Load the modules on to a transporting service. Use the handles so as not to damage the modules.
18. Deliver the modules to the project site in order by assembly nomenclatures for easy assembly, installation and hanging of the modules.
19. Unload the modules from the transporting service.
20. Unload using handles so as not to damage the modules.
21. Transport the modules to the location in the building shown on the design drawing(s).
22. Lift the horizontally-oriented distribution assembly modules towards the ceiling with a man lift or other lifting device via the handles.
23. Install the vertically-oriented distribution assembly modules in the shaft of the building.
24. Fasten the horizontally-oriented distribution assembly modules to the ceiling using the bracketing system—cable, off thread rod or other fastening device/system.
25. Make final adjustments after module is level.
26. Cut ends of plastic bag at duct work and piping ends and assemble into the next module/air duct.
27. Install zone control units and connect to duct and pipe.
28. Install flex duct from the distribution assembly modules to the zone control units for the transfer of supply airflows (outside air) to the zone control units.
29. Couple the stainless steel hose kits to the zone control unit hot water supply/return, chilled water supply/return and drain (option for drain plug in zone control units unit to hold pressure).
30. Re-pressurize the zone control modules to 100 psig and leave overnight, or re pressurize entire piping/module run.
31. The next day, check the gauges for the pressure reading to make sure there are no leaks. If the pressure is not the same as the night before then the leak may be in one of the stainless steel hose connections to the zone control units. Troubles shoot and repair.
32. Electrician and low voltage tradesman can now come in and run the electrical wires/conduit and the cable wiring. Or the conduit and trays may be already installed on the brackets.
36. The holes and rectangular box/cable tray are symmetrical and level through out the building. Thus, no hanging or support is required for the electrical, cables etc. Therefore, the installation time is very quick. All the pipe, duct, electrical, cables may be located on the brackets and follow the duct through out the building.
37. This may make it easier to locate all these things and provide more room to work on these components.
38. The components may take up less ceiling space and may be located symmetrically around the duct. It may be possible to have an extra floor(s) in the same building footprint by using this bracketing system.

HVAC Zone Control Unit Configurations

Figure 11:
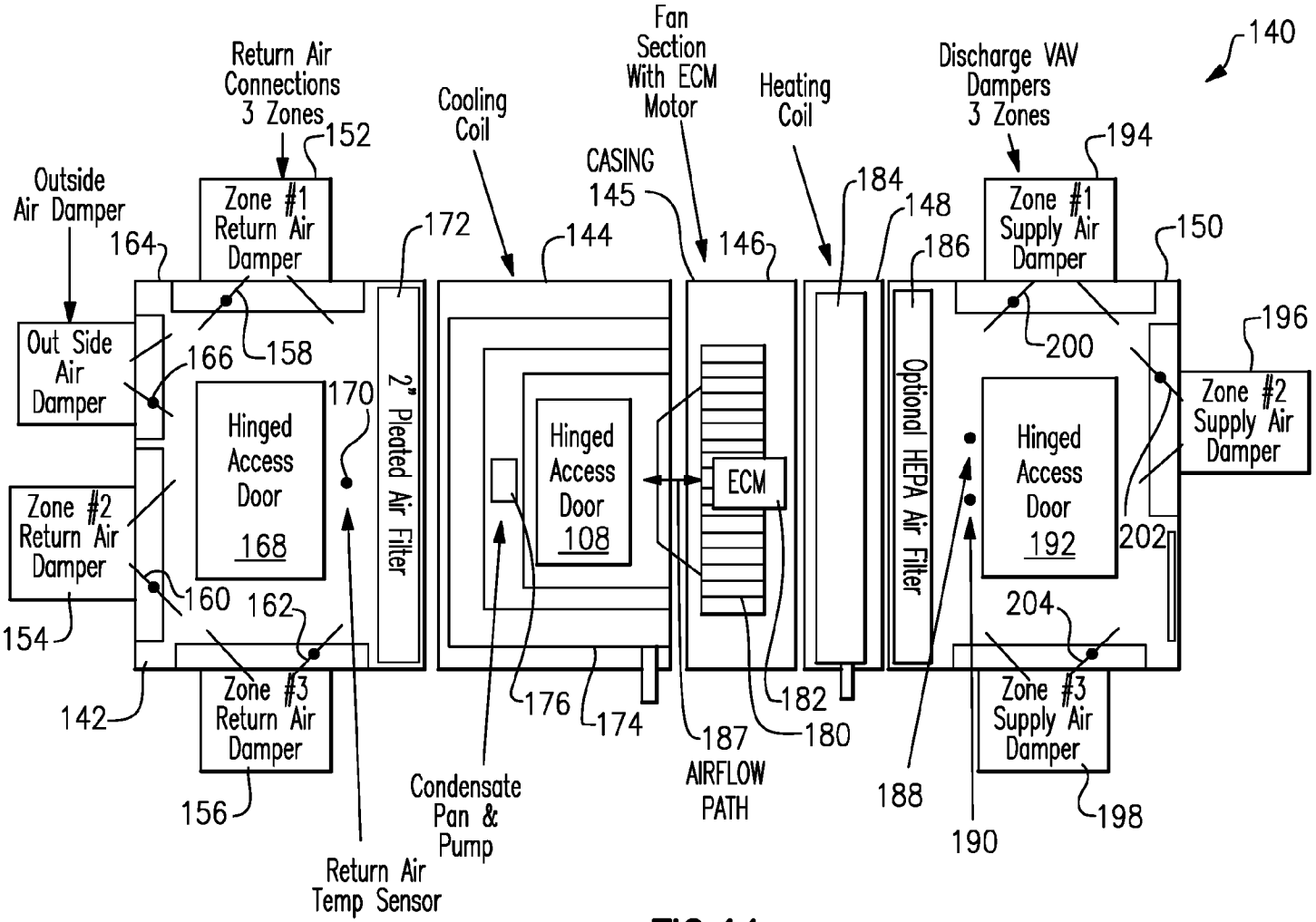
FIG. 11 is a top view diagrammatic illustration of an HVAC zone control unit that provides localized air recirculation via return air ducts and a circulation fan section disposed between a cooling coil section and a heating coil section, in accordance with many embodiments.

FIG. 11 is a top view diagrammatic illustration of an HVAC zone control unit 140, in accordance with many embodiments. The HVAC zone control unit 140 includes a return air section 142, a cooling coil section 144, a fan section 146, a heating coil section 148, and a supply air section 150.

In operation, return airflows from serviced building zones enters the return air section 142 via return air inlet collars 152, 154, 156. Automated return air dampers 158, 160, 162 are used to control the flow rate of the return airflows entering the return air section 142 through the return air inlet collars 152, 154, 156, respectively, which provides for better control of the associated building zone. For example, a return air damper 158, 160, 162 can be closed when the associated zone is not occupied. The return air dampers 158, 160, 162 can be configured with damper shafts located on the bottom of the HVAC zone control unit 140 for access from the bottom of the zone control unit. Supply airflow can enter the return air section 142 via a supply airflow inlet collar 164. A supply airflow damper 166 can be used to control the flow rate of the supply airflow flowing into the return air section 142. For example, the supply airflow damper 166 can be used in conjunction with an airflow probe to control and measure the flow rate of the supply airflow (e.g., outside air) that is input into the return air section, which can be used to provide better indoor air quality as well as control costs associated with the introduction of outside air (e.g., heating cost, cooling cost, humidity adjustment cost, etc.). The return air section 142 can include an access provision 168 (e.g., an access panel, a hinged access door) for access to the interior of the return air section (e.g., for maintenance, repair, etc.). The return air section 142 can include a return air temperature sensor 170 for monitoring the temperature of the mixed airflow. The temperature of the mixed airflow can be used to adjust system operational parameters. The return air section 142 can include an air filter 172 (e.g., a 2 inch pleated air filter) for filtering the mixed airflow prior to discharge from the return air section into the cooling coil section 144. The return air section can share a common footprint with the supply air section 150. A common damper can be used at two or more locations (e.g., a common 12 inch by 12 inch damper can be used for the return air dampers 158, 160, 162). The return air inlet collars 152, 154, 156 can be sized for an associated zone airflow requirement (e.g., CFM requirement). The return air section 72 can be configured such that the return air inlet collars 152, 154, 156 and the supply airflow inlet collar 164 are easily installable after the HVAC zone control unit has been installed to minimize shipping and installation damage. The return air section 142 can be insulated (e.g., with 1 inch engineered polymer foam insulation (EPFI)—closed cell insulation).

In many embodiments, a carbon dioxide ($CO_2$) sensor and/or a total organic volatile (TOV) sensor(s) are installed in the return air section 142 to sample the return airflows. The sensor(s) can be connected into a controller for the zone control unit for use in controlling the flow rate of supply air added to the return airflows and for controlling the rate of mixed airflow discharged to the zones serviced by the zone control unit. The sensor(s) can be installed in between the return air dampers to sample the return air as there is an invisible air curtain where the supply airflow (outside air) is coming in and mixing with the return airflows. Or a separate sensor(s) can be installed on each return air damper. By sensing the concentration of the measured compound (e.g., parts per million (ppm) of $CO_2$ and/or TOV(s)), the zone control unit can vary the rate of the supply airflow introduced to control the concentration of the measured compound. For example, when the concentration of $CO_2$ exceeds a specified level, the zone control unit can increase the flow rate of the supply airflow added to the return airflows (e.g., by opening the supply airflow damper and/or closing the return airflow dampers), and can also increase the flow rate of the mixed airflow discharged to the zones serviced by the zone control unit. The measured concentration levels can also be transmitted from one or more of the zone control units for external use. For example, for critical environments the concentration levels can be centrally monitored for use in making adjustments (e.g., by a central monitoring system, by a building operator, by a plant manager, etc.). With such an integrated sensor(s), the zone control units can employ the measured concentration levels to accomplish fine-tuned adjustments to operating parameters, thereby saving energy and providing excellent environmental control, which may be especially beneficial when critical environmental control is required.

The cooling coil section 144 receives air discharged by the return air section 142. The cooling coil section 144 includes a cooling coil 174. The cooling coil 174 can use a cooled medium (e.g., cooled water, refrigerant) to absorb heat from the mixed airflow. In many embodiments, the cooling coil 174 employs micro-channel technology. The cooling coil 174 can be arranged in a variety of ways (e.g., a planar arrangement, a u-shaped arrangement, 180 to 360 degree arrangements, etc.). Arranging the cooling coil 174 for increased surface area provides for the ability to realize a more compact zone control unit. The cooling coil 174 can employ, for example, ⅜ inch copper tubes for better heat transfer. The cooling coil 174 can employ high performance fins for better heat transfer. The cooling coil can employ fins that provide for a reduced pressure drop across the cooling coil as compared to industry standard coils, for example, seven to eight fins per inch can be used as compared to the industry standard of 10 fins per inch. In many embodiments, the cooling coil 174 is coupled with the chiller 20 (shown in FIG. 1) so that a cooling fluid (e.g., chilled water) is circulated between the chiller and the cooling coil 174 and heat is transferred from the mixed airflow to the chiller via the cooling fluid. The cooling coil section 144 can include a condensate pan and pump 176 (e.g., using plastic and/or aluminum construction to reduce or eliminate corrosion) for managing any condensate produced. The condensate pump can be factory installed. The condensate pump can be mounted and wired, and can be piped from a strainer and allow back flushing to reduce fouling and increase energy efficiency. The condensate pump can be wired to a control system and an alarm can be signaled if the condensate pump fails. An access provision 178 (e.g., an access panel, a hinged access door) can be provided for access to the interior of the cooling coil section for a range of purposes (e.g., inspection, access to the condensate pan and condensate pump, maintenance, access to coiling coil, cleaning of the cooling coil, repair, etc.). The cooling coil section 144 can be configured to produce a desired temperature drop in the airflow (e.g., a 30 degree Fahrenheit drop—entering airflow temperature at 80 degrees and a leaving airflow temperature at 50 degrees). The cooling coil section 144 provides for cooling local to the building zone as opposed to a large and expensive air handling unit. The cooling coil section 144 can be insulated (e.g., with 1 inch engineered polymer foam insulation (EPFI)—closed cell insulation).

The fan section 146 receives the mixed airflow from the cooling coil section 144. The fan section 146 includes a fan 180 driven by a motor 182. The motor 182 can be a known electric motor, for example, a variable speed motor (e.g., an ECM motor) for controlling the rate of the mix airflow through the HVAC zone control unit 140. The motor 182 can be a DC motor that can be run directly off of solar panels. Because the HVAC zone control unit provides for control over the air temperature of the mixed airflow discharged to the HVAC zones, an increased flow rate of the mixed airflow can be used, which increases the flow rate of the mixed airflow discharged into the building zones for better throw and mixing. The use of increased flow rate may help to reduce or eliminate stratification in the building zones serviced. The fan 180 can be a high efficiency plastic plenum or axial fan. The motor 182 can be an ECM motor for reduced energy usage and can be a variable speed ECM motor for adjusting the flow rate of the mixed airflow discharged to the building zone(s). Locating the fan section 146 between the cooling coil section 144 and the heating coil section 148 may provide for better acoustics. The use of a plenum fan may allow for better airflow velocity across the cooling coil and the heating coil. In the embodiment of FIG. 11, the fan section 146 draws the mixed airflow through the cooling coil and blows the mixed airflow through the heating coil. The use of a plenum fan may allow for a smaller footprint for the fan section 146. The fan section 146 can be insulated (e.g., with 1 inch engineered polymer foam insulation (EPFI)—closed cell insulation). Another fan section can be employed in series with the fan section 146, for example, downstream of the filters. Such an additional fan section can be used to account for an additional amount of pressure drop associated with HEPA and/or ultra low particle air (ULPA) filters, which may be used in certain applications such as laboratory applications. In some embodiments, an HVAC unit can be manufactured with an integrated fan 180.

Exemplary fan mechanisms may include a motor 182 such as an electronically commutated motor (ECM) motor. Motor 182 can operate to control or modulate air flow across a thermal transfer device or coil of an HVAC unit. Hence, fan 180 can provide a selected air flow rate through an HVAC unit, so as to achieve a desirable energy savings or comfort protocol. As shown in FIG. 11, at least a portion of a thermal transfer mechanism such as coil 174 can be placed along an air flow path 187 within a casing 145 (e.g. at coil section 144) such that at least a portion of an inlet piping assembly and at least a portion of an outlet piping assembly coupled with the coil are disposed exterior to the casing. Relatedly, fan 180 can be positioned along the airflow path 187 within casing 145 (e.g. at fan section 146).

The fan section 146 discharges the mixed airflow into the heating coil section 148, which contains a heating coil 184. The heating coil 184 can be coupled with the boiler 18 (shown in FIG. 1) so that a heating fluid (e.g., heated water) is circulated between the boiler and the heating coil and heat is transferred into the mixed airflow from the boiler via the heating fluid. In many embodiments, the heating coil 184 employs micro-channel technology. The heating coil 184 can be arranged in a variety of ways (e.g., a planar arrangement, a u-shaped arrangement, 180 to 360 degree arrangements, etc.). Arranging the heating coil 184 for increased surface area provides for the ability to realize a more compact unit. The heating coil 184 can employ, for example, ⅜ inch copper tubes for better heat transfer. The heating coil can employ high performance fins for better heat transfer. The heating coil can employ fins that provide for a reduced pressure drop across the heating coil as compared to industry standard coils, for example, seven to eight fins per inch can be used as compared to the industry standard of 10 fins per inch. The heating coil section 148 can be configured to produce a desired temperature rise in the airflow (e.g., a 30 degree Fahrenheit rise—entering airflow temperature at 70 degrees and a leaving airflow temperature at 100 degrees). The heating coil section 148 can be insulated (e.g., with 1 inch engineered polymer foam insulation (EPFI)—closed cell insulation).

The mixed airflow is discharged from the heating coil section 148 into the supply air section 150. The supply air section 150 can include a high efficiency particulate air (HEPA) filter 186. The supply air section 150 can include a humidity sensor 188 and can include a supply air temperature sensor 190. An access provision 192 (e.g., an access panel, a hinged access door) can be provided for access to the interior of the supply air section (e.g., for maintenance, repair, etc.). Supply airflows are discharged from the supply air section 150 to one or more serviced building zones via one or more supply air outlet collars 194, 196, 198. The supply air section 150 can include one or more actuated supply air dampers 200, 202, 204 for controlling the airflow rate through the supply air outlet collars 194, 196, 198, respectively, which provides for better control of airflow to the associated zone. For example, a supply air damper 200, 202, 204 can be closed when the associated zone is not occupied. The supply air dampers 200, 202, 204 can be configured with damper shafts located on the bottom of the HVAC zone control unit 140 for access from the bottom of the zone control unit. The supply air section can share a common footprint with the return air section 142. A common damper can be used at two or more locations (e.g., a common 12 inch by 12 inch damper can be used for the supply air dampers 200, 202, 204). The supply air outlet collars 194, 196, 198 can be sized for associated zone airflow requirements. The supply air section can be configured such that the supply air outlet collars 194, 196, 198 are easily installable after the HVAC zone control unit has been installed to minimize shipping and installation damage. The supply air section can be insulated (e.g., with 1 inch engineered polymer foam insulation (EPFI)—closed cell insulation).

Figure 12:
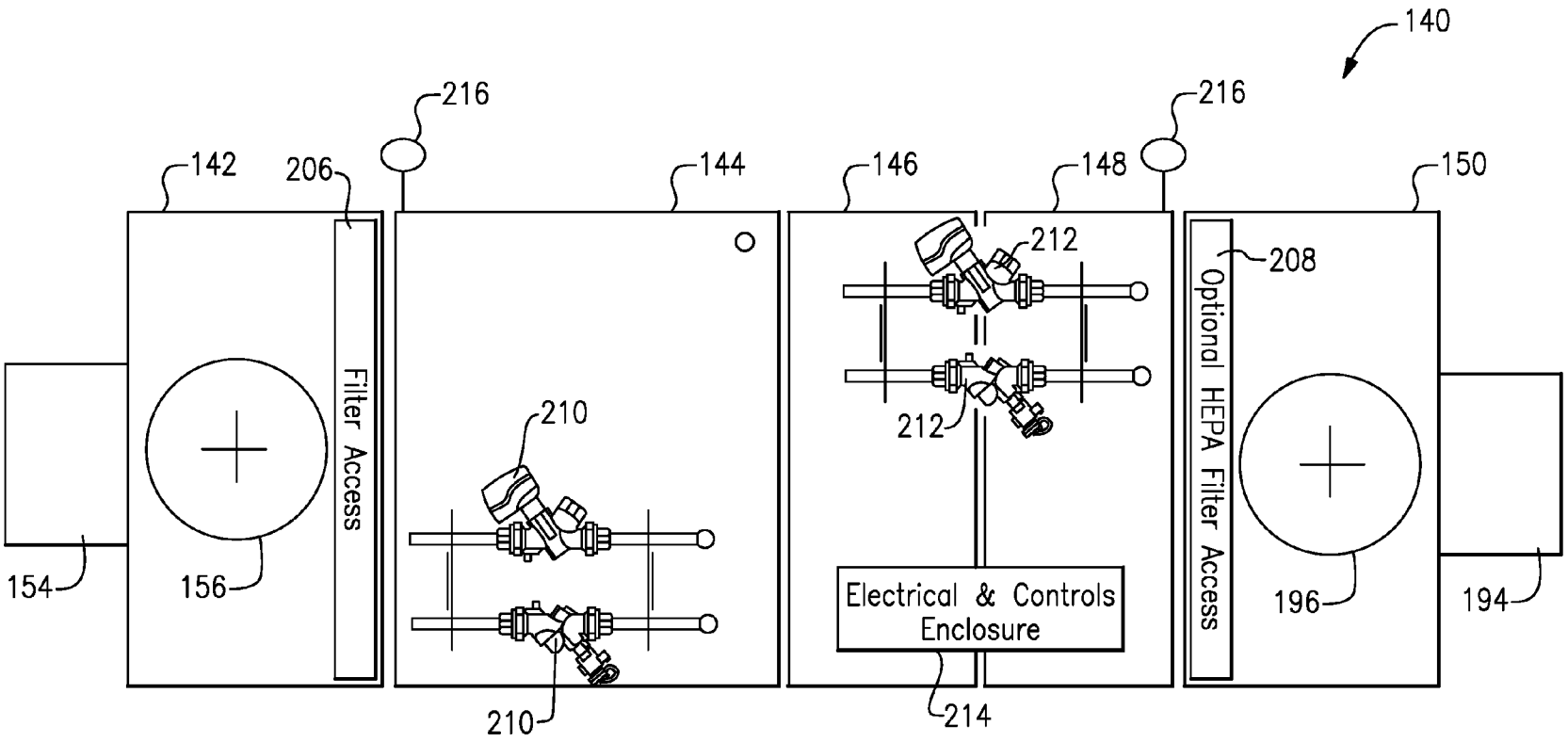
FIG. 12 is a side view diagrammatic illustration of the HVAC zone control unit of FIG. 11.

FIG. 12 is a side view diagrammatic illustration of the HVAC zone control unit 140 of FIG. 11. As further illustrated by FIG. 12, the return air section 142 can include a filter access provision 206 for access to the air filter 172 (shown in FIG. 11). Likewise, the supply air section 150 can include an access provision 208 for access to the HEPA filter 186. Cooling fluid control valves 210 can be used to control the circulation of cooling fluid between the cooling coil 174 (shown in FIG. 11) and the chiller 20 (shown in FIG. 1). The control valves 210 can be modulating control valves to provide for variable control of the temperature drop produced in the cooling coil section 144 so as to provide variable control of the temperature of the air supplied to the building zones services by the HVAC zone control unit 140. Likewise, heating fluid control valves 212 can be used to control the circulation of heating fluid between the heating coil 184 (shown in FIG. 11) and the boiler 18 (shown in FIG. 1). The control valves 212 can be modulating control valves to provide for variable control of the temperature increase produced in the heating coil section 148 so as to provide variable control of the temperature of the air supplied to the building zones services by the HVAC zone control unit 140. Alternatively, variable rate water pumps, for example, variable rate water pumps employing an ECM motor, can be employed to regulate the rate at which cooled water is circulated through the cooling coil section 144 and to regulate the rate at which heated water is circulated through the heating coil section 148. The HVAC zone control unit 140 can include an electrical and controls enclosure 214 for housing HVAC zone control unit related electrical and controls components. The HVAC zone control unit 140 can include one or more mounting provisions 216.

Figure 13:
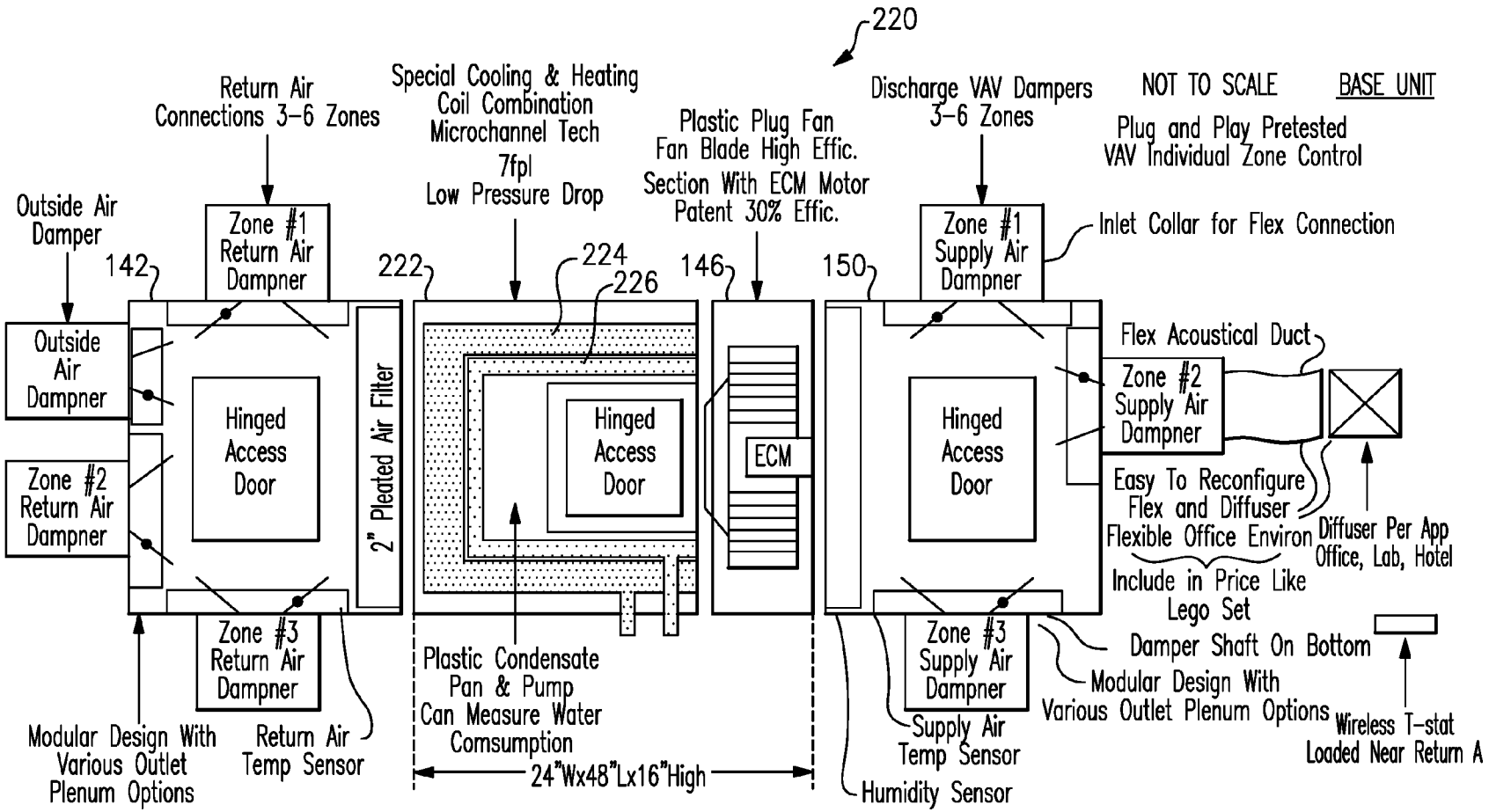
FIG. 13 is a top view diagrammatic illustration of an HVAC zone control unit that provides localized air recirculation via return air ducts and a combined heating/cooling coil section, in accordance to many embodiments.
Figure 14:
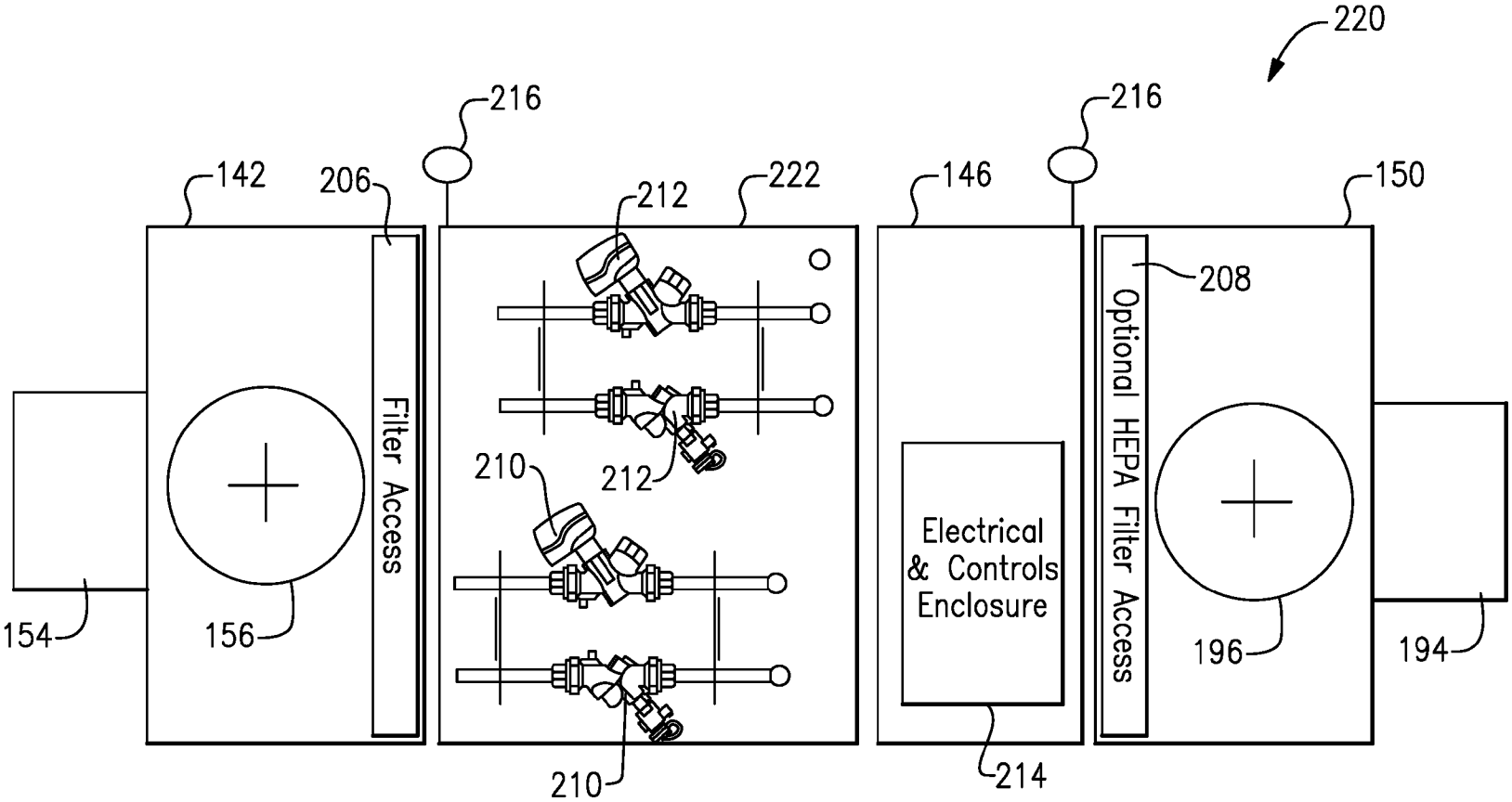
FIG. 14 is a side view diagrammatic illustration of the HVAC zone control unit of FIG. 13.

FIG. 13 is a top view diagrammatic illustration of an HVAC zone control unit 220, in accordance with many embodiments, that includes a combined heating/cooling section 222 in place of the separate cooling section 144 and heating section 148 discussed above with reference to FIGS. 11 and 12. The HVAC zone control unit 220 includes the above discussed return air section 142, fan section 146, and supply air section 150, which can contain the above discussed related components. The combined heating/cooling section 222 can include a cooling coil 224 and a heating coil 226, which as discussed above with reference to HVAC zone control unit 40, can employ micro-channel technology. The use of micro-channel technology may result in a decreased pressure drop across the cooling and heating coils. A wireless thermostat 228 can be used to provide for control of the HVAC zone control unit. FIG. 14 is a side view of the HVAC zone control unit 220, showing the location of components that were discussed above with reference to FIGS. 11, 12, and 13.

Figure 15:
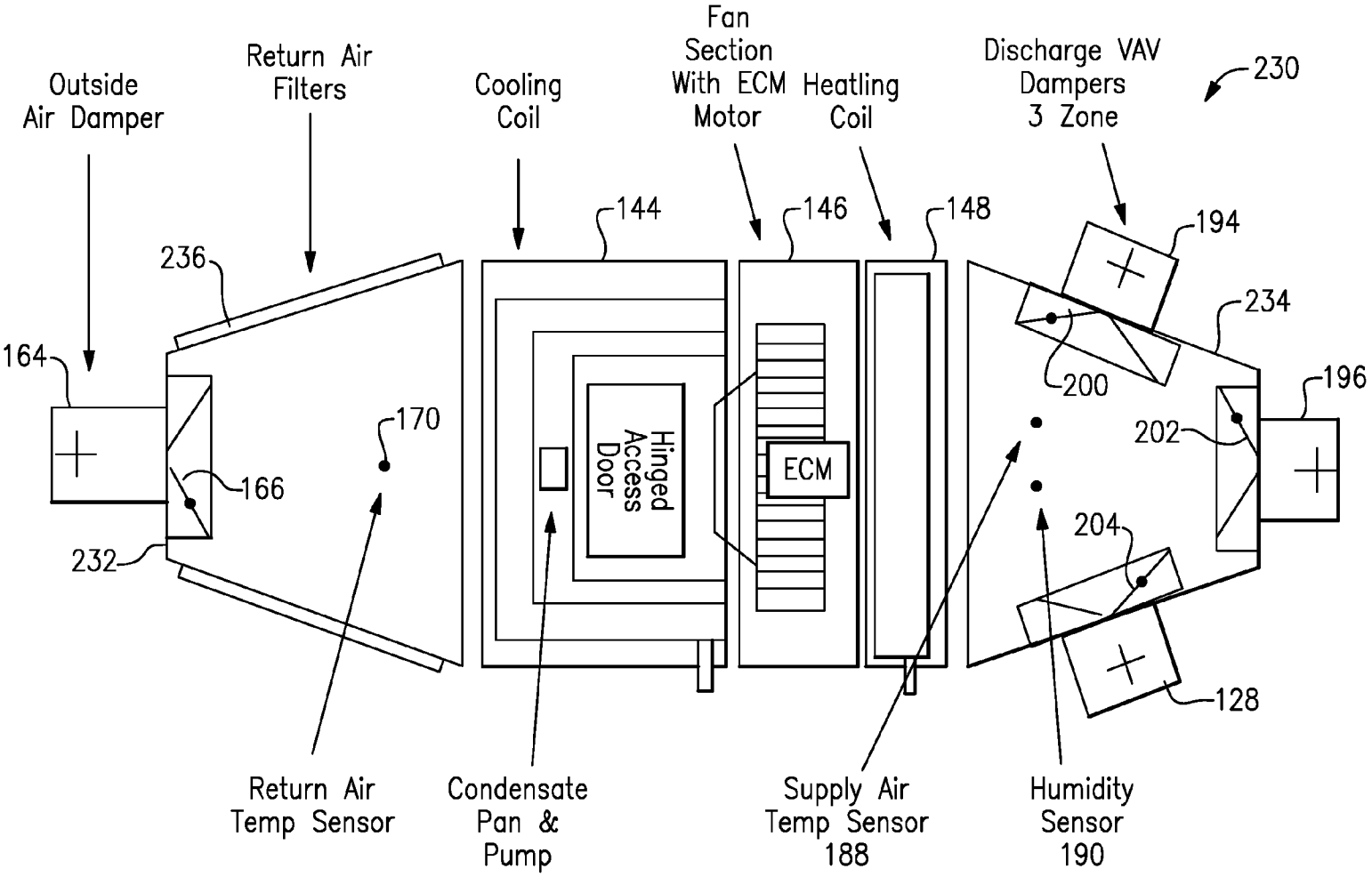
FIG. 15 is a top view diagrammatic illustration of an HVAC zone control unit with direct intake of local recirculation air and a circulation fan disposed between a cooling coil section and a heating coil section, in accordance with many embodiments.

FIG. 15 is a top view diagrammatic illustration of an HVAC zone control unit 230, in accordance with many embodiments, that includes a return air section 232 with a direct return airflow intake and a supply air section 234. The HVAC zone control unit 230 includes the above discussed cooling coil section 144, fan section 146, and heating coil section 148, which can contain the above discussed related components. The return air section 232 can share a common footprint with the supply air section 234. The return air section 232 includes return air filters 236 disposed on the exterior surface of the return air section. For example, the return air filters 236 can partially or completely surround the return air section. The return air section 232 can be conically shaped, which may serve to produce desired airflow patterns due to the increasing cross-sectional area of the return air section in the direction of airflow, which corresponds to the increased amount of airflow at the exit of the return air section as compared to the beginning of the return air section. The return air section 232 can include above discussed components (e.g., the labeled components). The supply air section 234 can be conically shaped, which may serve to produce desired airflow patterns due to the decreasing cross-sectional area of the supply air section in the direction of airflow, which corresponds to a decreased amount of airflow just prior to the supply air outlet collar 196 as compared to the beginning of the supply air section. The supply air section 234 can include above discussed components (e.g., the labeled components). The return air section 232 and the supply air section 234 can share a common footprint, which may provide for the use of common components.

Figure 16:
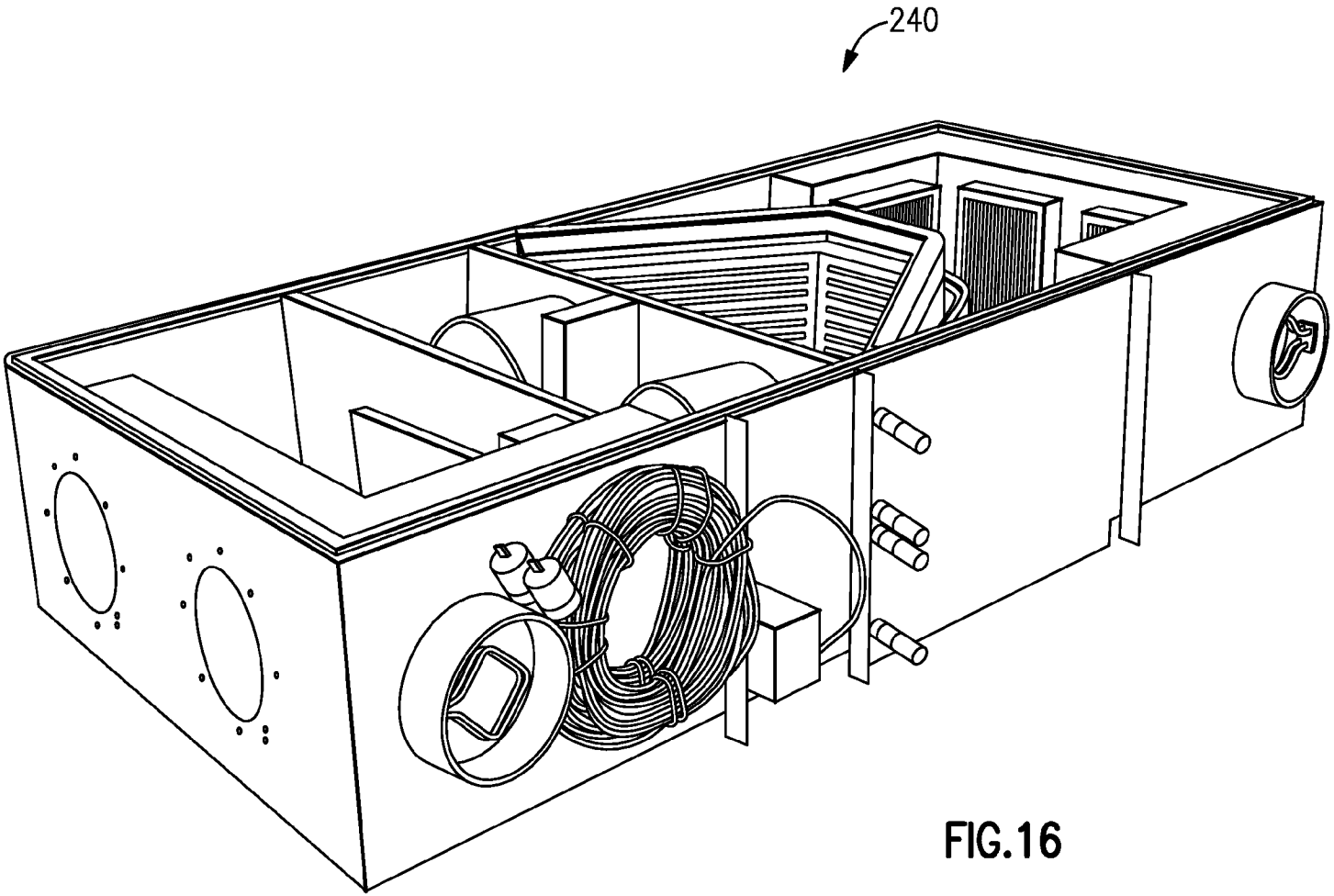
FIG. 16 is a photograph of a prototype zone control unit, in accordance with many embodiments.
Figure 17:
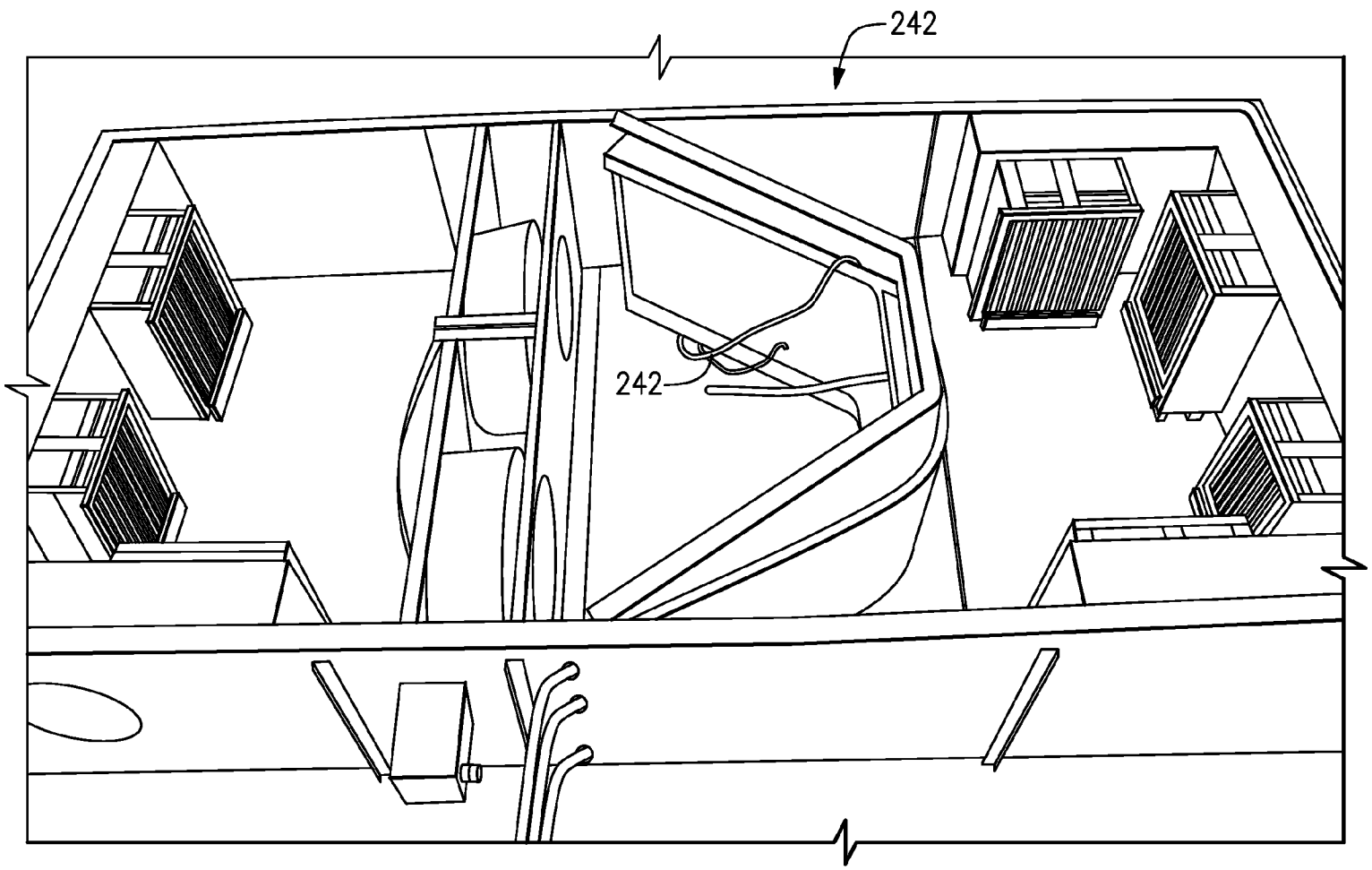
FIG. 17 is a photograph of the prototype zone control unit of FIG. 16, illustrating internal components and showing flow strips employed during testing.

FIG. 16 is a photograph of a prototype zone control unit 240 having a transparent top panel installed to allow viewing of airflow during testing. FIG. 17 is another photograph of the prototype zone control unit 240, showing internal components and flow strips 242 employed during testing.

Figure 18:
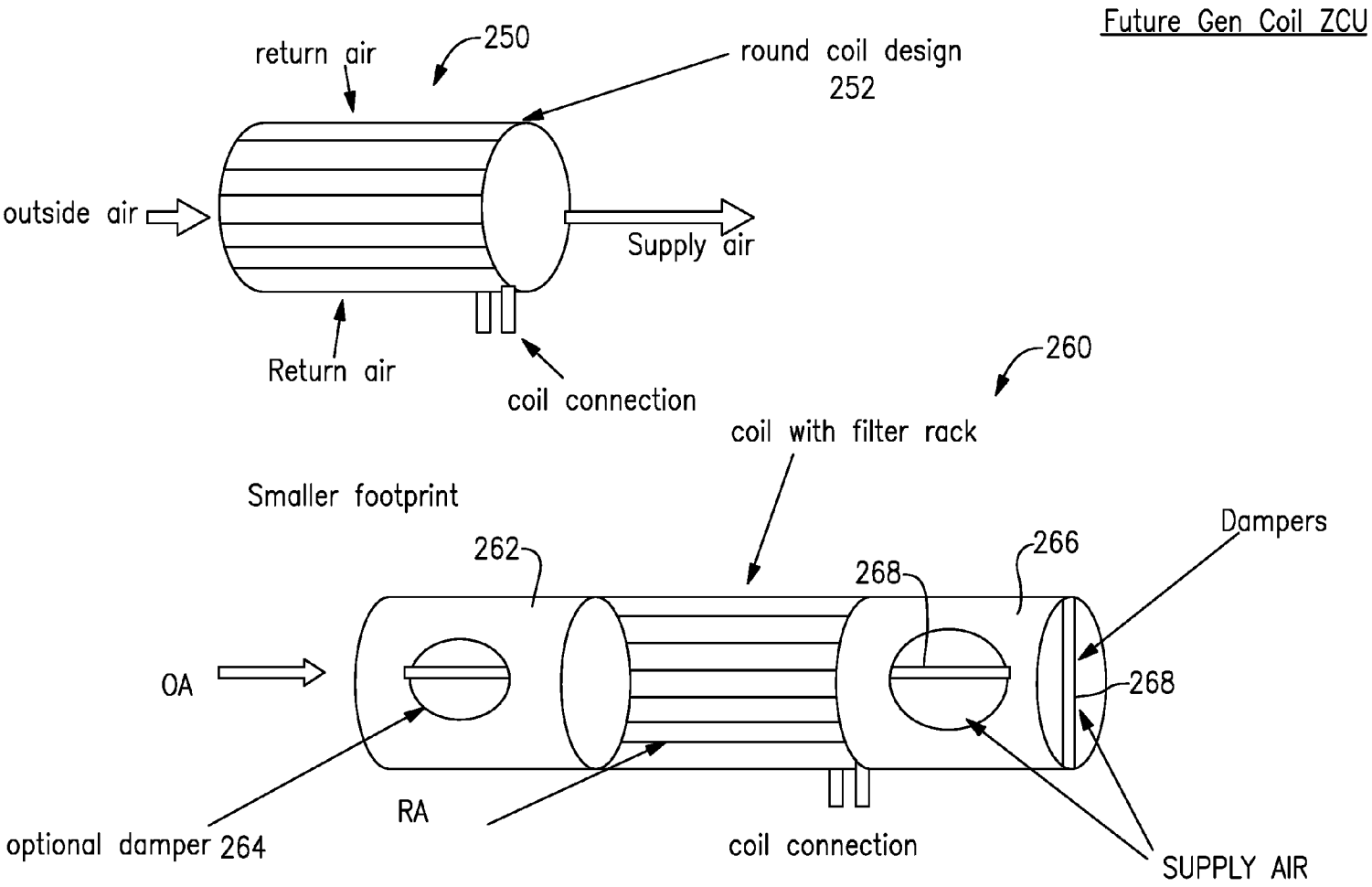
FIG. 18 schematically illustrates HVAC zone control units, in accordance with many embodiments.

FIG. 18 illustrates an HVAC zone control unit 250 and an HVAC zone control unit 260, in accordance with many embodiments. The HVAC zone control unit 250 includes a round coil 252 that provides for direct intake of a return airflow. A supply airflow (e.g., outside air) enters at one end, is mixed with the return airflow to form a mixed airflow, and the mixed airflow exits from the other end of the zone control unit 250. The amount of heat added to, or removed from, the mixed airflow can be used to control the temperature of the mixed airflow as desired. The HVAC zone control unit 260 further includes a supply airflow intake collar 262 that houses an optional supply airflow control damper 264 for controlling the flow rate of the supply airflow (e.g., outside airflow) used. The HVAC zone control unit 260 further includes a supply airflow section 266 that houses one or more mixed airflow dampers 268 for controlling the flow rate of the mixed airflow discharged to one or more serviced building zones.

Figure 19B:
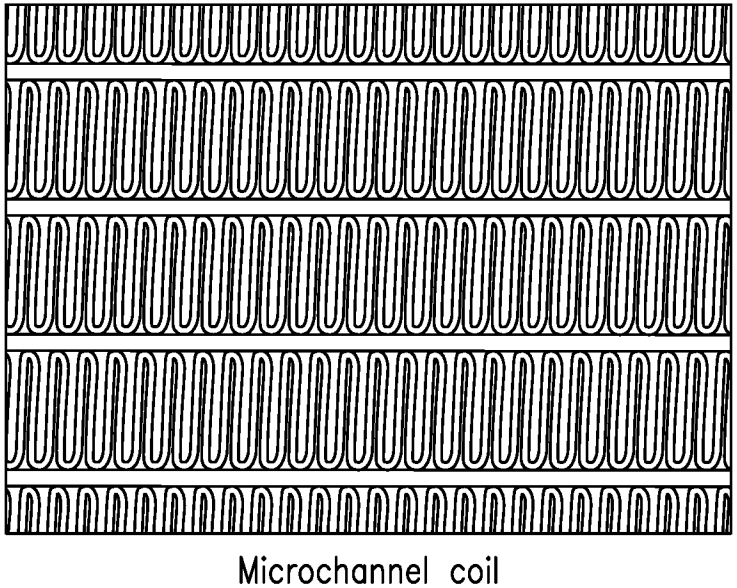
FIGS. 19A and 19B illustrate a micro-channel coil design, in accordance with many embodiments.
Figure 19A:
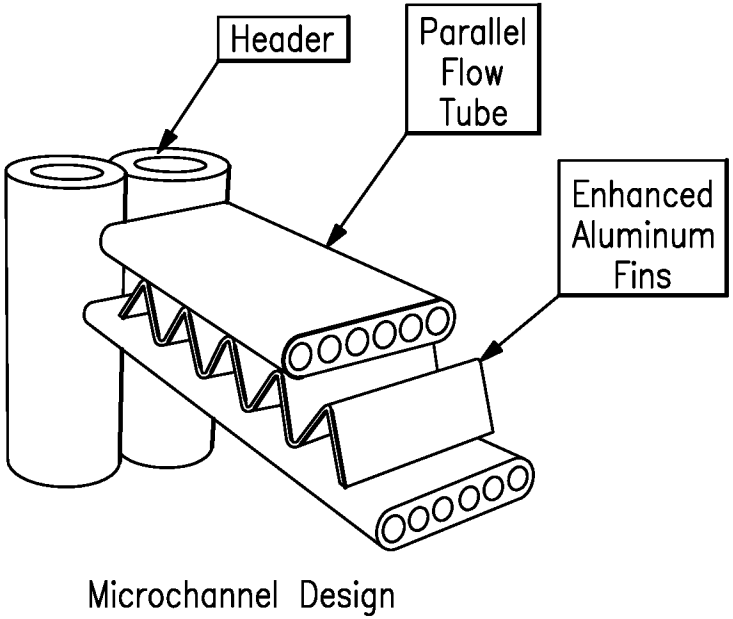

FIGS. 19A and 19B illustrate micro-channel coils that can be used as discussed above. A micro-channel coil can include a plurality of parallel flow tubes through which a working fluid is transferred between headers and enhanced fins for transferring heat to or from the parallel flow tubes to the airflow via enhanced fins, for example, aluminum fins. As discussed above, a micro-channel coil heat exchanger coil can employ a fin arrangement that provides for reduced pressure drop across the coil as compared to industry standard coils, for example, seven to eight fins per inch can be used as compared to the industry standard of 10 fins per inch.

Figure 20:
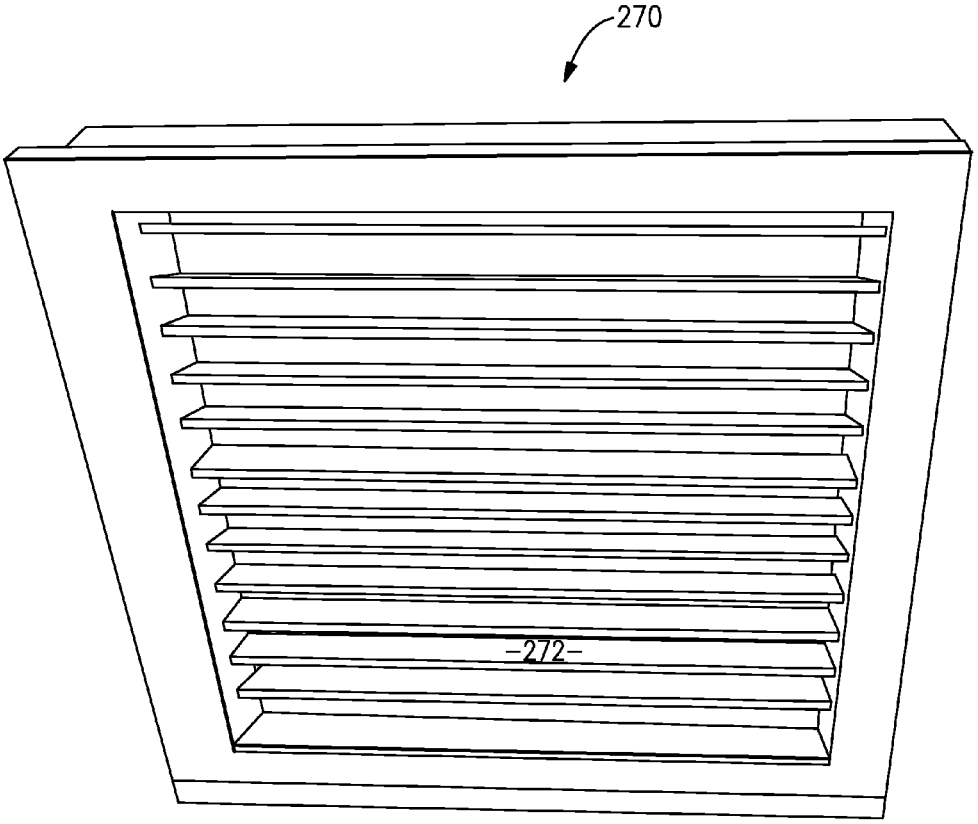
FIG. 20 is a perspective view illustrating a control damper of an HVAC zone control unit, in accordance with many embodiments.

FIG. 20 illustrates a control damper 270 for an HVAC zone control unit. The control damper 270 includes an array of louvers 272 that are controllably actuated to vary the flow rate of the respective airflow through the control damper 270 under the control of a control unit for the zone control unit.

Distribution System Configurations

Figure 21:
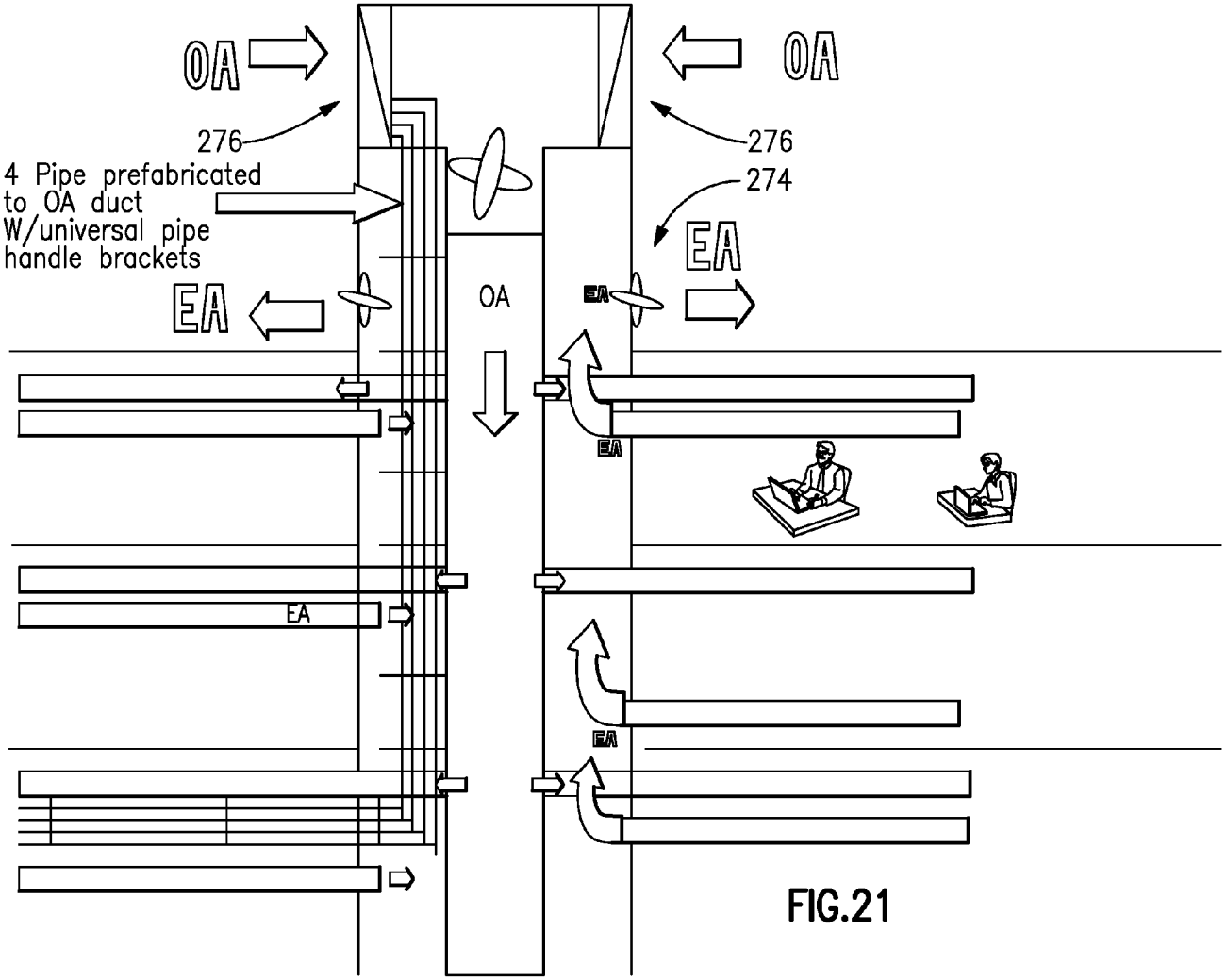
FIG. 21 diagrammatically illustrates the distribution of outside supply air, heated water, cooled water, and the discharge of exhaust air to and from zones of a multi-floor building, in accordance with many embodiments.
Figure 22:
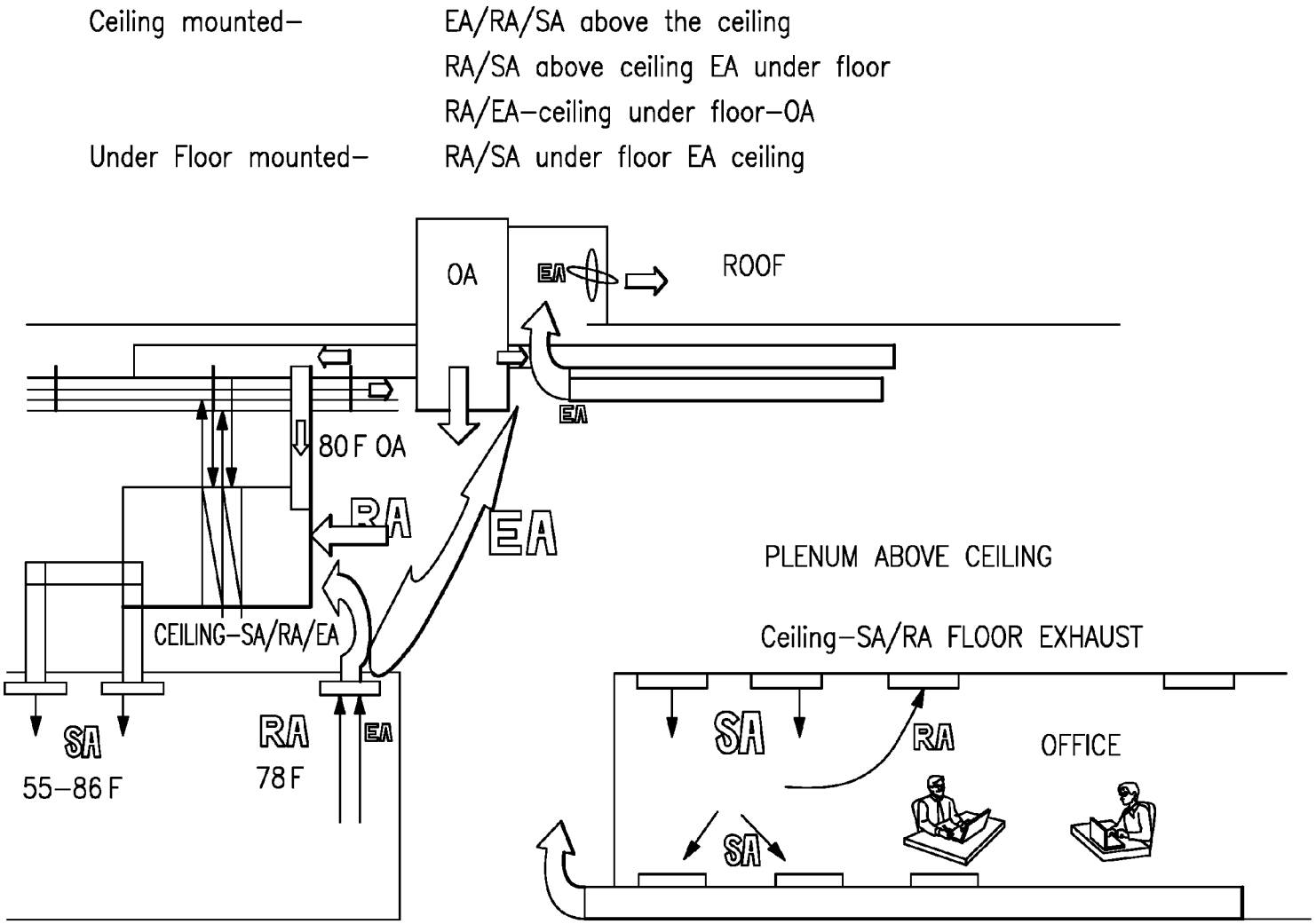
FIGS. 22 and 23 diagrammatically illustrate a number of configurations that can be used for the routing of supply air, return air, and exhaust air in an HVAC system having distributed zone control units, in accordance with many embodiments.
Figure 23:
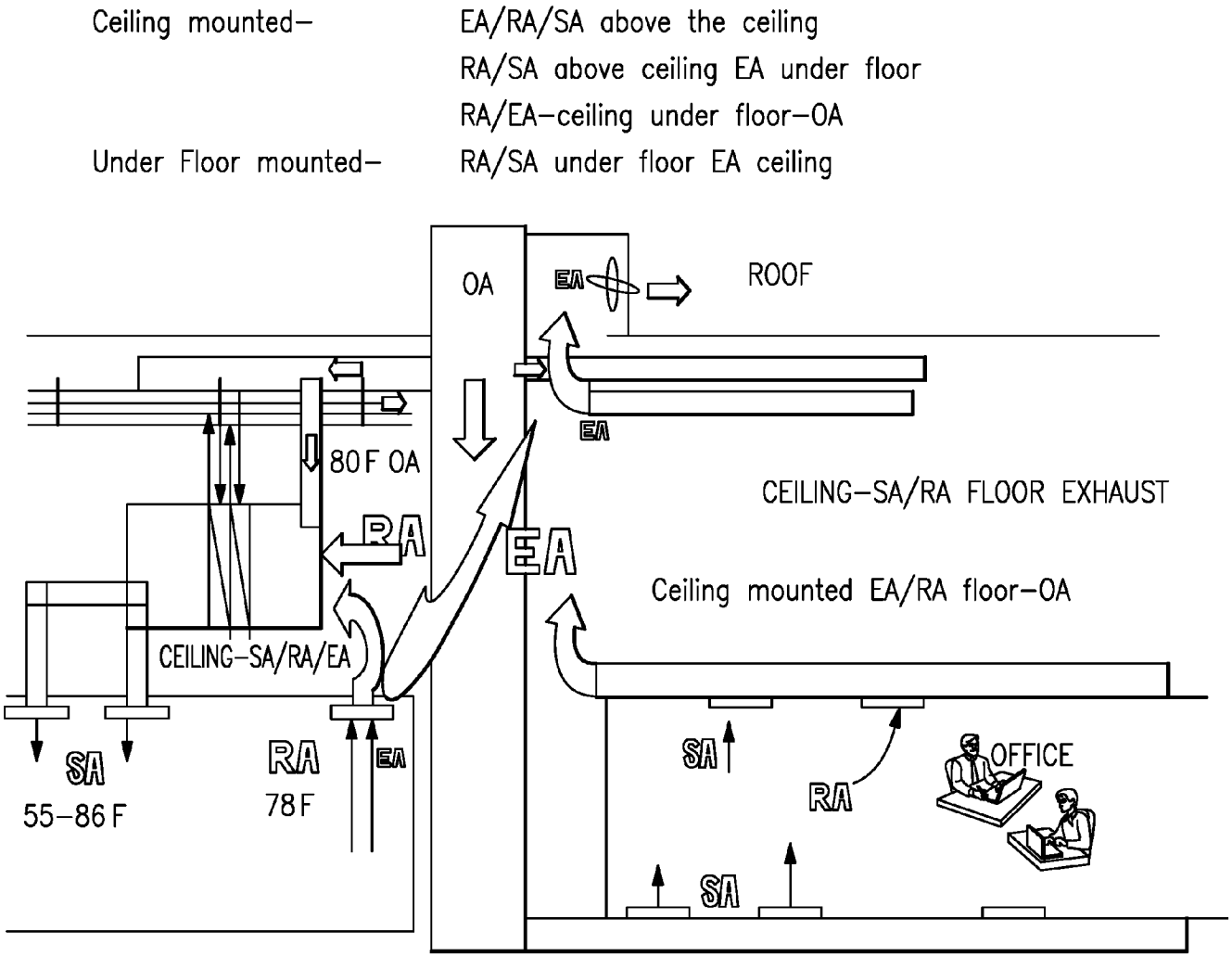

FIG. 21 through FIG. 23 illustrate a number of distribution system configurations that can be used for the routing of the supply airflow (e.g., outside air), the mixed airflows discharged to the serviced zones, the return airflows, and the exhaust airflows. For example, as illustrated in FIG. 21, the horizontally-oriented distribution assemblies used to service the zones on a building floor can be ceiling mounted and the exhaust airflows (EA) from the serviced zones can be discharged into a vertical shaft of the building (e.g., a vertical shaft where the vertically-oriented distribution assembly is installed) for subsequent discharge from the vertical shaft to outside of the building via an exhaust airflow outlet 274. The exhaust airflow outlet 274 can be suitably separated from one or more outside air inlets 276 used to intake outside air for delivery to the distributed zone control units. As illustrated in FIG. 22 and FIG. 23, the mixed airflow can be introduced into the serviced zones from ceiling mounted diffusers and/or floor mounted diffusers, and the exhaust airflows can be extracted from the ceiling and/or the floor.

HVAC Zone Control Unit Control System

Figure 24:
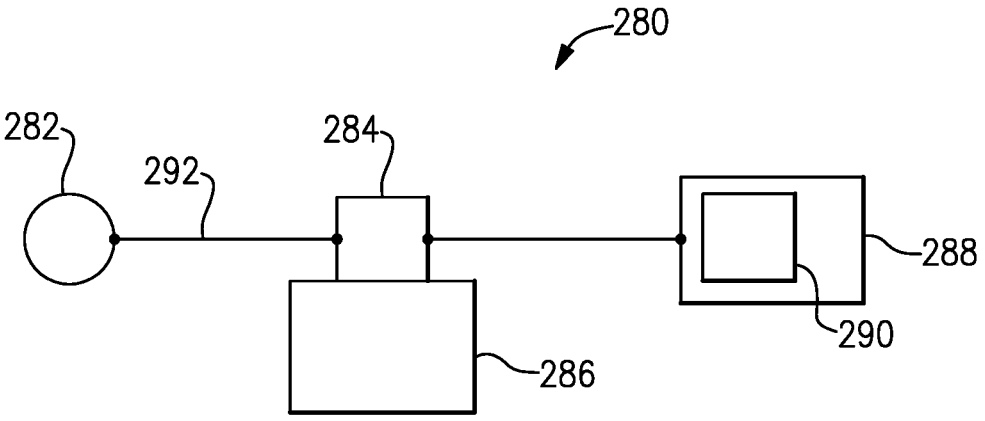
FIG. 24 schematically illustrates a control system for an HVAC zone control unit.

FIG. 24 illustrates a control system 280 for an HVAC zone control unit. The control system 280 includes a thermostat 282, a local control unit 284 configured to control an HVAC zone control unit 286, and a computer 288 hosting a building automation control program 290. The thermostat 282 is coupled with the local control unit 284 via a communication link 292. The local control unit 284 communicates with the computer 288 via a communication link 294. The control system 280 can be used to control the above described HVAC zone control units. Aspects of additional control systems that can be used to control the above described HVAC zone control units are described in numerous patent applications and publications, for example, in U.S. Patent Publication No. 2009/0062964, filed Aug. 27, 2007; U.S. Patent Publication No. 2009/0012650, filed Oct. 5, 2007; U.S. Patent Publication No. 2008/0195254, filed Jan. 24, 2008; U.S. Patent Publication No. 2006/0287774, filed Dec. 21, 2006; U.S. Pat. No. 7,343,226, filed Oct. 26, 2006; U.S. Pat. No. 7,274,973, filed Dec. 7, 2004; U.S. Pat. No. 7,243,004, filed Jan. 7, 2004; U.S. Pat. No. 7,092,794, filed Aug. 15, 2006; U.S. Pat. No. 6,868,293, filed Sep. 28, 2000; and U.S. Pat. No. 6,385,510, filed Dec. 2, 1998, the entire disclosures of which are hereby incorporated herein by reference.

Figure 25:
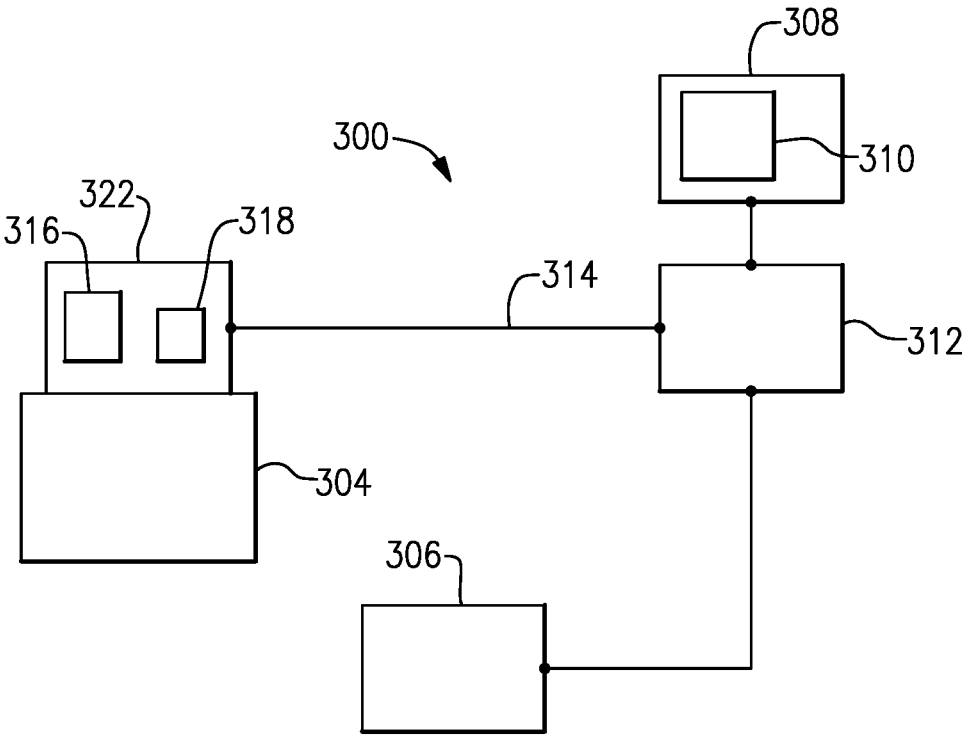
FIG. 25 schematically illustrates a control system for an HVAC zone control unit, the control system comprising a local control unit with an Internet protocol address, in accordance with many embodiments.

FIG. 25 illustrates a control system 300, in accordance with many embodiments, for an HVAC zone control unit, for example, the above described HVAC zone control units. The control system 300 includes an HVAC local control unit 302 configured to control an HVAC zone control unit 304; and one or more external control devices (e.g., an internet access device 306 (for example, laptop, PDA, etc.), a remote server 308 hosting an HVAC control program 310). In many embodiments, the local control unit 302 has its own Internet Protocol (IP) address. The local control unit 302 receives commands from and can supply data to the one or more external control devices via the Internet 312. The local control unit 302 is connected to the Internet 312 via a communication link 314. The communication link 314 can be a hard-wired communication link and can be a wireless communication link. In many embodiments comprising a wireless communication link 314, the local control unit 302 comprises wireless communication circuitry 316 for communicating over the Internet 312 via ZigBee communication protocol and 900 MHz frequency hopping and 802.11 WIFI WiFi X open protocol. In many embodiments, the local control unit 302 comprises a temperature sensor 318. The one or more external control devices can be used to access the IP address for the local control unit 302, optionally enter security information (e.g., user IDs, passwords, security code, etc), and adjust control variables (e.g., temperature, etc.). The control system 300 provides for the elimination of the thermostat and/or provides for remote control of the HVAC zone control unit, and enables both local and/or remote hosting of HVAC control programs. For example, the local control unit 302 can include a memory and processor for storing and executing a control program for the HVAC zone control unit 304. The communication circuitry 316 comprising ZigBee communication protocol and 900 MHz frequency hopping provides a universal board application with open protocol and/or Wi Fi open protocol that would allow the use of these technologies based on application.

Figure 26:
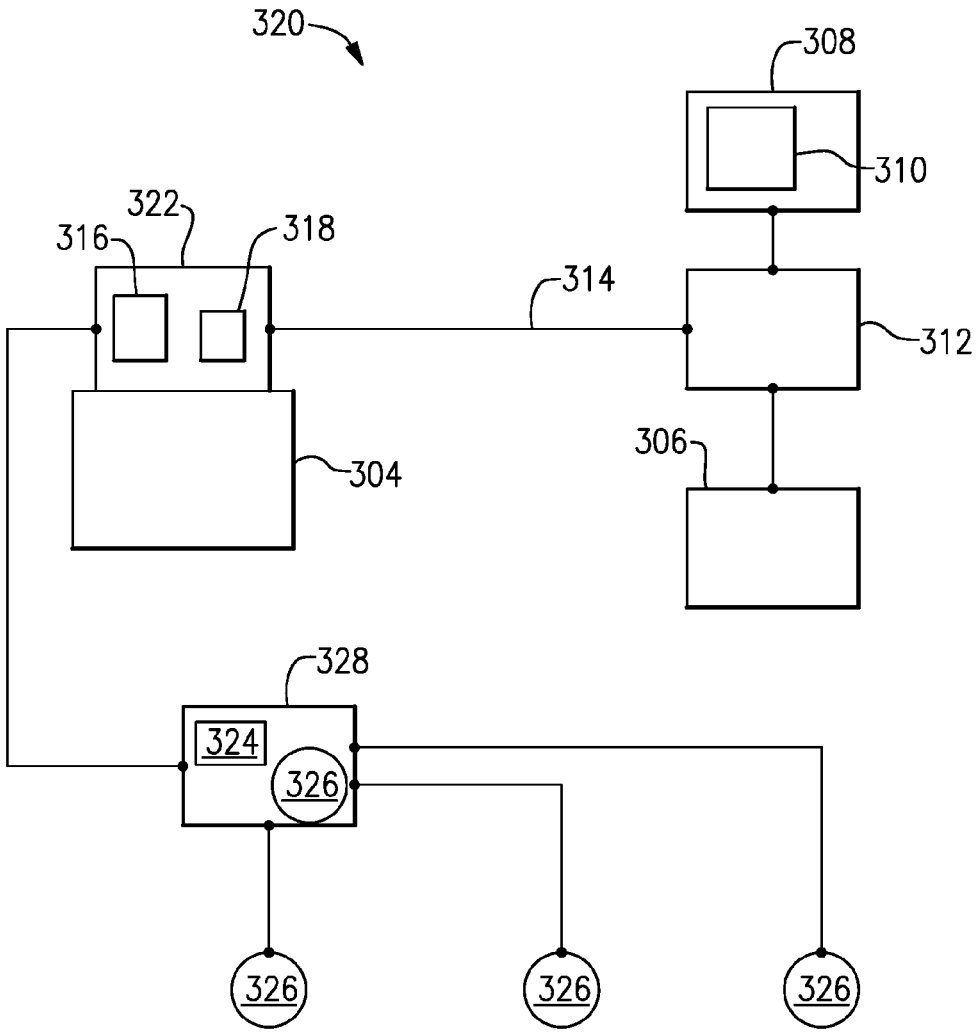
FIG. 26 schematically illustrates a control system for an HVAC zone control unit, the control system comprising a local control unit that receives input from a zone mounted sensor(s) and controls zone lighting, in accordance with many embodiments.

FIG. 26 illustrates a control system 320 for an HVAC zone control unit that includes a local control unit 322 that receives input from a zone mounted sensor(s) 324 and controls zone lights 326, in accordance with many embodiments. The control system 320 includes components used in the control system 300 of FIG. 25, as designated by the like reference numbers used. In addition, the control system 320 further includes the zone mounted sensor(s) 324 and/or one or more of the zone mounted lights 326. For example, the sensor(s) 324 and/or one or more of the zone mounted lights 326 can be mounted on a ceiling mounted return airflow diffuser 328 in one or more building zones serviced by the HVAC zone control unit. The local control unit 322 can be configured to provide control of the zone lights 326, and can be configured to monitor power consumption of the zone lights 326. Thus, the local control unit 322 can control all the HVAC and lights for a serviced zone(s) and also measure the corresponding power consumption for the serviced zone(s). The HVAC, lighting, and/or power consumption information/data can be transferred over the Internet 222 and disseminated, thereby providing occupant level information/data that can be used to control the occupant's zone and implement energy efficient strategies via the remote server 218 or the internet access device 216. The control system 320 enables zone based billing based on zone energy consumption. An application(s) can also be implemented (e.g., on the remote server 218 and/or on an internet access device 216) for the tenant to monitor energy consumption and/or implement energy-efficient HVAC and/or lighting strategies. Such an application(s) can show energy usage and utility rates so that the HVAC and/or the lighting in the zone can be managed commensurate to energy costs during peak and/or off peak hours of the day.

The sensor(s) 324 can include one or more types of sensors (e.g., a temperature sensor, a humidity sensor, a carbon-dioxide ($CO_2$) sensor, a photocell, a motion detector, an infrared sensor, one or more total organic volatile (TOV) sensors, etc.). For example, a $CO_2$ sensor and/or a total organic volatile (TOV) sensor(s) can provide concentration measurement information for a measure compound to the local control unit 212, which can use the concentration measurements to control the operation of the zone control unit, and can communicate the concentration measurements over the Internet 222, for example, to the remote server 218 and/or to the internet access device 216. A motion sensor and/or an infrared sensor can be employed to tailor the operation of the zone control unit in response to room occupancy.

A zone control unit control system can also be configured to provide additional functionality. For example, a control system can provide built in controls features such as tracking utility cost, logging of equipment run time for use in related maintenance and/or replacement of the equipment monitored, tracking of zone control unit operating parameters for use in setting boiler and/or chiller operating temperatures, tracking zone control unit operational parameters for use in trend analysis, etc.

HVAC Methods

Figure 27:
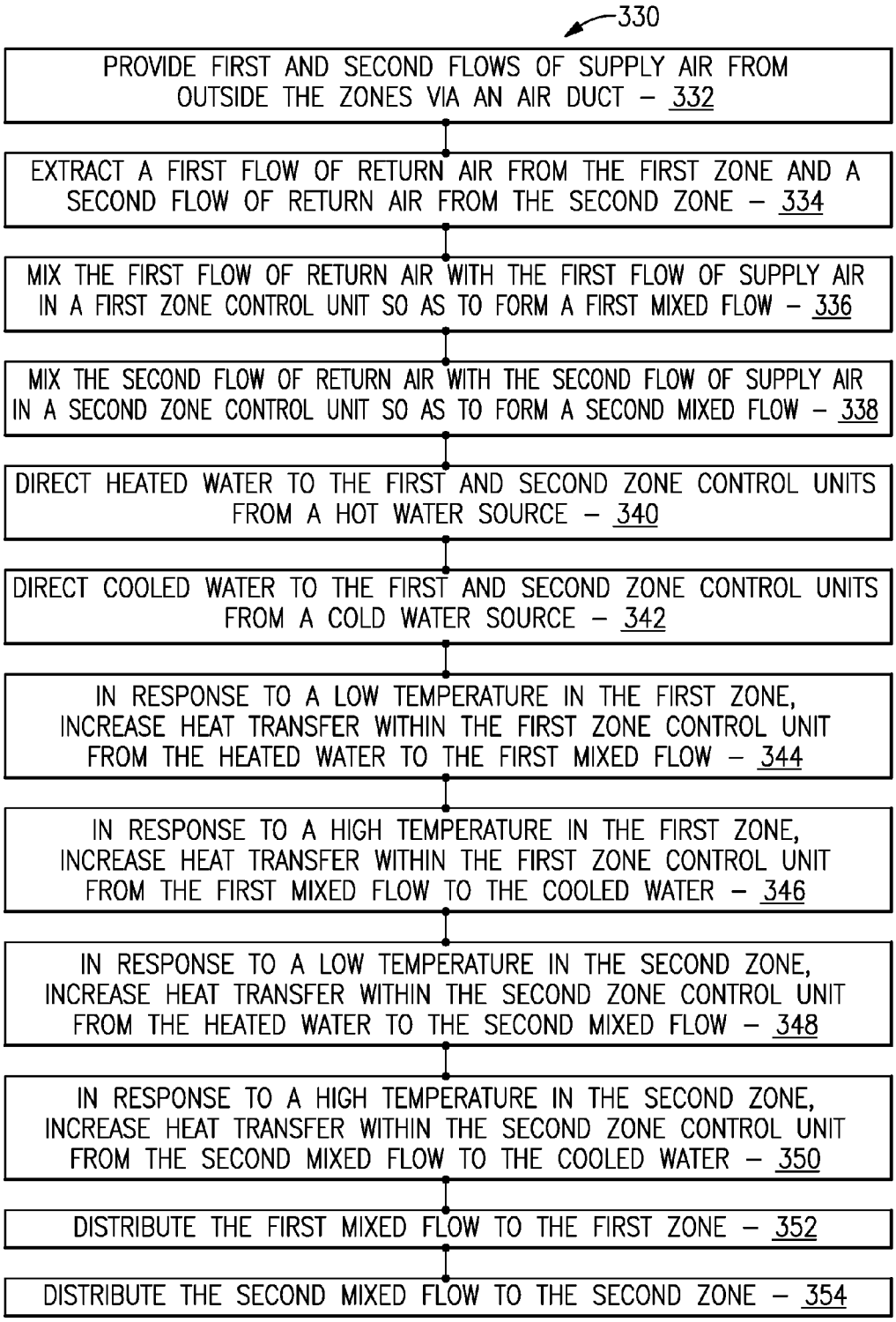
FIG. 27 is a simplified diagrammatic illustration of a method for providing heating, ventilation, and air conditioning (HVAC) to zones of a building, in accordance with many embodiments.

FIG. 27 is a simplified diagrammatic illustration of a method 330 for providing HVAC to zones of a building using distributed zone control units, in accordance with many embodiments. In the method 330, a first zone control unit is used to service a first zone of the building zones, and a second zone control unit is used to service a second zone of the building zones. In step 332, first and second flows of supply air from outside the zones are provided via an air duct. In step 334, a first return airflow is extracted from the first zone and a second return airflow is extracted from the second zone. In step 336, the first return airflow is mixed with the first supply airflow in the first zone control unit so as to form a first mixed flow. In step 338, the second return airflow is mixed with the second supply airflow in the second zone control unit so as to form a second mixed flow. In step 340, heated water is directed to the first and second zone control units from a hot water source (e.g., a boiler). In step 342, cooled water is directed to the first and second zone control units from a cold water source (e.g., a chiller). In step 344, in response to a low temperature in the first zone, heat transfer within the first zone control unit is increased from the heated water to the first mixed airflow. In step 346, in response to a high temperature in the first zone, heat transfer within the first zone control unit is increased from the first mixed airflow to the cooled water. In step 348, in response to a low temperature in the second zone, heat transfer within the second zone control unit is increased from the heated water to the second mixed flow. In step 350, in response to a high temperature in the second zone, heat transfer within the second zone control unit is increased from the second mixed flow to the cooled water. In step 352, the first mixed flow is distributed to the first zone. And in step 354, the second mixed flow is distributed to the second zone. The above-described zone control units can be used in practicing the method 330.

HVAC Zone Control Unit Control Methods

Figure 28:
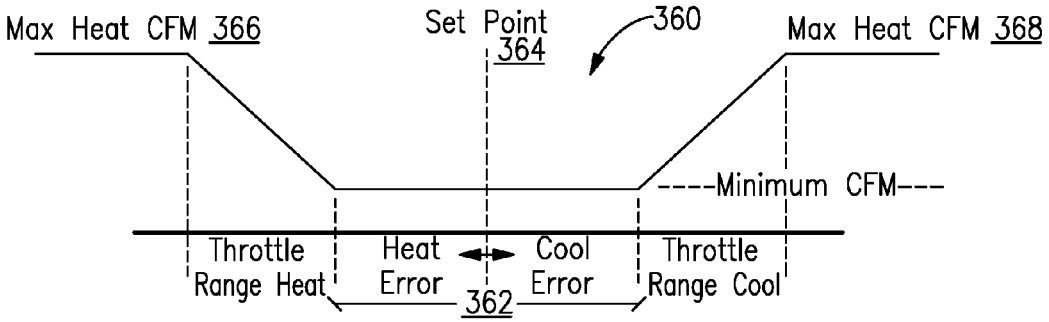
FIG. 28 diagrammatically illustrates an algorithm for controlling a zone control unit for zone cooling and heating, in accordance with many embodiments.

FIGS. 28 through 34 illustrate control algorithms that can be used to control the above-described HVAC zone control units, in accordance with many embodiments. FIG. 28 illustrates a control algorithm 360 that is used to control the speed at which the zone control unit fan(s) operates and the position of the airflow dampers through which the mixed airflow is discharged to the building zones serviced by the HVAC zone control unit. When the measured temperature of the service zoned falls within a specified band 362 encompassing a current temperature set point 364 for the serviced zone, the fan speed(s) and the discharge airflow damper for the serviced zone are set to deliver a minimum airflow rate of the mixed flow to the serviced zone. When the measured temperature of the serviced zone falls outside the specified band 362, the fan speed(s) and the discharge airflow damper position are adjusted to deliver increased flow rates up to the applicable maximum flow rate 366, 368 as a function of the temperature variance involved as illustrated. The control algorithm 360 is implemented in independent loops, one loop for each zone serviced by the zone control unit. Accordingly, the fan speed(s) are set to discharge the mixed flow at a rate equal to the combined rates called for by the serviced zones, and the discharge airflow dampers for the serviced zones are set to distribute the mixed flow according to the determined flow rates for the respective serviced zones.

Figure 29:
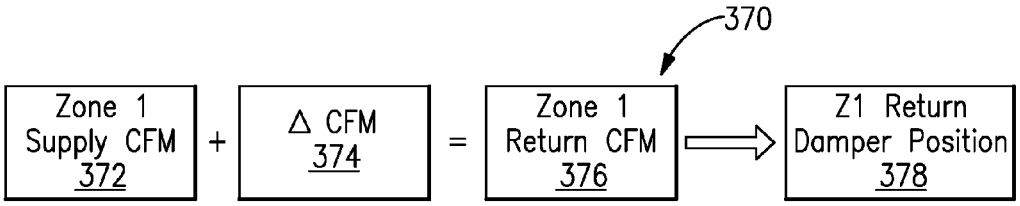
FIG. 29 diagrammatically illustrates an algorithm for controlling a zone control unit for zone pressurization, in accordance with many embodiments.

FIG. 29 illustrates a control algorithm 370 used to control zone pressurization. The algorithm 370 takes the zone discharge airflow rate 372 (i.e., the flow rate that the mixed flow is discharged to the zone) and adds a flow rate offset 374 (which can be either a positive or negative flow rate offset) to obtain a return airflow rate 376 for the zone. The calculated return airflow rate 376 is then used to calculate a return airflow damper position 378 for the zone.

Figure 30:
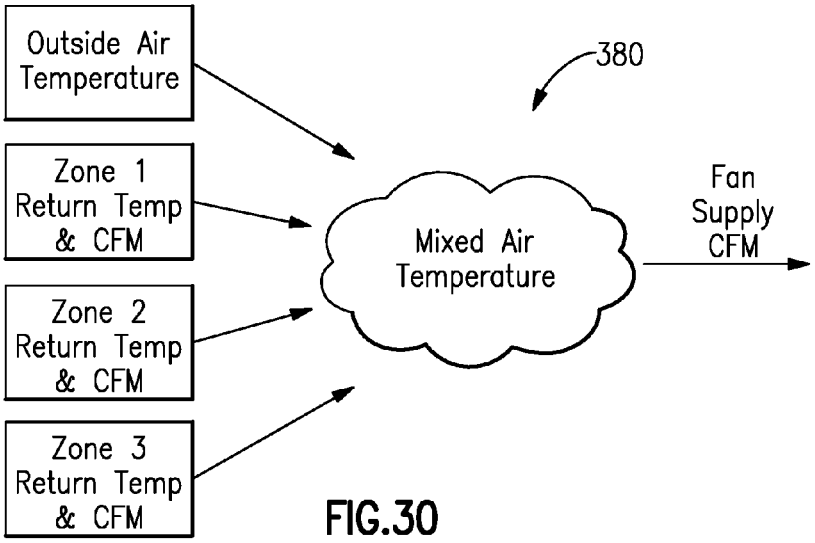
FIG. 30 diagrammatically illustrates an algorithm for controlling a zone control unit for supply air and mixed airflow control, in accordance with many embodiments.

FIG. 30 illustrates an algorithm 380 used to calculate the rate of supply airflow (outside air) that is mixed with the return airflows based on occupancy and space pressurization requirements. The algorithm 380 also establishes minimum rates of the mixed flow discharged to each of the zones serviced by the zone control unit. The minimum zone mixed flow discharge rate can be based on the number of people in the zone. For example, the minimum mixed for discharge rate for a zone (in units of cubic feet per minute (CFM)) can be equal to the flow rate offset 374 of FIG. 29 added to the number of people associated with the zone times 10. The resulting flow rates of the supply airflow and the return airflow rates from each of the serviced zones can be used in combination with the respective temperatures of the supply airflow and the return airflows to determine the temperature of the mixed flow transferred to the heat exchanging coils of the zone control unit.

Figure 31:
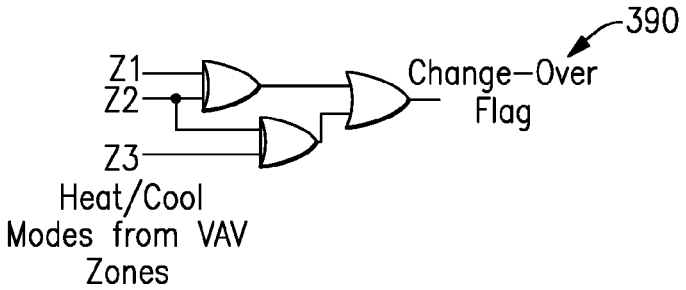
FIG. 31 diagrammatically illustrates an algorithm for determining whether to operate a zone control unit so as to provide both heating and cooling to zones serviced by the zone control unit, in accordance with many embodiments.

FIG. 31 illustrates an algorithm 390 used to determining whether to operate an HVAC zone control unit so as to provide both heating and cooling to zones serviced by the zone control unit. In some instances, the zones serviced by a zone control unit may have conflicting heating/cooling requirements. For example, one serviced zone may have a current temperature and a thermostat setting requiring heat to be added to the zone, while another serviced zone may have a current temperature and a thermostat setting requiring heat to be extracted from the zone. In such an instance, the zone control unit can be operated in a change-over mode in which the mixed flow is alternately heated and cooled and the discharge of the mixed flow is controlled to discharge the heated mixed flow primarily to the zone(s) requiring heat and to discharge the cooled mixed flow primarily to the zone(s) requiring the removal of heat. For example, the flow rate discharged to a particular zone can be maximized when the mode of the zone control unit matches the heating/cooling requirements of the zone and can be minimized when the mode of the zone control unit disagrees with the heating/cooling requirements of the zone. Because zone pressurization may require that a minimum mixed airflow rate be discharged to each zone at all times, a certain amount of reheating and/or re-cooling of the serviced zones may result. To account for this, the zone control unit can be configured with an increased heating/cooling capacity to account for the resulting additional reheating and re-cooling requirements. The algorithm 390 can be periodically executed (e.g., every 10 minutes) to change over between heating and cooling if such a mixed heating/cooling requirement is present. In the absence of such a mixed heating/cooling requirement, the zone control unit remains in the applicable heating/cooling mode.

Figure 32:
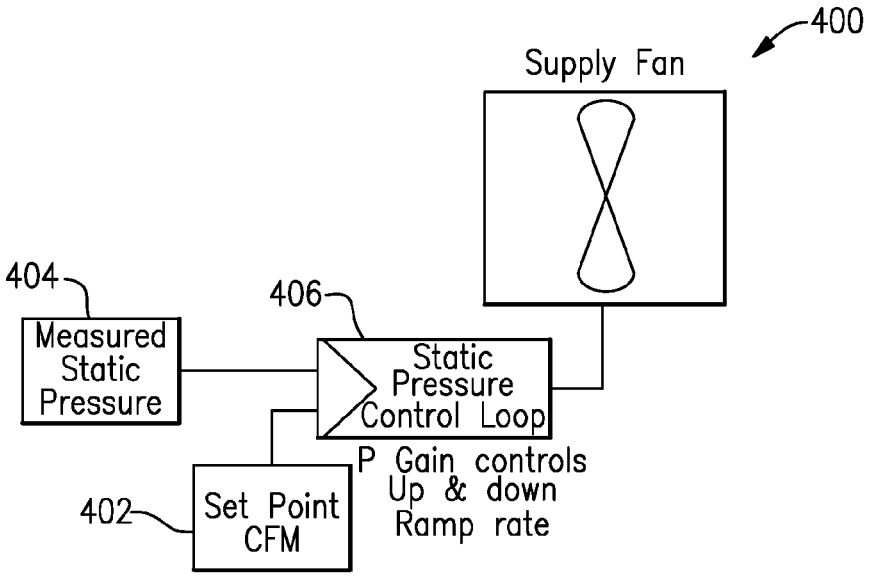
FIG. 32 diagrammatically illustrates an algorithm for controlling a flow rate of supply air, in accordance with many embodiments.

FIG. 32 illustrates an algorithm 400 for controlling the speed of the supply fan(s) used to discharge the mixed airflow to the serviced zones. The supply fan(s) speed 402, determined in the algorithm 360 of FIG. 28, along with a measured static pressure 404 (if employed) are fed into a static pressure control loop 406 that adjusts the supply fan(s) speed 402 up or down according to a standard variable air volume static pressure loop. A static pressure set point can be set at a suitable level just high enough to overcome variable air volume box static pressure drop (e.g., 0.3 inch $H_2O$). A P gain or ramp function can be used to minimize noise due to changing fan speed during a heating/cooling mode changeover.

Figure 33:
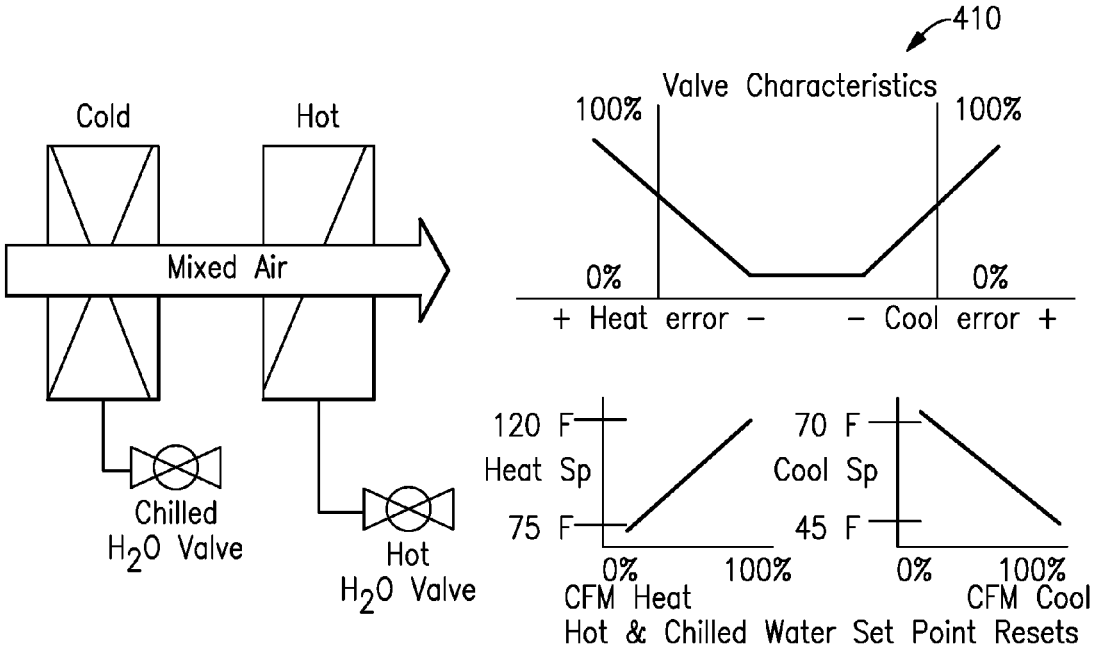
FIG. 33 diagrammatically illustrates an algorithm for controlling the flow of heated and cooled water through heat exchanging coils of a zone control unit, in accordance with many embodiments.

FIG. 33 illustrates an algorithm 410 for controlling the flow rates of heated and cooled water through the heat exchanging coils of an HVAC zone control unit. The flow rates of the heated and cooled water can be controlled via controllable valves and/or via variable flow rate pumps (e.g., a pump with the highly efficient electronically commutated permanent magnet motor (ECM technology)). The algorithm 410 can also be used to control the temperatures of the heated and cooled water directed to the distributed zone control units based on the heating/cooling requirements of one or more of the distributed zone control units.

Figure 34:
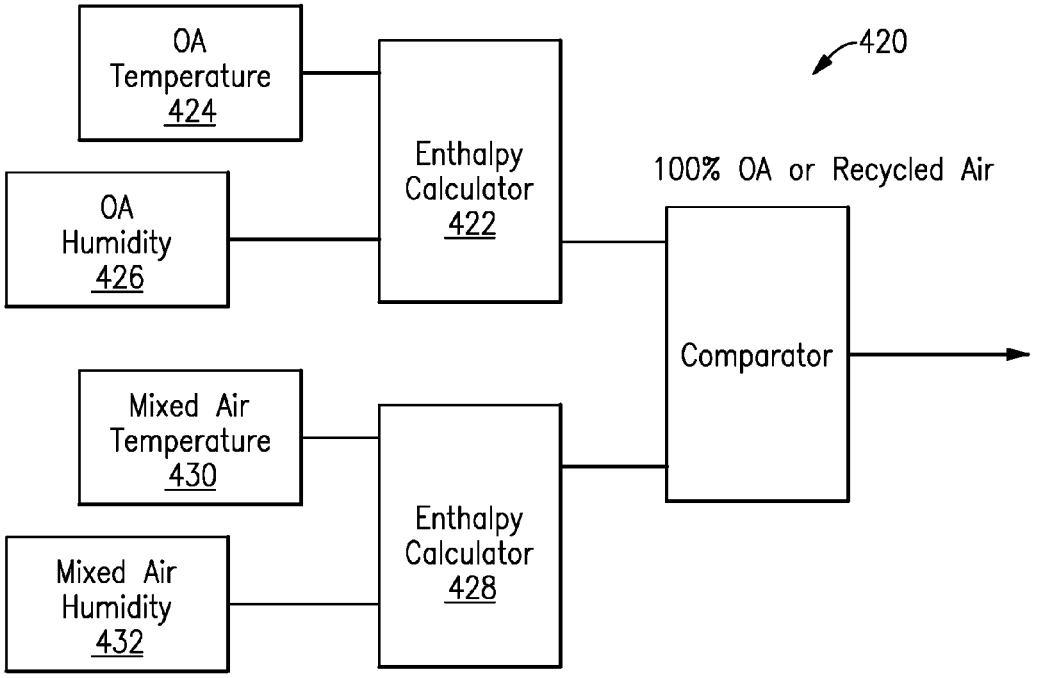
FIG. 34 diagrammatically illustrates an algorithm for controlling a zone control unit to reduce energy usage via the selection of flow rates for return air and supply air, in accordance with many embodiments.

FIG. 34 illustrates an algorithm 420 for controlling an HVAC zone control unit to reduce energy consumption via the selection of flow rates for the return airflow and the supply airflow. A supply airflow enthalpy calculator 422 calculates the enthalpy of the supply airflow based on the supply airflow temperature 424 and the supply airflow humidity 426. Similarly, a return airflow enthalpy calculator 428 calculates the enthalpy of the mixed airflow based on the mixed airflow temperature 430 and the mixed airflow humidity 432. The calculated results can be used to select the airflows so as to minimize energy usage (e.g., by selecting the lowest energy airflow to maximize when cooling is called for and by selecting the highest energy airflow to maximize when heating is called for). Enthalpy can be calculated and/or looked up from a table. While enthalpy can be calculated from temperature and relative humidity as these quantities may be the least expensive to commercially measure, dew point, grains, and wet bulb can also be used. The algorithm 420 may not be usable when return air space pressurization is in use due to the lack of mechanism by which a zone control unit can dump excess air to the outdoors. Such a dumping of excess air to the outdoors can instead be accomplished via an exhaust fan(s).

Figure 35:
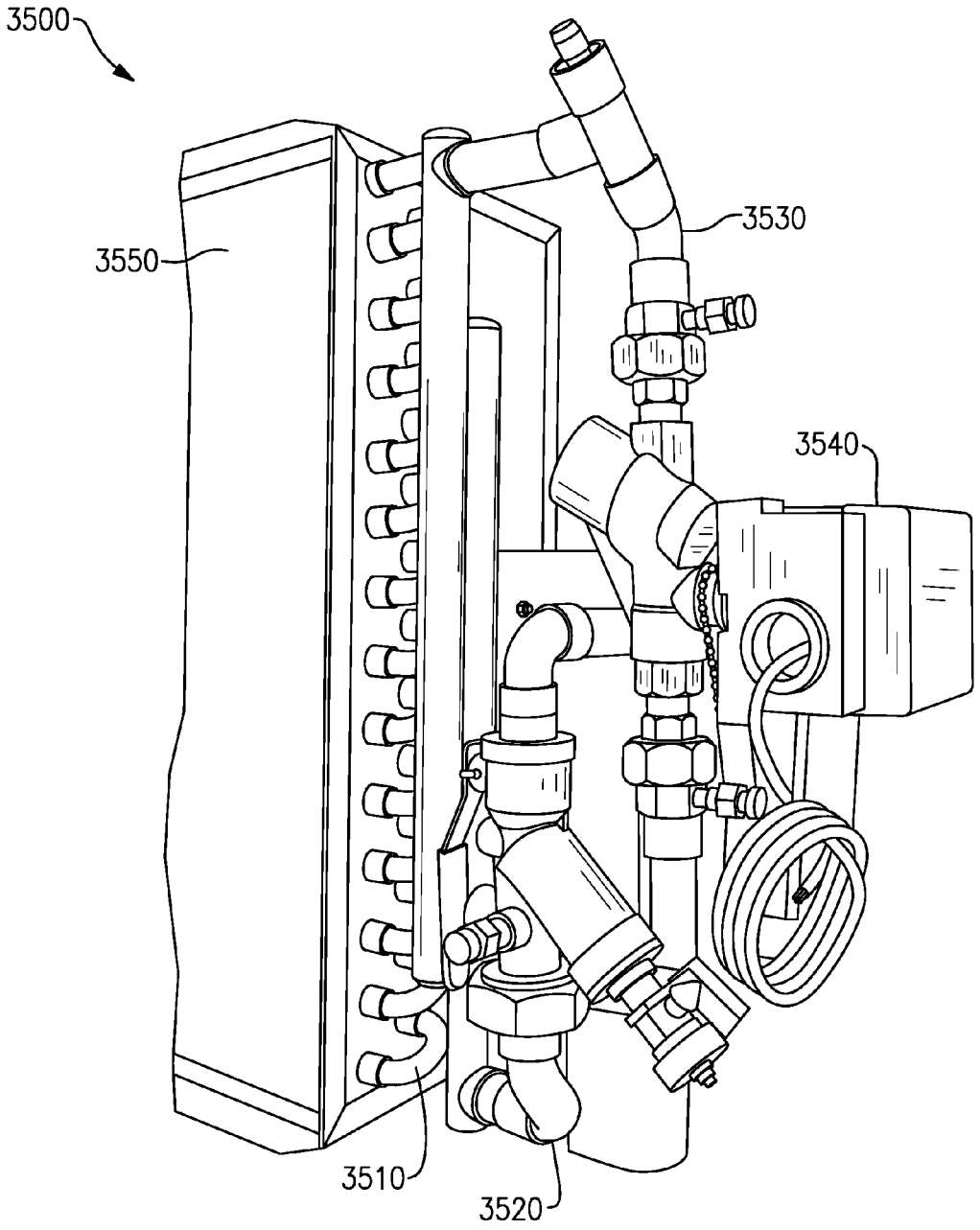
FIGS. 35 and 36 show aspects of HVAC units according to embodiments of the present invention.

FIG. 35 shows an HVAC unit 3500 packaged with ancillary components, including a thermal transfer mechanism 3510, an inlet piping assembly 3520, an outlet piping assembly 3530, and an embedded pump mechanism 3540. The thermal transfer mechanism, piping, pump, and other ancillary components can be pre assembled prior to shipping to a construction job site, with some or all of the assembly optionally being performed using robotic fabrication techniques and systems. Support structures or handles can facilitate handling and installation of the assembled unit, protect the unit and components thereof during shipping, and may also be used to support the unit after installation. The piping may terminate with sealed piping stubs during shipping and installation, with a pressure sensor and gauge allowing quick verification of the piping assembly integrity. Along with heat exchanger/coil units, other HVAC units such as fan coil units and the like may benefit from the systems and methods described herein. Standardization, quality control and tracking, and other improved structures and method described herein may also be implemented with such units.

In some instances, thermal transfer mechanism 3510 includes a heat exchanger coil, which may be pre-fabricated on the HVAC unit along with the piping and pump. In some cases, pump mechanism 3540 includes a variable speed pump. Optionally, pump mechanism 3540 may include a variable speed water pump having an electronically commutated motor (ECM). In operation, one or more water pumps can regulate the rate at which water is circulated through inlet piping assembly 3520, outlet piping assembly 3530, or thermal transfer mechanism 3510, or any combination thereof. In some cases, HVAC units can be constructed with such water pumps such that flow through inlet piping assembly 3520, outlet piping assembly 3530, or thermal transfer mechanism 3510 is controlled without the use of valves such as automatic control valves. Relatedly, HVAC units can be constructed with such water pumps in the absence of balancing valves or pressure drops. ECM motor embodiments can employ DC (e.g. solar) technology, and in some cases can operate to vary the flow into a thermal transfer device from about 0 to about 15+ GPM. In some instances, the water pumps may be circular pumps. In some cases, the water pumps may be operable at flow rates of 3 gpm, 5 gpm, and the like. Some water pumps may provide variable flow rates between about 0 and about 15 gmp, and may be adjustable on a real-time basis. Some water pumps may include check valves or on/off actuators. Exemplary HVAC units can be manufactured by integrating or embedding pump mechanisms 3540 with inlet piping assembly 3520, outlet piping assembly 3530, or thermal transfer mechanism 3510. Hence, HVAC units can provide fluid communication between pump mechanism 3540 and inlet piping assembly 3520, outlet piping assembly 3530, or thermal transfer mechanism 3510. Such constructions can eliminate the need for field fabrication of ancillary components, controls, and the like. In some cases, pump mechanism 3540 may operate on 0 to 10 volts and pulse width modulation as controls outputs. A building automation controls contractor may wire into the pump 0 to 10 volt signal to control the pump based on sensor inputs. In some instances, water pumps can be operable based on input from pressure sensors located at selected positions on an HVAC system. Pump mechanism 3540 can provide a selected flow rate (e.g. gpm) through inlet piping assembly 3520, outlet piping assembly 3530, or thermal transfer mechanism 3510, so as to achieve a desirable energy savings or comfort protocol.

Pump mechanism 3540 can operate to add heat to or remove heat from air circulating through the HVAC unit by routing water through thermal transfer mechanism 3510, the routed water having a temperature higher or lower than the air temperature. For example, a variable rate pump can control a flow rate of water routed through a heat exchanging coil. In some cases, airflow through the HVAC unit can be modulated with a variable speed fan to control a flow rate of the air. As shown in FIG. 35, at least a portion of thermal transfer mechanism 3510 can be disposed or placed within a casing 3550. Similarly, at least a portion of inlet piping assembly 3520 and at least a portion of outlet piping assembly 3530 can be disposed or placed outside of casing 3550.

Figure 36:
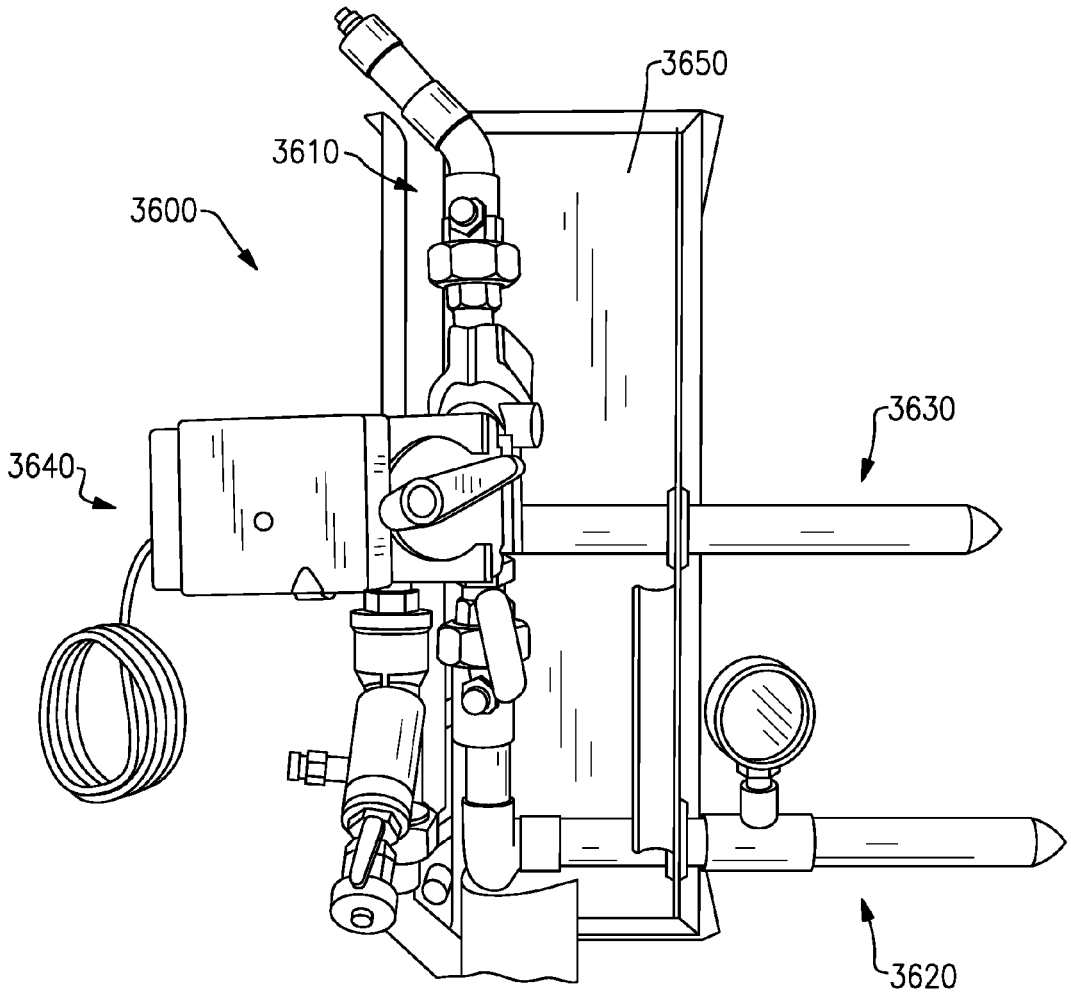

FIG. 36 shows an HVAC unit 3600 packaged with ancillary components, including a thermal transfer mechanism 3610, an inlet piping assembly 3620, an outlet piping assembly 3630, and an embedded pump mechanism 3640. The thermal transfer mechanism, piping, pump, and other ancillary components can be pre assembled prior to shipping to a construction job site, with some or all of the assembly optionally being performed using robotic fabrication techniques and systems. Support structures or handles can facilitate handling and installation of the assembled unit, protect the unit and components thereof during shipping, and may also be used to support the unit after installation. The piping may terminate with sealed piping stubs during shipping and installation, with a pressure sensor and gauge allowing quick verification of the piping assembly integrity. Along with heat exchanger/coil units, other HVAC units such as fan coil units and the like may benefit from the systems and methods described herein. Standardization, quality control and tracking, and other improved structures and method described herein may also be implemented with such units.

In some instances, thermal transfer mechanism 3610 includes a heat exchanger coil, which may be pre-fabricated on the HVAC unit along with the piping and pump. In some cases, pump mechanism 3640 includes a variable speed pump. Optionally, pump mechanism 3640 may include a variable speed water pump having an electronically commutated motor (ECM). In operation, one or more water pumps can regulate the rate at which water is circulated through inlet piping assembly 3620, outlet piping assembly 3630, or thermal transfer mechanism 3610, or any combination thereof. In some cases, HVAC units can be constructed with such water pumps such that flow through inlet piping assembly 3620, outlet piping assembly 3630, or thermal transfer mechanism 3610 is controlled without the use of valves such as automatic control valves. Relatedly, HVAC units can be constructed with such water pumps in the absence of balancing valves or pressure drops. ECM motor embodiments can employ DC (e.g. solar) technology, and in some cases can operate to vary the flow into a thermal transfer device from about 0 to about 15+ gpm. In some instances, the water pumps may be circular pumps. In some cases, the water pumps may be operable at flow rates of 3 gpm, 5 gpm, and the like. Some water pumps may provide variable flow rates between about 0 and about 15 gpm, and may be adjustable on a real-time basis. Some water pumps may include check valves or on/off actuators. Exemplary HVAC units can be manufactured by integrating or embedding pump mechanisms 3640 with inlet piping assembly 3620, outlet piping assembly 3630, or thermal transfer mechanism 3610. Hence, HVAC units can provide fluid communication between pump mechanism 3640 and inlet piping assembly 3620, outlet piping assembly 3630, or thermal transfer mechanism 3610. Such constructions can eliminate the need for field fabrication of ancillary components, controls, and the like. In some cases, pump mechanism 3640 may operate on 0 to 10 volts and pulse width modulation as controls outputs. A building automation controls contractor may wire into the pump 0 to 10 volt signal to control the pump based on sensor inputs. In some instances, water pumps can be operable based on input from pressure sensors located at selected positions on an HVAC system. Pump mechanism 3640 can provide a selected flow rate (e.g. gpm) through inlet piping assembly 3620, outlet piping assembly 3630, or thermal transfer mechanism 3610, so as to achieve a desirable energy savings or comfort protocol.

Pump mechanism 3640 can operate to add heat to or remove heat from air circulating through the HVAC unit by routing water through thermal transfer mechanism 3610, the routed water having a temperature higher or lower than the air temperature. For example, a variable rate pump can control a flow rate of water routed through a heat exchanging coil. In some cases, airflow through the HVAC unit can be modulated with a variable speed fan to control a flow rate of the air. As shown in FIG. 36, at least a portion of thermal transfer mechanism 3610 can be disposed or placed within a casing 3650. Similarly, at least a portion of inlet piping assembly 3620 and at least a portion of outlet piping assembly 3630 can be disposed or placed outside of casing 3650.

Embodiments of the present invention may incorporate aspects of zone control units and other HVAC piping or piping and coil assemblies, methods of installing zone control units and other HVAC piping or piping and coil assemblies, methods of preparing zone control units and other HVAC piping or piping and coil assemblies for delivery, methods of transporting zone control units and other HVAC piping or piping and coil assemblies, methods of mounting zone control units and other HVAC piping or piping and coil assemblies to surfaces such as HVAC duct surfaces, methods of manufacturing or fabricating zone control units and other HVAC piping or piping and coil assemblies, control systems which can be used to control zone control units and other HVAC piping or piping and coil assemblies, quality control methods for zone control units and other HVAC piping or piping and coil assemblies, and bracket or handle configurations which may be used in conjunction with or incorporated into zone control units and other HVAC piping or piping and coil assemblies, such as those described in U.S. Patent Publication Nos. 2003/0085022, 2003/0085023, 2005/0056752, 2005/0056753, 2006/0011796, 2006/0130561, 2006/0249589, 2007/0068226, 2007/0108352, 2007/0262162, 2008/0164006, 2008/0307859, 2009/0057499, and 2010/0252641, the entire disclosures of which are incorporated herein by reference.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A method of installing a heating, ventilation, and air conditioning (HVAC) unit in an HVAC system, the method comprising:

(a) obtaining an HVAC unit manufactured by providing a bracket with mounting features configured to support an inlet piping assembly and an outlet piping assembly;

securing an inlet piping assembly of the HVAC unit to the bracket at a mounting location of the inlet piping assembly;

securing an outlet piping assembly of the HVAC unit to the bracket at a mounting location of the outlet piping assembly;

coupling a thermal transfer mechanism of the HVAC unit with the inlet piping assembly and the outlet piping assembly, wherein at least a portion of the thermal transfer mechanism is positioned along an air flow path disposed within a casing of the HVAC unit and wherein at least a portion of the inlet piping assembly and at least a portion of the outlet piping assembly are disposed exterior to the casing;

mounting a water pump directly on the HVAC unit to provide an embedded pump mechanism on the HVAC unit that is in fluid communication with at least one of the thermal transfer mechanism, the inlet piping assembly, or the outlet piping assembly, the water pump disposed along a fluid path between the mounting location of the inlet piping assembly and the mounting location of the outlet piping assembly;

positioning a fan along the airflow path within the casing;

subsequent to securing the inlet and outlet piping assemblies of the HVAC unit to the bracket, coupling the thermal transfer mechanism of the HVAC unit with the inlet and outlet piping assemblies, and fluidly coupling the water pump along the fluid path between the inlet piping assembly and the outlet piping assembly; and (b) installing the HVAC unit to the HVAC system by mounting the bracket to the HVAC system; and maintaining alignment of the HVAC unit thermal transfer mechanism, the HVAC unit inlet piping assembly, and the HVAC unit outlet piping assembly while mounting the HVAC unit in the HVAC system.

2. The method of claim 1, wherein the water pump comprises a variable rate water pump.

3. The method of claim 1, wherein the water pump comprises a variable rate water pump having an electronically commutated motor.

4. The method of claim 1, wherein the water pump comprises a variable rate water pump operable between about 0 and about 15 gallons per minute.

5. The method of claim 1, wherein the water pump is controlled by pulse width modulation.

6. The method of claim 1, wherein the water pump is controlled by a signal of between about 0 volts and about 10 volts.

7. The method of claim 1, wherein the fan comprises a variable rate fan.

8. The method of claim 1, wherein the fan comprises a variable rate fan having an electronically commutated motor.

9. The method of claim 1, wherein the thermal transfer mechanism, the inlet piping assembly, the outlet piping assembly, and the water pump are pre-fabricated, sealed, and pressurized prior to shipment to a construction site for installation.

10. A method of preparing multiple heating, ventilation, and air conditioning (HVAC) units for delivery to a construction site for installation in an HVAC system, the method comprising:

coupling a first thermal transfer mechanism with a first inlet piping assembly and a first outlet piping assembly, the first inlet piping assembly configured to supply fluid to the first thermal transfer mechanism and the first outlet piping assembly configured to receive fluid from the first thermal transfer mechanism;

mounting a first water pump with a member selected from the group consisting of the first thermal transfer mechanism, the first inlet piping assembly, and the first outlet piping assembly to provide an embedded first water pump;

placing at least a portion of the first thermal transfer mechanism along a first air flow path within a first casing, such that at least a portion of the first inlet piping assembly and at least a portion of the first outlet piping assembly are disposed exterior to the first casing;

positioning a first fan along the first airflow path within the first casing;

coupling a first bracket with the first casing, the first inlet piping assembly at a mounting location of the first inlet piping assembly, and the first outlet piping assembly at a mounting location of the first outlet piping assembly, so as to maintain the first casing, the first inlet piping assembly, and the first outlet piping assembly as components of a first heating, ventilation, and air conditioning (HVAC) unit in positional relationship, the water pump disposed along a fluid path between the mounting location of the first inlet piping assembly and the mounting location of the first outlet piping assembly;

coupling a second thermal transfer mechanism with a second inlet piping assembly and a second outlet piping assembly, the second inlet piping assembly configured to supply fluid to the second thermal transfer mechanism and the second outlet piping assembly configured to receive fluid from the second thermal transfer mechanism;

mounting a second water pump with a member selected from the group consisting of the second thermal transfer mechanism, the second inlet piping assembly, and the second outlet piping assembly to provide an embedded second water pump;

placing at least a portion of the second thermal transfer mechanism along a second air flow path within a second casing, such that at least a portion of the second inlet piping assembly and at least a portion of the second outlet piping assembly are disposed exterior to the second casing;

positioning a second fan along the second airflow path within the second casing; and coupling a second bracket with the second casing, the second inlet piping assembly at a mounting location of the second inlet piping assembly, and the second outlet piping assembly at a mounting location of the second outlet piping assembly, so as to maintain the second casing, the second inlet piping assembly, and the second outlet piping assembly as components of a second heating, ventilation, and air conditioning (HVAC) unit in positional relationship the water pump disposed along a fluid path between the mounting location of the second inlet piping assembly and the mounting location of the second outlet piping assembly.

11. The method of claim 10, wherein the water pump comprises a variable rate water pump.

12. The method of claim 10, wherein the water pump comprises a variable rate water pump having an electronically commutated motor.

13. The method of claim 10, wherein the water pump comprises a variable rate water pump operable between about 0 and about 15 gallons per minute.

14. The method of claim 10, wherein the water pump is controlled by pulse width modulation.

15. The method of claim 10, wherein the water pump is controlled by a signal of between about 0 volts and about 10 volts.

16. The method of claim 10, wherein the fan comprises a variable rate fan.

17. The method of claim 10, wherein the fan comprises a variable rate fan having an electronically commutated motor.

18. The method of claim 10, wherein the first thermal transfer mechanism, the first inlet piping assembly, the first outlet piping assembly, and the first water pump are pre-fabricated, sealed, and pressurized prior to shipment to a construction site for installation.

19. A heating, ventilation, and air conditioning (HVAC) unit for transporting fluid in an (HVAC) system, the HVAC unit comprising:

a thermal transfer mechanism;

an inlet piping assembly coupled with the thermal transfer mechanism for supplying fluid to the thermal transfer mechanism;

an outlet piping assembly coupled with the thermal transfer mechanism for receiving fluid from the thermal transfer mechanism;

a water pump coupled to a member selected from the group consisting of the thermal transfer mechanism, the inlet piping assembly, and the outlet piping assembly to provide an integrated pump mounted on the HVAC unit;

a bracket that maintains the thermal transfer mechanism, the inlet piping assembly, and the outlet piping assembly in positional relationship, wherein the water pump is disposed along a fluid path between a first mounting location between the inlet piping assembly and the bracket and a second mounting location between the outlet piping assembly and the bracket;

a casing defining an airflow path; and a fan disposed along the airflow path within the casing;

wherein at least a portion of the thermal transfer mechanism is disposed along the air flow path within the casing, at least a portion of the inlet piping assembly and at least a portion of the outlet piping assembly are disposed exterior to the casing, and at least a portion of the bracket is disposed exterior to the casing.

20. The HVAC unit of claim 19, wherein the water pump comprises a variable rate water pump having an electronically commutated motor.

21. The HVAC unit of claim 19, wherein the water pump comprises a variable rate water pump operable between about 0 and about 15 gallons per minute.

22. The HVAC unit of claim 19, wherein the fan comprises a variable rate fan having an electronically commutated motor.

23. The HVAC unit of claim 19, wherein the thermal transfer mechanism, the inlet piping assembly, the outlet piping assembly, and the water pump are pre-fabricated, sealed, and pressurized prior to shipment to a construction site for installation.

24. A method of installing a heating, ventilation, and air conditioning (HVAC) unit in an HVAC system, the method comprising:

(a) obtaining an HVAC unit manufactured by providing a bracket with mounting features configured to support an inlet piping assembly and an outlet piping assembly;

securing an inlet piping assembly of the HVAC unit to the bracket at a mounting location of the inlet piping assembly;

securing an outlet piping assembly of the HVAC unit to the bracket at a mounting location of the outlet piping assembly;

coupling a thermal transfer mechanism of the HVAC unit with the inlet piping assembly and the outlet piping assembly, wherein at least a portion of the thermal transfer mechanism is positioned along an air flow path disposed within a casing of the HVAC unit and wherein at least a portion of the inlet piping assembly and at least a portion of the outlet piping assembly are disposed exterior to the casing;

mounting a flow control device directly to the HVAC unit to provide an embedded flow control device on the HVAC unit that is in fluid communication with at least one of the thermal transfer mechanism, the inlet piping assembly, or the outlet piping assembly, wherein the flow control device comprises a member selected from the group consisting of a pump and a control valve and wherein the water pump disposed along a fluid path between the mounting location of the inlet piping assembly and the mounting location of the outlet piping assembly;

positioning a fan along the airflow path within the casing;

subsequent to securing the inlet and outlet piping assemblies of the HVAC unit to the bracket, coupling the thermal transfer mechanism of the HVAC unit with the inlet and outlet piping assemblies, and fluidly coupling the flow control device to along the fluid path between the inlet piping assembly and the outlet piping assembly; and (b) installing the HVAC unit to the HVAC system by mounting the bracket to the HVAC system; and maintaining alignment of the HVAC unit thermal transfer mechanism, the HVAC unit inlet piping assembly, and the HVAC unit outlet piping assembly while mounting the HVAC unit in the HVAC system.

25. The method of claim 24, wherein the thermal transfer mechanism, the inlet piping assembly, the outlet piping assembly, and the flow control device are pre-fabricated, sealed, and pressurized prior to shipment to a construction site for installation.

26. A method of preparing multiple heating, ventilation, and air conditioning (HVAC) units for delivery to a construction site for installation in an HVAC system, the method comprising:

coupling a first thermal transfer mechanism with a first inlet piping assembly and a first outlet piping assembly, the first inlet piping assembly configured to supply fluid to the first thermal transfer mechanism and the first outlet piping assembly configured to receive fluid from the first thermal transfer mechanism;

mounting a first flow control device with a member selected from the group consisting of the first thermal transfer mechanism, the first inlet piping assembly, and the first outlet piping assembly, wherein the first flow control device comprises a member selected from the group consisting of a pump and a control valve to provide an embedded first flow control device;

placing at least a portion of the first thermal transfer mechanism along a first air flow path within a first casing, such that at least a portion of the first inlet piping assembly and at least a portion of the first outlet piping assembly are disposed exterior to the first casing;

positioning a first fan along the first airflow path within the first casing;

coupling a first bracket with the first casing, the first inlet piping assembly at a mounting location of the first inlet piping assembly, and the first outlet piping assembly at a mounting location of the first outlet piping assembly, so as to maintain the first casing, the first inlet piping assembly, and the first outlet piping assembly as components of a first heating, ventilation, and air conditioning (HVAC) unit in positional relationship, the flow control device disposed along a fluid path between the mounting location of the first inlet piping assembly and the mounting location of the first outlet piping assembly;

coupling a second thermal transfer mechanism with a second inlet piping assembly and a second outlet piping assembly, the second inlet piping assembly configured to supply fluid to the second thermal transfer mechanism and the second outlet piping assembly configured to receive fluid from the second thermal transfer mechanism;

mounting a second flow control device with a member selected from the group consisting of the second thermal transfer mechanism, the second inlet piping assembly, and the second outlet piping assembly, wherein the second flow control device comprises a member selected from the group consisting of a pump and a control valve to provide an embedded second flow control device;

placing at least a portion of the second thermal transfer mechanism along a second air flow path within a second casing, such that at least a portion of the second inlet piping assembly and at least a portion of the second outlet piping assembly are disposed exterior to the second casing;

positioning a second fan along the second airflow path within the second casing; and coupling a second bracket with the second casing, the second inlet piping assembly at a mounting location of the second inlet piping assembly, and the second outlet piping assembly at a mounting location of the second outlet piping assembly, so as to maintain the second casing, the second inlet piping assembly, and the second outlet piping assembly as components of a second heating, ventilation, and air conditioning (HVAC) unit in positional relationship, the flow control device disposed along a fluid path between the mounting location of the second inlet piping assembly and the mounting location of the second outlet piping assembly.

27. The method of claim 22, wherein the first thermal transfer mechanism, the first inlet piping assembly, the first outlet piping assembly, and the first flow control device are pre-fabricated, sealed, and pressurized prior to shipment to a construction site for installation.

28. A heating, ventilation, and air conditioning (HVAC) unit for transporting fluid in an (HVAC) system, the HVAC unit comprising:

a thermal transfer mechanism;

an inlet piping assembly coupled with the thermal transfer mechanism for supplying fluid to the thermal transfer mechanism;

an outlet piping assembly coupled with the thermal transfer mechanism for receiving fluid from the thermal transfer mechanism;

a flow control device coupled to a member selected from the group consisting of the thermal transfer mechanism, the inlet piping assembly, and the outlet piping assembly to provide an integrated flow control device mounted on the HVAC unit, wherein the flow control device comprises a member selected from the group consisting of a pump and a control valve;

a bracket that maintains the thermal transfer mechanism, the inlet piping assembly, and the outlet piping assembly in positional relationship, wherein the flow control device is disposed along a fluid path between a first mounting location between the inlet piping assembly and the bracket and a second mounting location between the outlet piping assembly and the bracket;

a casing defining an airflow path; and a fan disposed along the airflow path within the casing;

wherein at least a portion of the thermal transfer mechanism is disposed along the air flow path within the casing, at least a portion of the inlet piping assembly and at least a portion of the outlet piping assembly are disposed exterior to the casing, and at least a portion of the bracket is disposed exterior to the casing.

29. The HVAC unit of claim 28, wherein the thermal transfer mechanism, the inlet piping assembly, the outlet piping assembly, and the flow control device are pre-fabricated, sealed, and pressurized prior to shipment to a construction site for installation.

* * * * *